US005732632A

United States Patent [19]

Oomoto et al.

[11] Patent Number: 5,732,632

[45] Date of Patent: Mar. 31, 1998

[54] METHOD FOR ROLLING RECORDING PAPER, INK SHEET, AND APPARATUS THEREFOR

[75] Inventors: Noboru Oomoto, Toyokawa; Takayuki Yokoyama, Sagamihara; Susumu Nittani, Toyokawa, all of Japan

[73] Assignee: Minolta Co, Ltd., Osaka, Japan

[21] Appl. No.: 648,983

[22] Filed: May 17, 1996

[30] Foreign Application Priority Data

May 19, 1995 [JP] Japan ..... 7-121898

[51] Int. Cl.[6] ..... B41F 1/28

[52] U.S. Cl. ..... 101/483; 271/277; 347/218; 101/415.1; 101/246

[58] Field of Search ..... 101/477, 483, 101/415.1, 485, 232, 246; 400/642, 643, 645, 645.4, 659; 271/277; 347/213, 215, 218, 219, 220, 221

[56] References Cited

U.S. PATENT DOCUMENTS 4,999,649 3/1991 Saji et al. ..... 347/218
5,026,045 6/1991 Wirz et al. ..... 271/277
5,255,056 10/1993 Preszler et al. ..... 101/415.1

FOREIGN PATENT DOCUMENTS 1-216871 8/1989 Japan ..... 347/218
6-328742 11/1994 Japan .
6-328805 11/1994 Japan .
7-58922 3/1995 Japan .

*Primary Examiner*—Christopher A. Bennett
*Attorney, Agent, or Firm*—Burns, Doane, Swecker & Mathis, LLP

[57] ABSTRACT

A method and apparatus for rolling a recording paper is disclosed which is characterized by causing first nipping means disposed on a cylindrical drum to nip one end of the recording paper, rotating the cylindrical drum thereby rolling the recording paper around the cylindrical drum, causing second nipping means to nip the other end of the recording paper, and moving the first nipping means so as to bring the recording paper into close contact with the cylindrical drum. Owing to the construction, the recording paper and the ink sheet can be easily and infallibly brought into close contact with the cylindrical drum.

32 Claims, 47 Drawing Sheets

METHOD FOR ROLLING RECORDING PAPER, INK SHEET, AND APPARATUS THEREFOR

BACKGROUND OF THE INVENTION

This invention relates to a method and apparatus for rolling a recording paper or an ink sheet around a cylindrical drum. It relates to a method and apparatus for rolling a recording paper or ink sheet around the cylindrical drum of a thermal ink transfer printer, for example.

As one mode of operating the thermal ink transfer printer, the method which effects transfer of the dye of an ink sheet (referred to hereinafter occasionally as "donor paper") to a recording paper by placing the recording paper in close contact with the ink sheet and heating a necessary image forming part has been known.

The printing process according to this principle of thermal ink transfer requires to establish close contact between the recording paper and the ink sheet. The reason for this necessity is that insufficient contact will entrain the problem of lowering the efficiency of transfer of the ink and uneven contact will induce the drawback of suffering this unevenness to manifest itself in the density of ink in the produced image.

Among the printers operated by this thermal ink transfer system, the thermal head printer is less susceptible of such problems as mentioned above because it establishes contact between the recording paper and the ink sheet by virtue of the pressing force of a thermal head and implements necessary printing by dint of the heat generated by the thermal head. Incidentally, the case of the laser thermal ink transfer printer which irradiates the ink sheet with a laser beam and consequently induces generation of heat within the ink sheet must rely on some method to establish close contact between the recording paper and the ink sheet because it has no way of utilizing such pressing force as mentioned above.

JP-A-06-191,064, for example, discloses a method which attains the establishment of close contact between the recording paper and the ink sheet by vacuumizing the interior of the drum. As disclosed in the publication, this method utilizes a hollow drum 100 which is provided in the outer surface thereof with numerous suction holes 101 and inside the drum 100 proper thereof with a first decompressing chamber 102 for causing tight adhesion thereto of a recording paper 160 and a second decompressing chamber 103 for causing tight adhesion thereto of a donor paper 161 as shown in FIG. 65*a* and FIG. 65*b* and, by means of the apparatus thus constructed, implements fast adhesion of the recording paper 160 to the hollow drum 100 and also fast adhesion of the donor paper 161 to the recording paper 160 adhering to the hollow drum 100 by decompressing the hollow drum 100 through suction hole areas 104 and 105 which correspond respectively to the decompressing chambers 102 and 103. FIG. 65*a* depicts the cross section of the drum and FIG. 65*b* the surface of the drum.

JP-A-05-239,668, JP-06-198,922, etc. disclose a method which comprises passing a recording paper and an ink sheet through a gap intervening between two adjoining members at least either of which is transparent thereby establishing close contact between the recording paper and the ink sheet and causing a laser beam to pass through the transparent member and impinge on and heat the ink sheet and thereby attaining formation of an image.

Specifically, the invention of JP-A-05-239,668 contemplates adopting an apparatus using two rollers 201 and 202, having one of these two rollers, specifically the roller 202, formed of a transparent material, disposing a lens 203 at a position such that a laser beam 204 emanating from a light source 206 may pass through the roller 202 of the transparent material and focus at a nipping part 205 arising from the contiguity of the two rollers as shown in FIG. 66 and fulfilling formation of an image bye procedure of passing a recording paper 260 and an ink sheet 261 between the two rollers 201 and 202 and thereby enabling them to form close mutual contact and meanwhile expose themselves to the laser beam 204.

In the production of a color print, since this color print is obtained by causing three or four ink sheets to transfer their dyes of different colors one after another to one recording paper, this production requires the plurality of ink sheets to be brought into close contact one after another with the one recording paper.

In the conventional method that attains close contact between a recording paper and an ink sheet by the use of decompressing means disposed in a drum, therefore, the drum requires to be provided therein with two decompressing chambers capable of independent control for the purpose of enabling the plurality of ink sheets to be severally brought into close contact with the one recording paper and then separated therefrom. As a result, the apparatus suffers complication of construction. Further, the apparatus has the problem of entrailing a dimensional increase because it necessitates use of a vacuum pump. The use of the vacuum pump also poses the problem of necessitating adoption of a measure for keeping the vacuum pump from emitting noise while in operation.

The method which relies on transparent members to nip a recording paper and an ink sheet together and thereby establish close contact therebetween is at a disadvantage in not enabling the drum to be operated at a high speed during the course of printing because the drum, when rotated at a high speed, induces a slip between the recording paper and the ink sheet. Further, the fact that the ink sheet is also nipped by the transparent members entrains the problem that the heat generated in the ink sheet easily escapes via the transparent members possibly to the extent of degrading the efficiency of transfer of the ink from the ink sheet. The inevitable projection of the laser beam through the transparent member has the possibility of obscuring the focal point of the laser beam. To preclude this possibility, the transparent member to be used requires to possess very high transparency and freedom from distortion. Thus, the apparatus suffers a rise in cost.

SUMMARY OF THE INVENTION

It is an object of this invention to provide, for the elimination of such problems of the prior art as mentioned above, a method for rolling a recording paper and/or an ink sheet which method is capable of simply and infalliably establishing close contact between the recording paper and the ink sheet and an apparatus for fulfilling this method.

To accomplish the object mentioned above, this invention provides a method for rolling a recording paper around a rotatable cylindrical drum, which method is characterized by comprising a first step for causing first nipping means provided on the circumference of the cylindrical drum to nip one end of the recording paper, a second step for starting rotation of the cylindrical drum subsequently to the first step and thereby causing the recording paper to be rolled around the cylindrical drum, a third step for causing second nipping means provided on the circumference of the cylindrical drum to nip the other end of the recording paper subsequently to the second step, and a fourth step for moving the first nipping means or the second nipping means so as to force the recording paper into close contact with the cylindrical drum. Owing to the construction described above, the method of this invention for rolling the recording paper causes the first and the second nipping means to nip the leading and the trailing ends of the recording paper and then moves the first or the second nipping means so as to draw the recording paper and bring it into close contact with the periphery of the cylindrical drum.

To accomplish the object mentioned above, this invention further provides an apparatus for rolling a recording paper on a rotatable cylindrical drum, which apparatus is characterized by comprising first nipping means disposed on the circumference of the cylindrical drum and adapted to nip one end of the recording paper, second nipping means disposed on the circumference of the cylindrical drum and adapted to nip the other end of the recording paper, and moving means for moving the first or the second nipping means so as to bring the recording paper into close contact with the cylindrical drum.

Owing to the construction described above, the apparatus of this invention for rolling the recording paper causes the first and the second nipping means to nip the leading and the trailing ends of the recording paper and enables the moving means to move the first or the second nipping means so as to draw the recording paper and bring it into close contact with the periphery of the cylindrical drum.

To accomplish the object described above, this invention further provides a method for rolling a recording paper and an ink sheet around a rotatable cylindrical drum, which method is characterized by comprising a first step for causing first nipping means disposed on the circumference of the cylindrical drum to nip one end of the recording paper, a second step for rotating the cylindrical drum subsequently to the first step thereby rolling the recording paper around the cylindrical drum, a third step for causing second nipping means disposed on the circumference of the cylindrical drum subsequently to the second step to nip the other end of the recording paper, a fourth step for moving the first or the second nipping means subsequently to the third step thereby bringing the recording paper into close contact with the cylindrical drum, a fifth step for causing third nipping means disposed on the circumference of the cylindrical drum between the first and the second nipping means subsequently to the fourth step to nip one end of the ink sheet, a sixth step for rotating the cylindrical drum subsequently to the fifth step thereby rolling the ink sheet around the cylindrical drum, a seventh step for causing fourth nipping means disposed on the circumference of the cylindrical drum between the first and the second nipping means subsequently to the fourth step to nip the other end of the ink sheet, and an eighth step for moving the third or the fourth nipping means subsequently to the seventh step so as to bring the recording paper into close contact with the cylindrical drum.

According to the construction, the method of this invention for rolling the recording paper first causes the first and the second nipping means to nip the leading and the trailing ends of the recording paper on the cylindrical drum, moves the first or the second nipping means so as to draw the recording paper and bring it into close contact with the periphery of the cylindrical drum, then causes the third and the fourth nipping means to nip the leading and the trailing ends of the ink sheet on the cylindrical drum, and moves the third or the fourth nipping means so as to draw the ink sheet and bring it into close contact with the recording paper.

To accomplish the object described above, this invention further provides an apparatus for rolling a recording paper and an ink sheet around a rotatable cylindrical drum, which apparatus is characterized by comprising first nipping means disposed on the circumference of the cylindrical drum and adapted to nip one end of the recording paper, second nipping means disposed on the circumference of the cylindrical drum and adapted to nip the other end of the recording paper, first moving means for moving the first or the second nipping means so as to bring the recording paper into close contact with the cylindrical drum, third nipping means disposed on the circumference of the cylindrical drum between the first and the second nipping means and adapted to nip one end of the ink sheet, fourth nipping means disposed on the circumference of the cylindrical drum between the first and the second nipping means and adapted to nip the other end of the ink sheet, and second moving means for moving the third or the fourth nipping means so as to bring the ink sheet into close contact with the cylindrical drum.

According to the construction described above, the apparatus of this invention for rolling the recording paper enables the first and the second nipping means to nip the leading and the trailing ends of the recording paper on the cylindrical drum and causes the first moving means to move the first or the second nipping means so as to draw the recording paper and bring it into close contact with the periphery of the cylindrical drum. It also causes the third and the fourth nipping means disposed between the first and the second nipping means to nip the leading and the trailing ends of the ink sheet on the cylindrical drum and further causes the second moving means to move the third or the fourth nipping means so as to draw the ink sheet and bring into close contact with the ink sheet.

DETAILED DESCRIPTION OF THE INVENTION

Now, one embodiment of this invention will be described below with reference to the accompanying drawings.

FIG. 1 is a diagram of an apparatus for rolling a recording paper and an ink sheet as an embodiment of this invention.

Figure 1B:
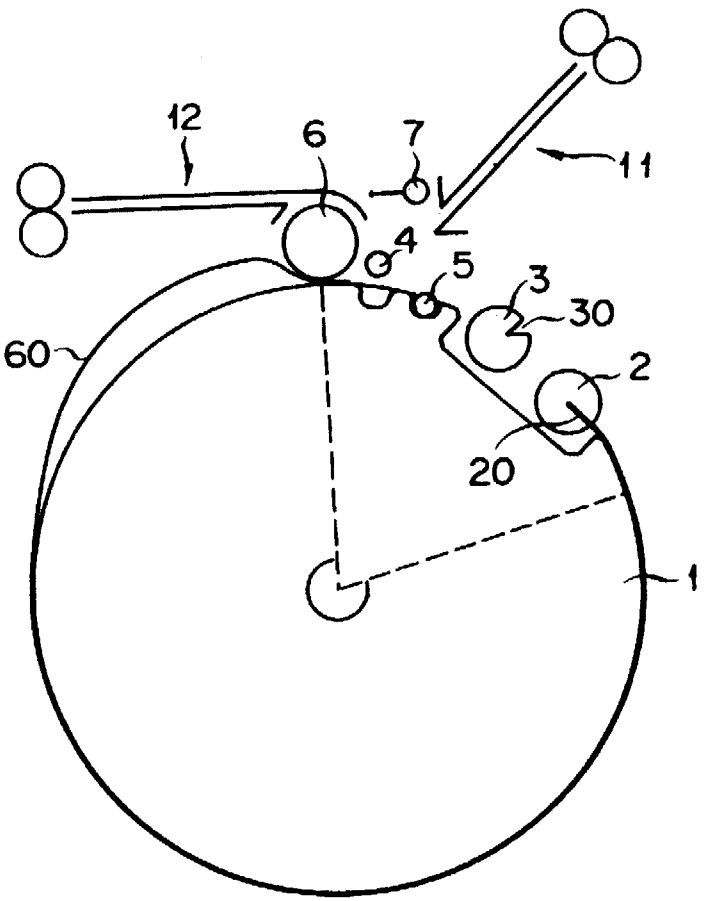
FIG. 1*a* and 1*b* are diagrams for aiding in the description of a rolling apparatus as one embodiment of this invention.
Figure 1A:
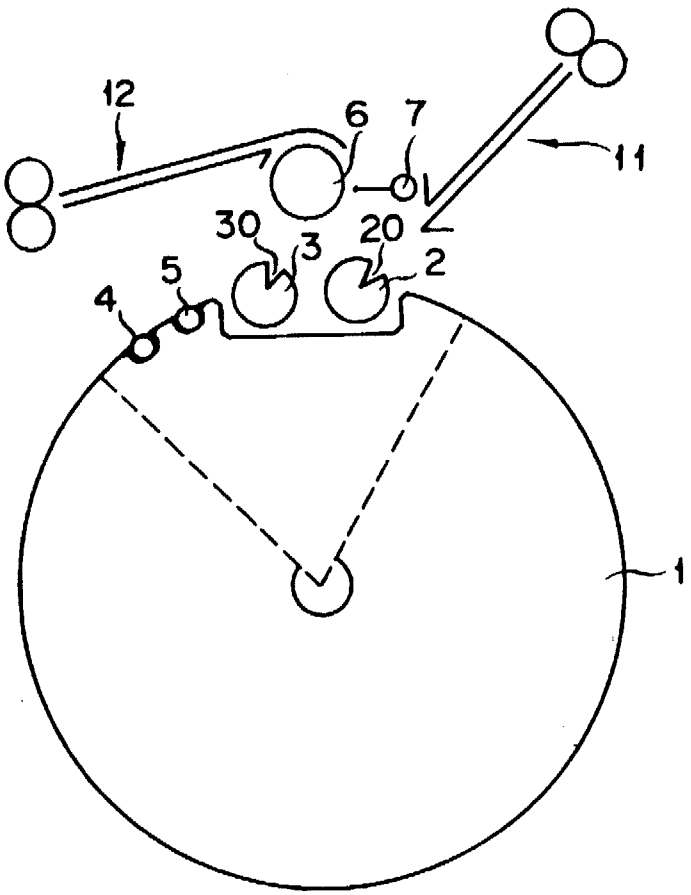

This rolling apparatus, as shown in FIG. 1*a*, is provided on the circumference of a cylindrical drum 1 serving to effect main scanning with a leading end chuck 20 for nipping one end of a recording paper fed from a feed device 11 for feeding a recording paper and an ink sheet and also provided with a winding roller 2 for winding up the recording paper, a trailing end chuck 4 for nipping the trailing end of the recording paper, a leading end chuck 30 for nipping an ink sheet fed from the feed device 11, a winding roller 3 for winding up the ink sheet, and a trailing end chuck 5 for nipping the trailing end of the ink sheet.

The operation of this apparatus, roughly as shown in FIG. 1*b*, comprises first the feed device 11 feeding a recording paper 60, the leading end chuck 20 of the winding roller 2 nipping the recording paper 60, the drum 1 being rotated and consequently enabled to roll the recording paper 60 around the drum 1, the trailing end chuck 4 nipping the trailing end of the recording paper, then the winding roller 2 being rotated and the leading end chuck 20 thereof consequently being moved to draw the recording paper and bring it into close contact with the drum 1.

Similarly it comprises the feed device 11 feeding an ink sheet, a leading end chuck 30 of the winding roller 3 nipping the leading end of the ink sheet, the drum 1 being rotated and consequently enabled to roll the ink sheet on the recording paper around the drum 1, the trailing end chuck 5 nipping the trailing end of the ink sheet, and then the winding roller 3 being rotated and the leading end chuck 30 thereof consequently being moved to draw the ink sheet and bring it into close contact with the drum 1 across the recording paper. As a result, the ink sheet comes into close contact with the image-receiving surface of the recording paper.

As a motor for rotating the drum 1, a step motor is adopted for the purpose of ensuring accuracy of the rotation of the drum 1. The drum 1 is provided with an initial drum position sensor capable of detecting the fact that the drum 1 assumes a stated position.

The winding rollers 2 and 3 are similar in mechanism. The mechanism, for example, comprises a rotary shaft 21, a spring member 22 having one end thereof attached to the rotary shaft 21 with a screw 23 and having the shank thereof wound around the rotary shaft 21, and a leading end chuck 20 (or 30) formed by splitting the spring member 22 as shown in FIG. 2.

Figure 2C:
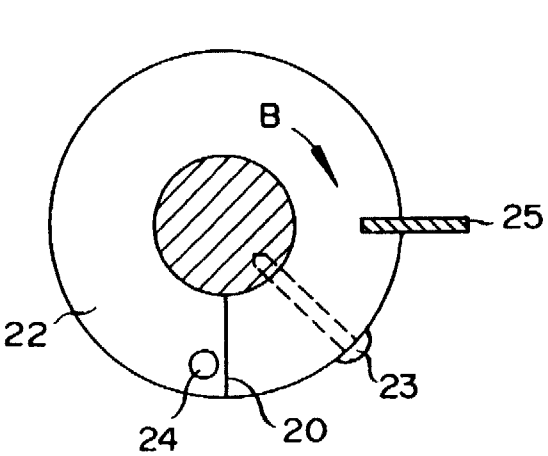
FIG. 2*a*, 2*b*, and 2*c* are diagrams showing one example of a winding roller to be used in the rolling apparatus of the embodiment mentioned above.
Figure 2B:
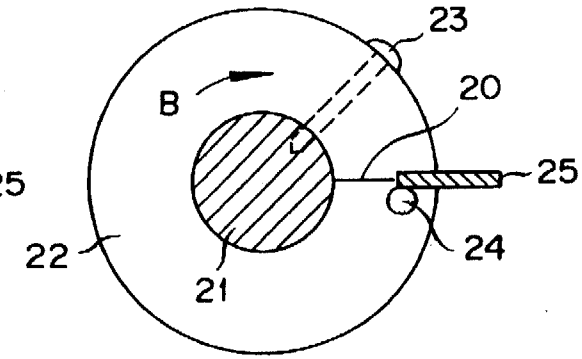
Figure 2A:
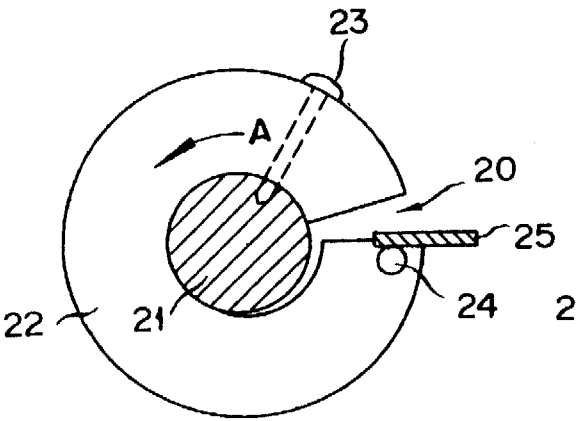

As respects the operation of this mechanism, a pin 24 disposed at one end of the leading end chuck 20 (or 30) is caught on a hooking bar 25 disposed on the drum 1 in consequence of the rotation of the rotary shaft 21 in the direction of an arrow A shown in the diagram and the leading end chuck 20 (or 30) is opened as shown in FIG. 2*a*. In the resulting state of the mechanism, the recording paper or the ink sheet is fed. The leading end chuck 20 (or 30) is closed so as to nip the recording paper or the ink sheet in consequence of the rotation of the rotary shaft 21 of the winding roller in the direction of an arrow B shown in FIG. 2*b*. Then, by the fact that the rotary shaft 21 is rotated in the direction of the arrow B, the recording paper or the ink sheet is drawn and brought into close contact with the drum 1 as shown in FIG. 2*c*.

FIG. 3 shows the winding rollers 2 and 3 in another construction. They each comprise a rotary member 32 provided in a part thereof with a notched part 35 and adapted to be rotated by an eccentric rotary shaft 31 and a spring member 34 having one end thereof held in contact with the notched part 35 and the other end thereof attached with a screw to the rotary member 32 and disposed so as to wrap around the periphery of the rotary member 32. The gap between one wall surface of the notched part 35 of the rotary member 32 and the spring member 34 constitutes the leading end chuck 20 (or 30).

Figures 3A, 3B, 3C:
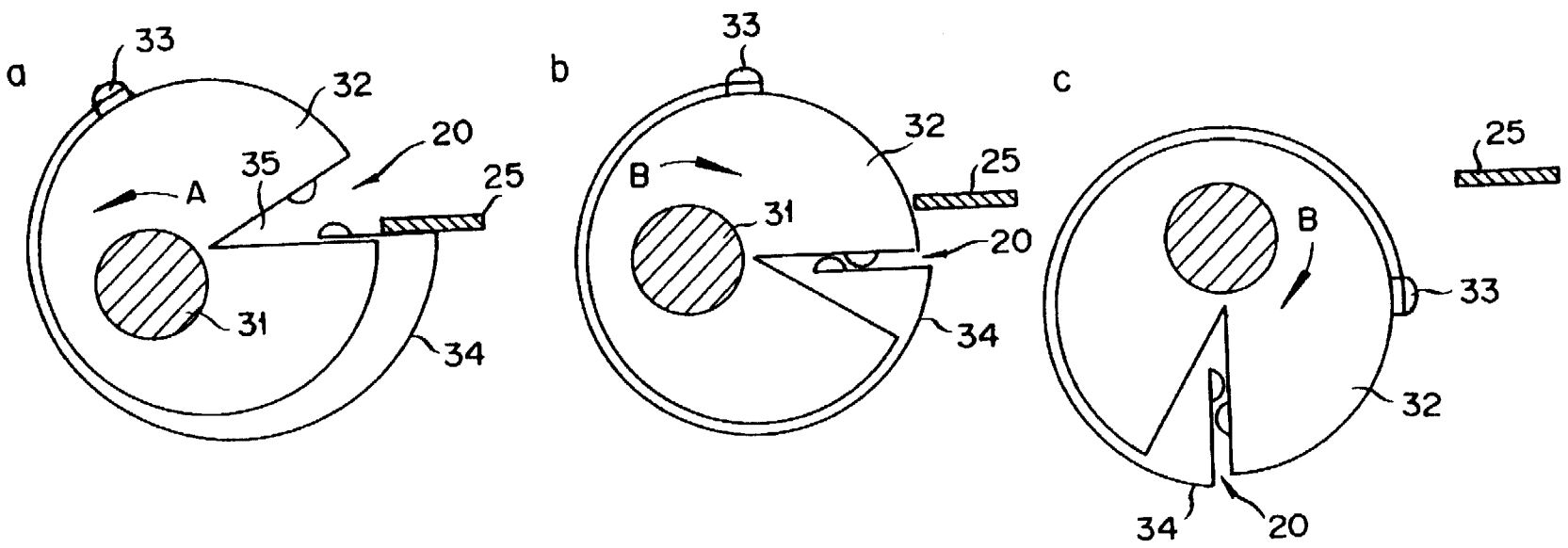
FIG. 3*a*, 3*b*, and 3*c* are diagrams showing another example of the winding roller to be used in the rolling apparatus of the embodiment mentioned above.

As respects the operation of the winding rollers 2 and 3, one part of the spring member 34 is caught on the hooking bar 25 disposed on the drum 1 and the leading end chuck 20 is consequently opened as shown in FIG. 3*a* owing to the rotation of the rotary shaft 31 in the direction of the arrow A shown in the diagram. In the resulting state of the winding roller 2 or 3, the recording paper or the ink sheet is fed. By the fact that the rotary shaft 31 of the winding roller is rotated in the direction of the arrow B shown in FIG. 3*b*, the gap between the inner wall of the notched part 35 and one end of the spring member 34 is closed until the recording paper or the ink sheet is nipped therein. Further in consequence of the rotation of the rotary shaft 31 in the direction of the arrow B as shown in FIG. 3*c*, the recording paper or the ink sheet is drawn and brought into close contact with the drum 1.

These winding rollers 2 and 3 are each rotated by a motor provided with a torque limiter the leading end of which has the shape of a key matching a key groove (not shown) provided in the rotary shaft 21 (or 31) so that the rotation is automatically stopped when a stated force is exerted on the motor. This motor is advanced forward and backward by a solenoid so as to be engaged with the rotary shaft 21 (or 31) only when it rotates the winding roller 2 or 3. When the rotation is not required, the motor is retracted so as to avoid hindering the rotation of the drum 1. The rotary shaft 21 (or 31) is provided with a ratchet mechanism so that it may be prevented from rotating in the direction of the arrow A in FIG. 2 and FIG. 3 when the motor is not engaged therewith. This ratchet mechanism is allowed to rotate when a claw member of the ratchet is dislocated by a ratchet motor.

Further, the winding rollers 2 and 3 are provided with a winding roller open position sensor for detecting the fact that the leading end chuck 20 (30) assumes a position proper to be opened and consequently enabled to nip the recording paper or the ink sheet and also with a winding roller chuck position sensor for detecting the fact that the leading end chuck 20 (or 30) assumes a closed state.

Figure 4B:
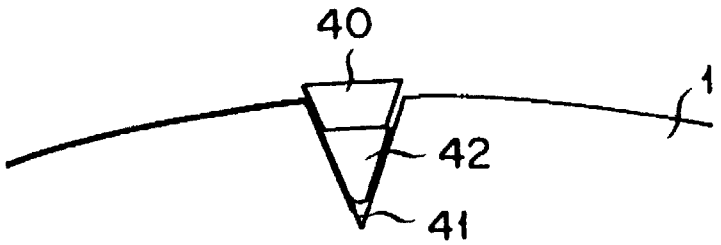
FIG. 4*a* and 4*b* are diagrams showing one example of a trailing end chuck to be used in the rolling apparatus of the embodiment mentioned above.
Figure 4A:
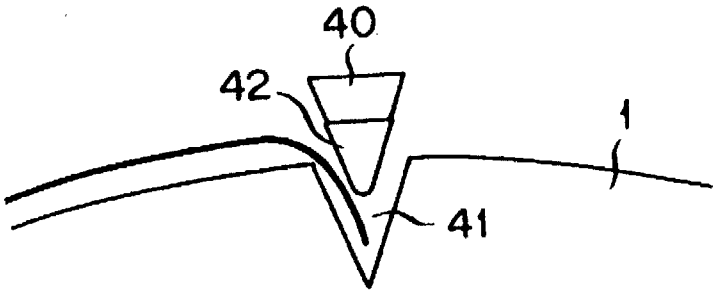
Figure 5B:
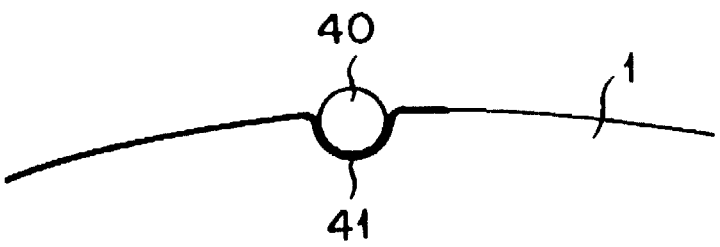
FIG. 5*a* and 5*b* are diagrams showing another example of the trailing end chuck to be used in the rolling apparatus of the embodiment mentioned above.
Figure 5A:
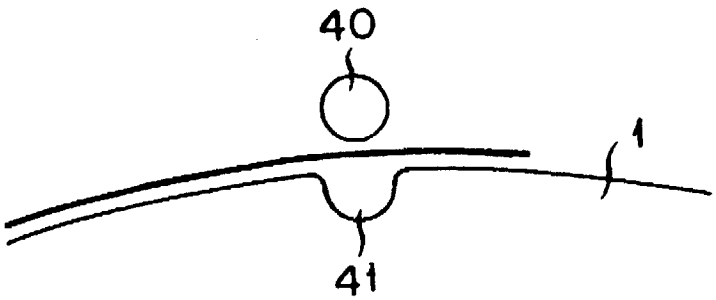

The trailing end chucks 4 and 5 are each possessed of either a cross section of the shape of a wedge having an elastic member 42 at the leading end thereof as shown in FIG. 4 or a cross section of the simple shape of a circle as shown in FIG. 5. In either of the shapes mentioned above, they rely on a shaft 40 of a metallic material longer than the width (the direction of secondary scanning) of the drum 1 and a depression 41 on the surface of the drum 1 to nip the recording paper or the ink sheet. The shaft 40 is normally kept urged as by a spring toward the center of the drum 1 and, when required to nip the recording paper or the ink sheet, flung up by a solenoid to form a gap with the depression 41 of the drum 1 as shown in FIG. 4*a* or FIG. 5*a*. This shaft 40, while keeping the recording paper or the ink sheet in the nipped state, is urged by the spring mentioned above against the depression 41 of the drum 1 as shown in FIG. 4*b* or FIG. 5*b*. As the means for lifting the shaft 40, a cam or a lever may be used in the place of the solenoid.

Around the drum 1, a pressing roller 6, a discharge device 12, a peel roller 7, a sensor for detecting the leading ends of the recording paper and the ink sheet, and a sensor for detecting the trailing ends thereof are further disposed.

The pressing roller 6 reciprocates relative to the drum 1 and, after the leading ends of the recording paper and the ink sheet have been nipped by the winding roller 2 or 3 and before the drum 1 is about to rotate and have the recording paper and the ink sheet rolled around it, presses itself against the drum 1 and plays the role of a guide roller. The pressing roller 6, when the trailing end chucks 4 and 5 are about to nip the trailing ends of the recording paper and the ink sheet, plays the role of causing the trailing ends of the recording paper and the ink sheet to be slipped between the shaft 40 of the trailing end chuck and the depression 41. Besides, the pressing roller 6, when the recording paper and the ink sheet are about to be discharged, plays the role of separating the recording paper and the ink sheet from the drum 1 and leading them to a discharge device 12.

The reciprocation of the pressing roller 6 is implemented by the solenoid in conjunction with the discharge device 12 as will be described specifically herein below. The pressing roller 6 is rotated accurately by a step motor and rendered rotatable by means of a clutch.

The discharge device 12 reciprocates in conjunction with the pressing roller 6 relative to the drum 1 and discharges the recording paper and the ink sheet which have been led thereto by the pressing roller 6. At this time, the peel roller 7 guides to the discharge device 12 the recording paper and the ink sheet separated from the drum 1 in advance by the pressing roller 6. The discharge device 12 is provided with a discharge sensor capable of detecting the fact that the recording paper and the ink sheet have been discharged. The peel roller 7 is reciprocated by a solenoid.

The feed device 11 and the discharge device 12 feeds and discharges the recording paper and the ink sheet respectively by means of a feed motor and a discharge motor.

The leading end sensor is disposed in the leading end part of the feed device 11 and detects the fact that the recording paper and the ink sheet have been fed and the leading end parts thereof have entered the winding rollers 2 and 3. The trailing end sensor detects the trailing ends of the recording paper and the ink sheet when the recording paper and the ink sheet have been rolled around the drum 1.

Figure 6:
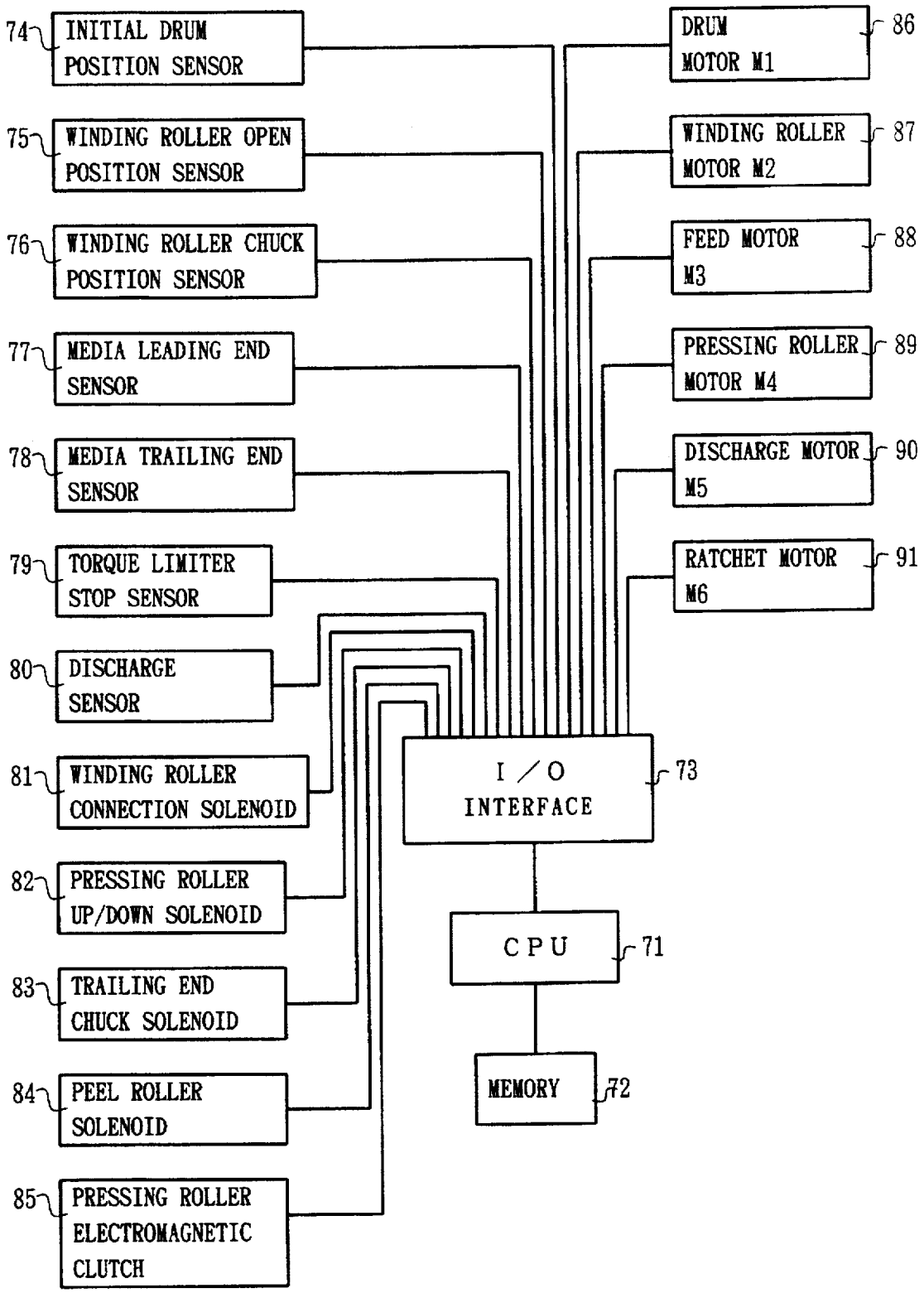
FIG. 6 is a block diagram showing a control system of the rolling apparatus of the embodiment mentioned above.

FIG. 6 is a block diagram of a control system to be used for controlling the rolling apparatus.

In this control system, a CPU 71 controls the driving of varying solenoids and varying motors in response to signals from relevant sensors and a memory 72 keeps in storage the program for controlling the rolling and discharging of the recording paper and the ink sheet.

The signals from an initial drum position sensor 74, a winding roller open position sensor 75, a winding roller chuck position sensor 76, a media leading end sensor 77, a media trailing end sensor 78, a torque limiter stop sensor 79, and a discharge sensor 80 and the signals to a winding roller connection solenoid 81, a pressing roller up/down solenoid 82, a trailing end chuck solenoid 83, a peel roller solenoid 84, a pressing roller electromagnetic clutch 85, a drum motor 86, a winding roller motor 87, a feed motor 88, a pressing roller motor 89, a discharge motor 90, and a ratchet motor 91 are delivered by relevant signal lines through the medium of an I/O interface 73.

Now, the operation of the rolling apparatus will be described below. In the following description, the term "media" is meant to refer to either a recording paper or an ink sheet. Since an equal rolling operation is carried out on both the recording paper and the ink sheet, this word "media" will be used herein below as a general term for both the articles where no discrimination is required.

Figure 7:
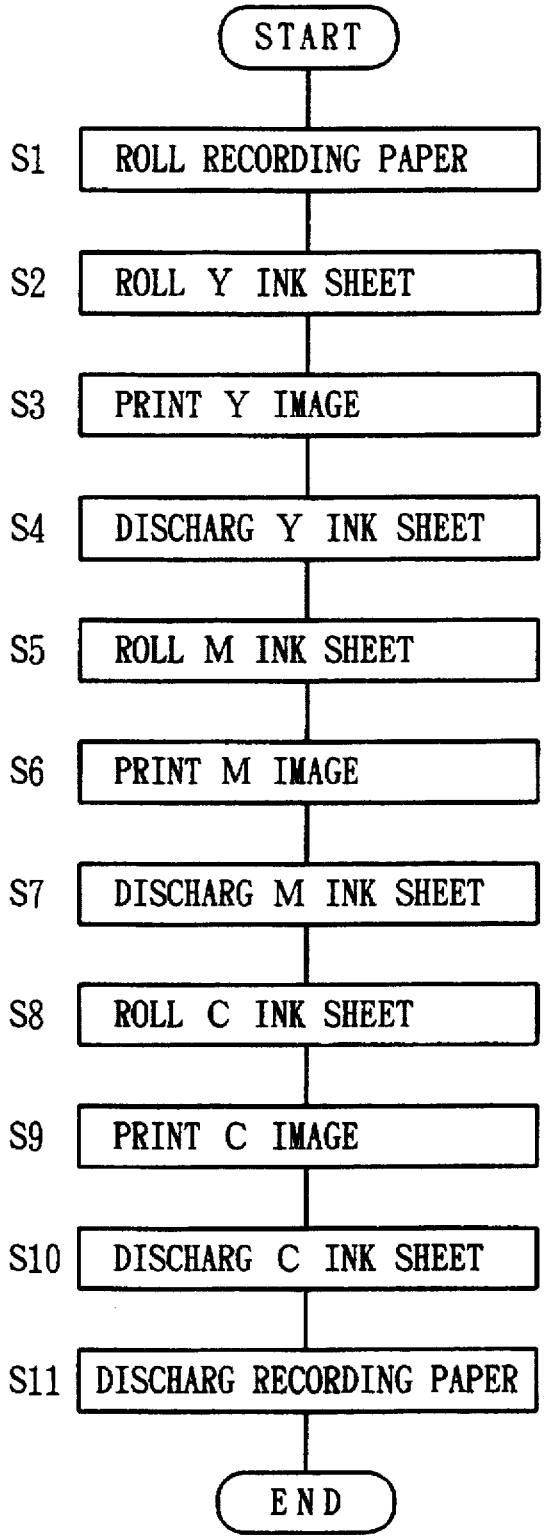
FIG. 7 is a flow chart showing a printing operation in the embodiment mentioned above.

FIG. 7 is a flow chart showing one example of the color print operation generally applicable herein. FIGS. 8–15 are flow charts showing the steps of the operation of rolling the media.

The operation of color print, as shown in FIG. 7, comprises first rolling a recording paper (S1), then rolling a yellow (Y) ink sheet (S2), printing a yellow image (S3), discharging the yellow ink sheet (S4), rolling a magenta (M) ink sheet (S5), printing a magenta image (S6), discharging the magenta ink sheet (S7), rolling a cyan (C) ink sheet (S8), printing a cyan image (S9), and discharging the cyan ink sheet (S10). The recording paper on which the images of the three complementary colors have been sequentially printed is then discharged (S11) to complete the operation.

The recording paper which is used for the color print of this principle is obtained by depositing an image receiving layer having affinity for dye (such as, for example, polycarbonate sheet or polyurethane sheet) on a substrate (such as, for example, polyester sheet or a condenser paper). The ink sheet also used herein is obtained by depositing a photothermal conversion layer of large absorption (such as, for example, carbon) and a coloring agent layer (having a subliming dye dispersed in a macromolecular binding agent) on a base film incapable of showing very large absorption at the wavelength of a laser beam to be used (such for example, polyethylene terephthalate film).

The image of a given color is printed by the fact that the laser beam forms a focal point in the photothermal conversion layer of the relevant ink sheet and consequently induces the photothermal conversion layer to generate heat, this heat is conducted to the coloring agent layer and consequently enabled to excite the subliming dye in the coloring agent layer and cause the dye existent in a solid state thence in the macromolecular binding agent to be gasified and expelled out of the coloring agent layer, and the expelled subliming dye, when passing a position very close to the image receiving layer, is trapped by the image receiving layer and consequently caused to dye the image receiving layer. There are times when the recording paper requires to be heated in advance because the ease with which the dye is trapped by the image receiving agent exalts in proportion as the temperature of the image receiving layer rises.

The image receiving layer after being dyed is preferably cooled once to the neighborhood of room temperature. This is because the cooling fortifies the bondage between the dye and the image receiving agent to a point where the dye will be kept from subliming again if it is exposed again to heat. Particularly when three or four colors are superposed as in a color print, the cooling proves important for the sake of ensuring color balance because the recording paper is destined to be heated again during the course of the subsequent deposition of dye.

Figure 8:
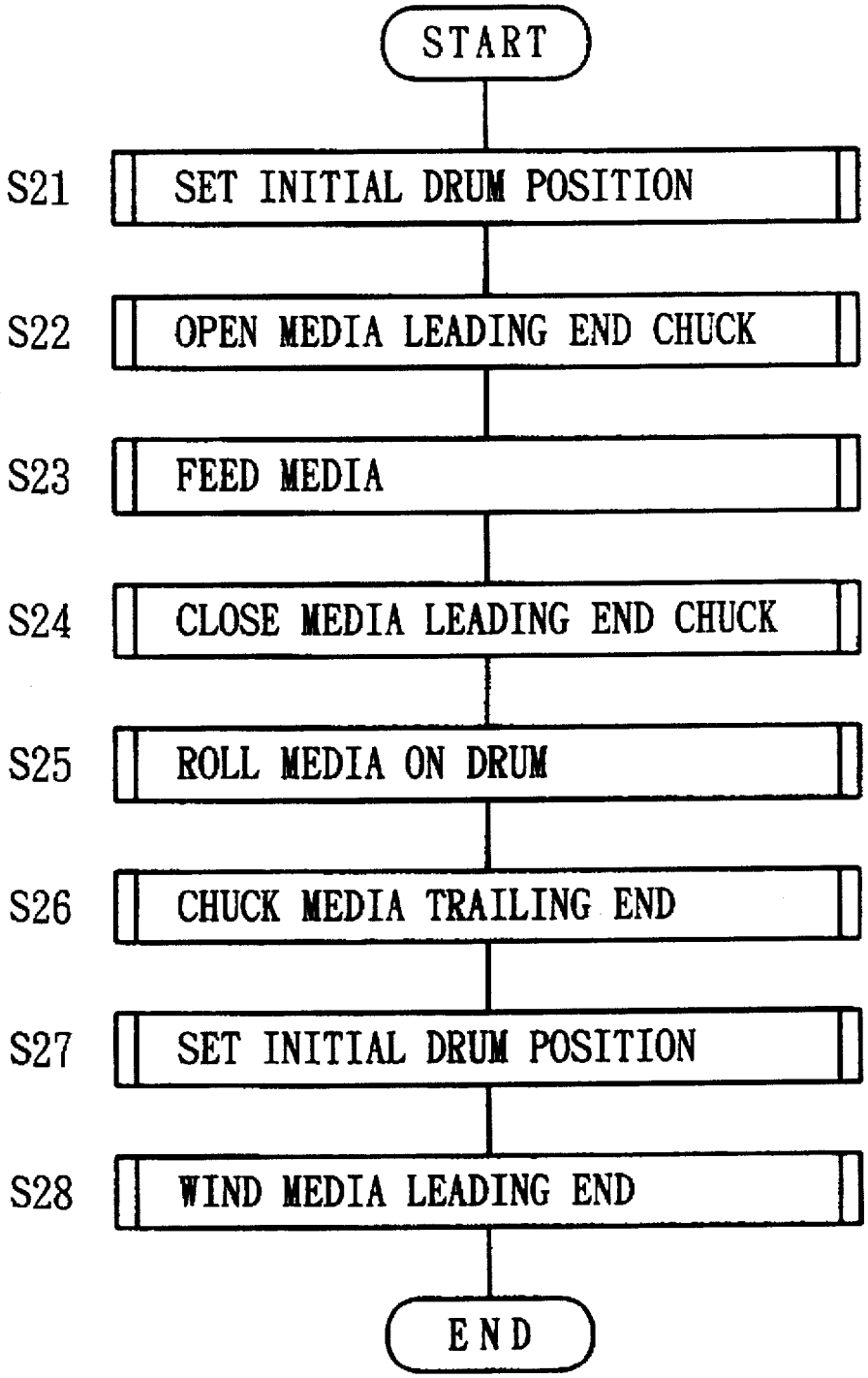
FIG. 8 is a flow chart showing an operation for rolling a media in the embodiment mentioned above.

In the print operation performed as described above, the operation of rolling the media (recording paper or ink sheet), as shown in FIG. 8, comprises setting the initial drum position (S21), opening the leading end chuck of the winding roller (S22), feeding the media from the media feed device (S23), closing the leading end chuck of the winding roller (S24), rolling the media by rotating the drum 1 (S25), setting the chuck on the trailing end of the media (S26), setting the drum at the initial position (S27), and winding the leading end of the media (S28). In consequence of the steps of the operation mentioned above, the media is rolled around the drum.

Figure 9:
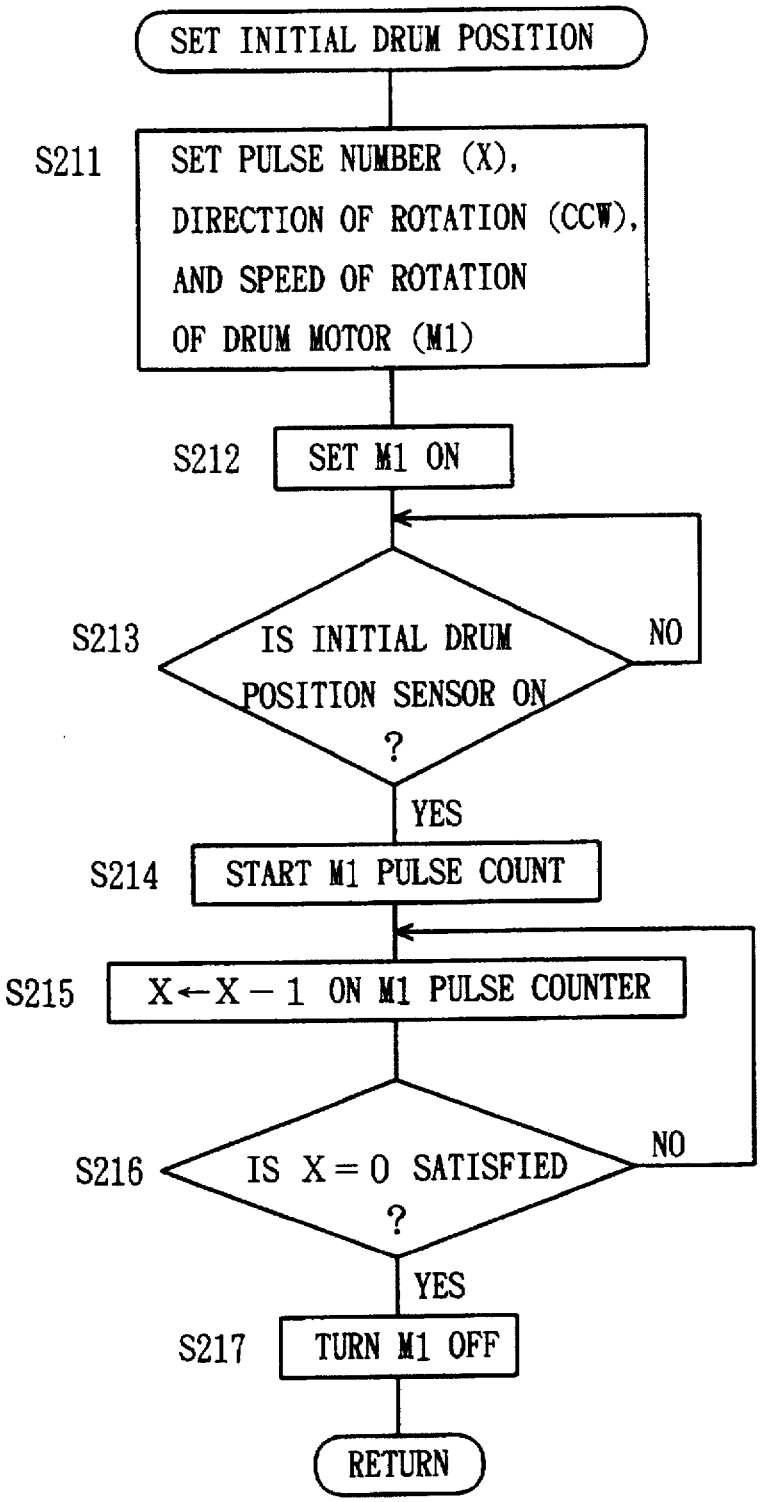
FIG. 9 is a flow chart showing an operation for setting the initial drum position in the media rolling operation in the embodiment mentioned above.

This operation will be described more specifically below. First, the setting of the initial drum position is effected, as shown in FIG. 9, by setting the number of pulses X, the direction of rotation CCW, and the speed of rotation for the drum motor M1 (S211). Then, the motor M1 is started (M1 ON) (S212). When the drum starts rotation, the counting of pulses of the motor M1 is started (S214) by the initial drum position sensor detecting the fact that the drum has reached the initial position (S213). The motor M1 is stopped (M1 OFF) (S217) when the fact that the number, X, of pulses is sequentially decreased (S215) and brought ultimately to 0 is detected (S216). As a result, the drum is brought to the stated (home) position.

Figure 10:
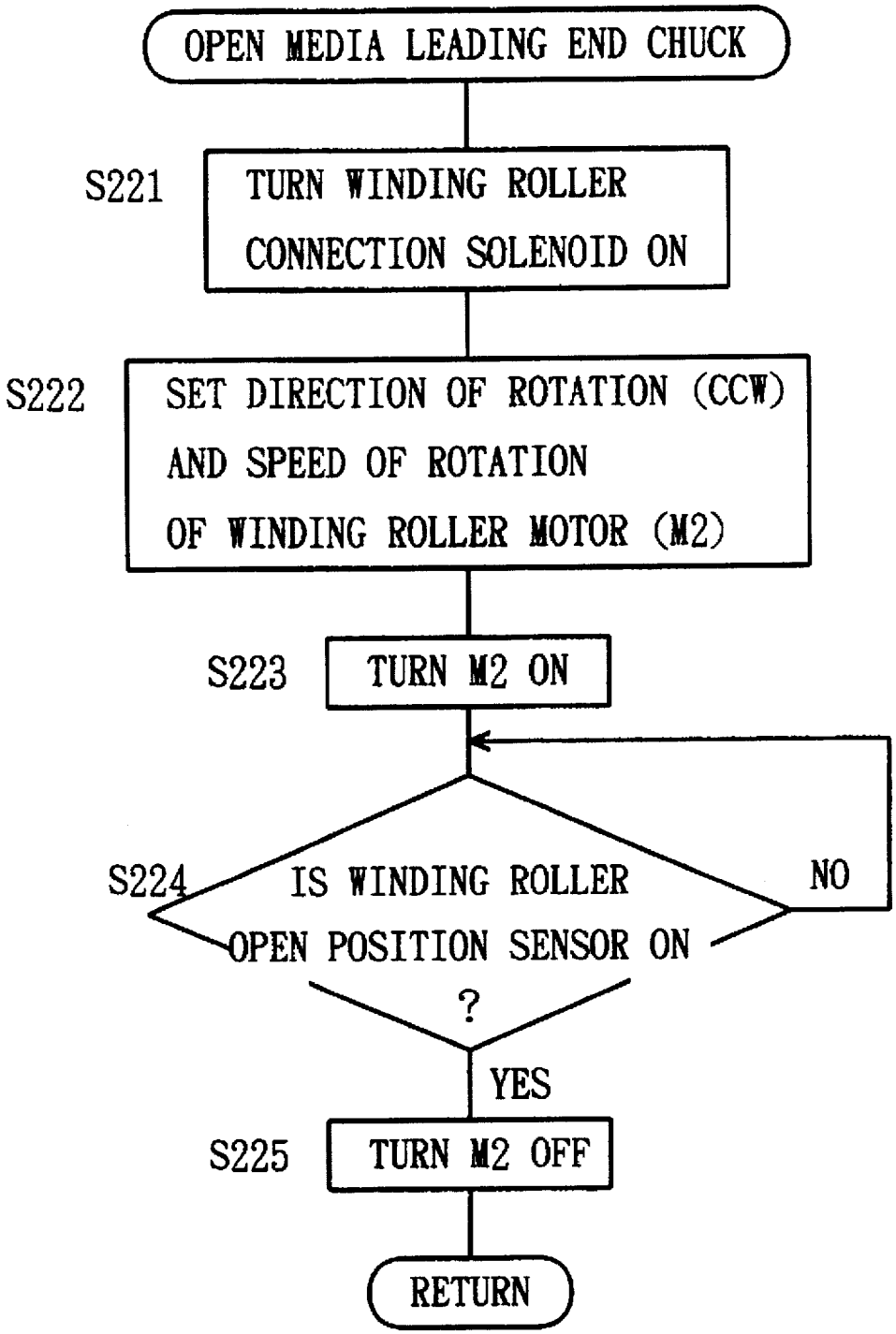
FIG. 10 is a flow chart showing an operation for opening a chuck at the leading end of a media in the media rolling operation in the embodiment mentioned above.

The operation for opening the chuck for nipping the leading end of the media, as shown in FIG. 10, comprises turning the winding roller connection solenoid ON and permitting transmission of the motive force of the motor M2 to the winding roller (S221), then setting the direction of rotation CCW and the speed of rotation for the winding roller motor M2 (S222), starting the motor M2 (M2 ON) (S223), stopping the motor M2 (M2 OFF) (S225) after the detection by the winding roller open position sensor of the fact that the winding roller has reached an open position (S224). As a result, the leading end chuck of the winding roller is opened to admit the media in the leading end chuck when the media fed is received.

Figure 11:
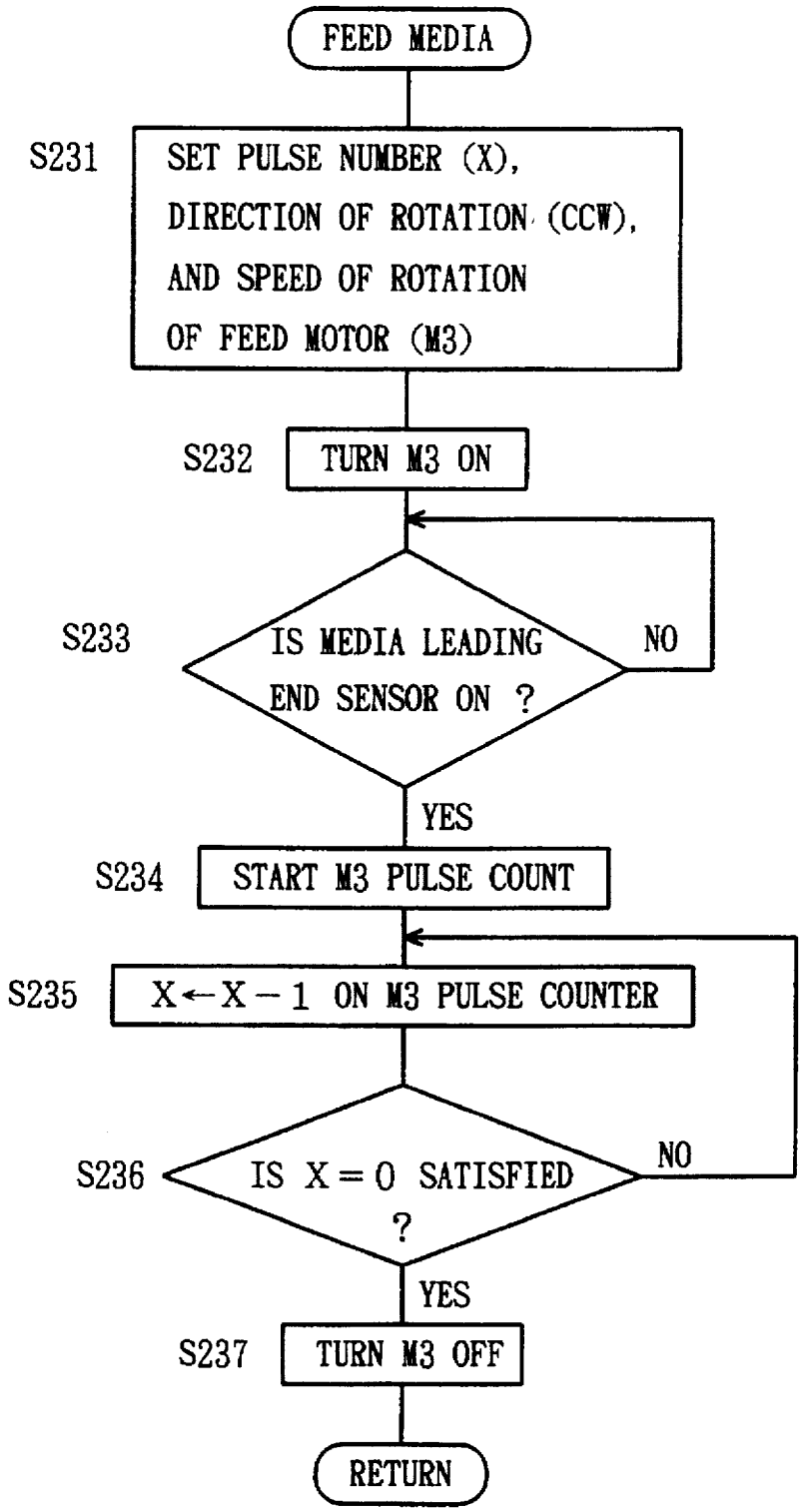
FIG. 11 is a flow chart showing an operation for media supply in the media rolling operation in the embodiment mentioned above.

Then, the operation for feeding the media, as shown in FIG. 11, comprises first setting the number of pulses X, the direction of rotation CCW, and the speed of rotation for the feed motor M3 of the feed device for feeding the media (S231), starting the motor M3 (M3 ON) (S232), starting the counting of pulses of the motor M3 (S234) when the media leading end sensor detects the leading end of the media (S233), and stopping the motor M3 (M3 OFF) (S237) at the time that the number of pulses X, decreased sequentially (S235) is ultimately brought to 0 (S236). As a result, the leading end of the media enters the leading end chuck.

Figure 12:
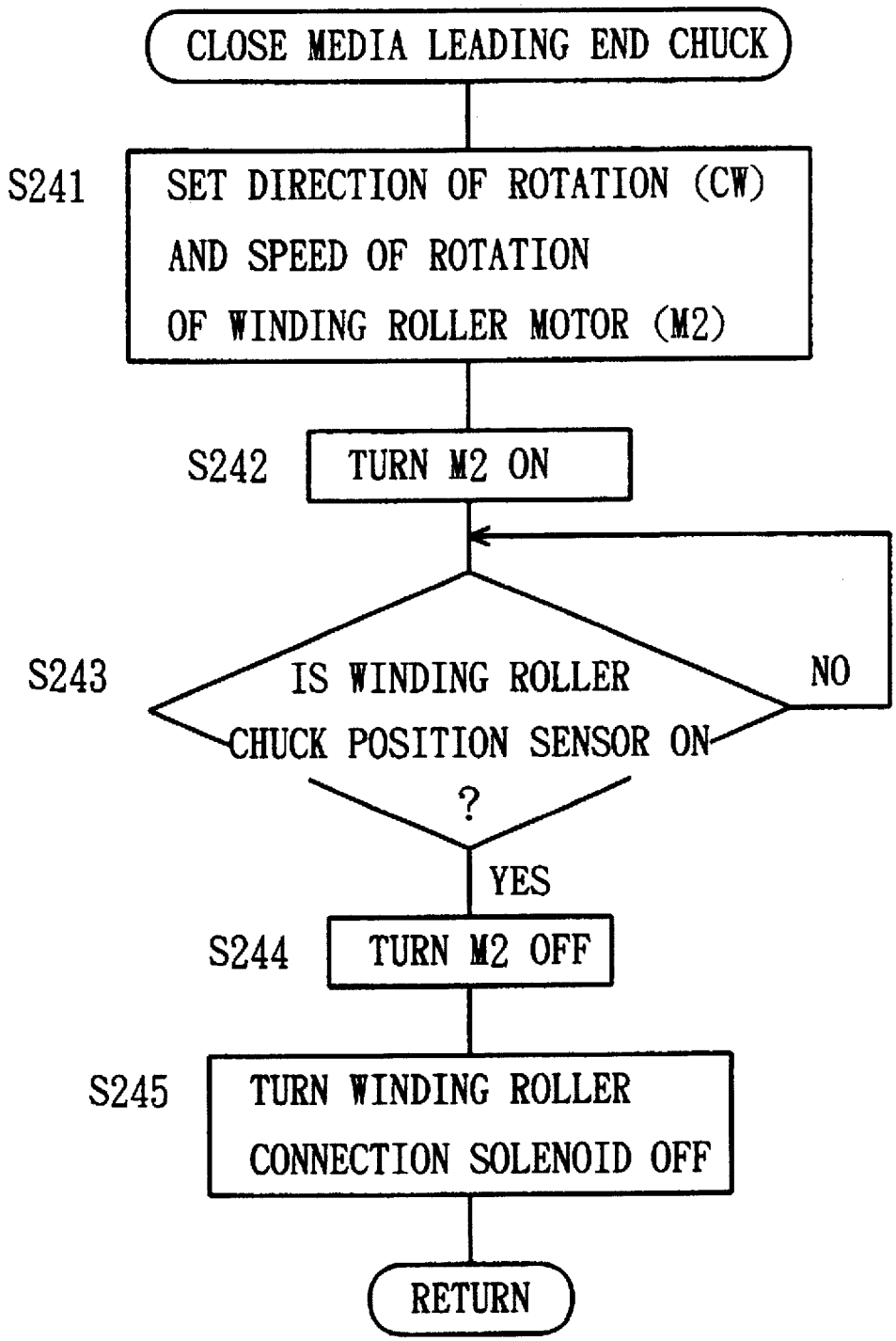
FIG. 12 is a flow chart showing an operation for closing the chuck at the leading end of the media in the media rolling operation in the embodiment mentioned above.

The operation for closing the chuck for nipping the leading end of the media, as shown in FIG. 12, comprises first setting the direction of rotation CW and the speed of rotation for the winding roller motor M2 (S241), the direction of rotation CW so set being opposite to the direction of rotation CCW which was set during the operation for opening the chuck for nipping the leading end of the media (S222, FIG. 10) mentioned above, then starting the motor M2 (M2 ON) (S242), stopping the motor M2 (M2 OFF) (S244) when the winding roller chuck position sensor detects the fact that the winding roller position has reached the chuck position (S243) thereby closing the leading end chuck to nip the leading end of the media, and turning OFF the winding roller connection solenoid which has kept the winding roller and the motor M2 in a connected state and thereby retracting the motor M2 so as to avoid hindering the rotation of the drum 1 (S245).

Figure 13:
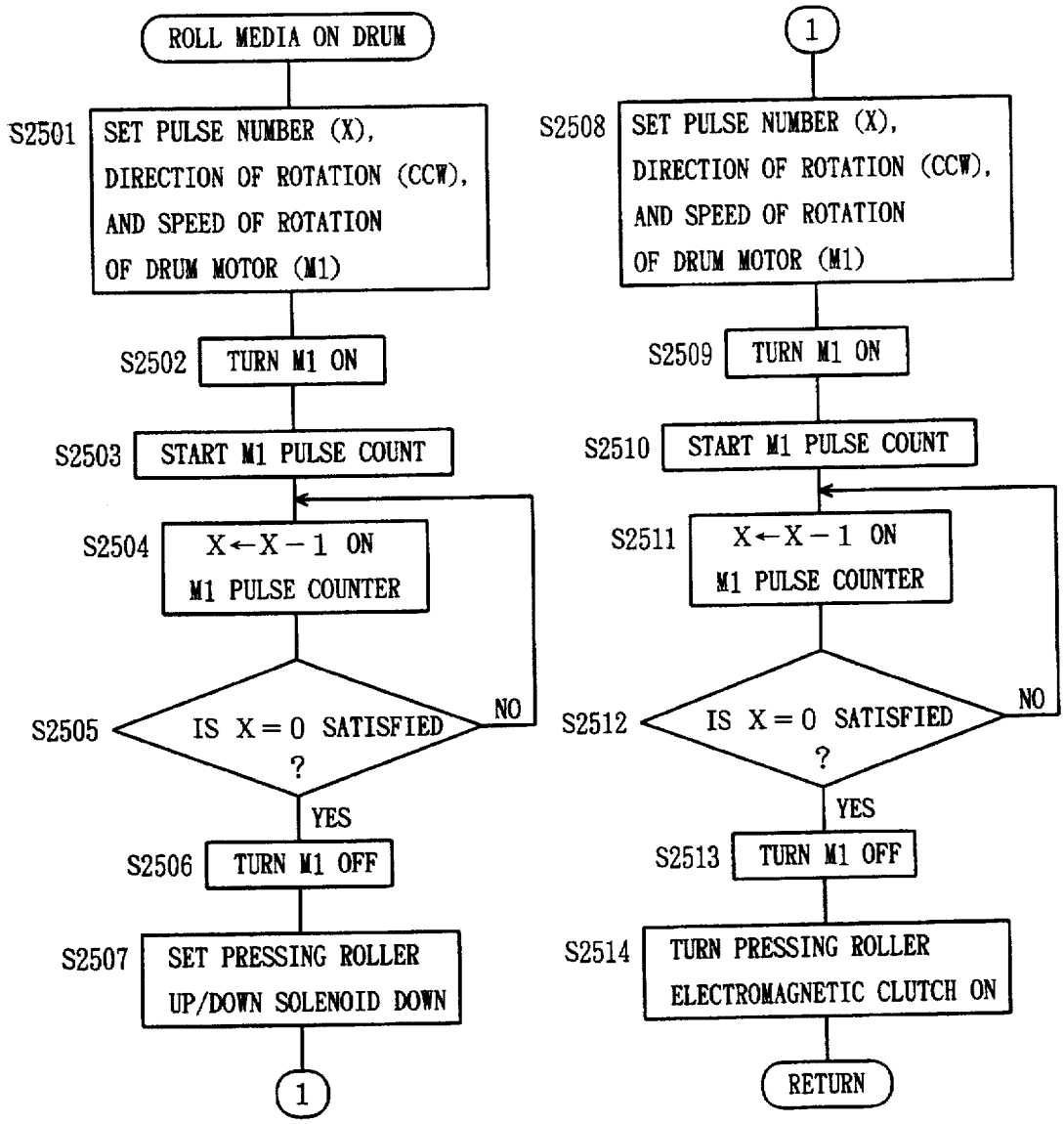
FIG. 13 is a flow chart showing an operation for rolling the media around the drum in the media rolling operation in the embodiment mentioned above.

The operation for rolling the media around the drum, as shown in FIG. 13, comprises first setting the number of pulses X, the direction of rotation CCW, and the speed of rotation for the drum motor M1 (S2501), starting the motor M1 (M1 ON) (S2502), starting the count of pulses of the motor M1 when the drum starts rotating (S2503), stopping the motor M1 (M1 OFF) (S2506) when the number, X, of pulses sequentially decreased (S2504) is ultimately brought to 0 (2505), setting the pressing roller up/down solenoid in a down mode (S2507) thereby allowing the pressing roller to contact the drum, again setting the number of pulses X, the direction of rotation CCW, and the speed of rotation for the drum motor M1 (S2508), starting the motor M1 (M1 ON) (S2509), stanting the count of pulses of the motor M1 when the drum starts rotating (S2510), stopping the motor M1 (M1 OFF) (S2513) at the time that the number of pulses, X, decreased sequentially (S2511) is ultimately brought to 0 (S2512), and turning the electromagnetic clutch of the pressing roller ON thereby allowing exertion of motive force on the pressing roller (S2514) when the rotation of the drum being accompanied by the rotation of the pressing roller is stopped.

Figure 14:
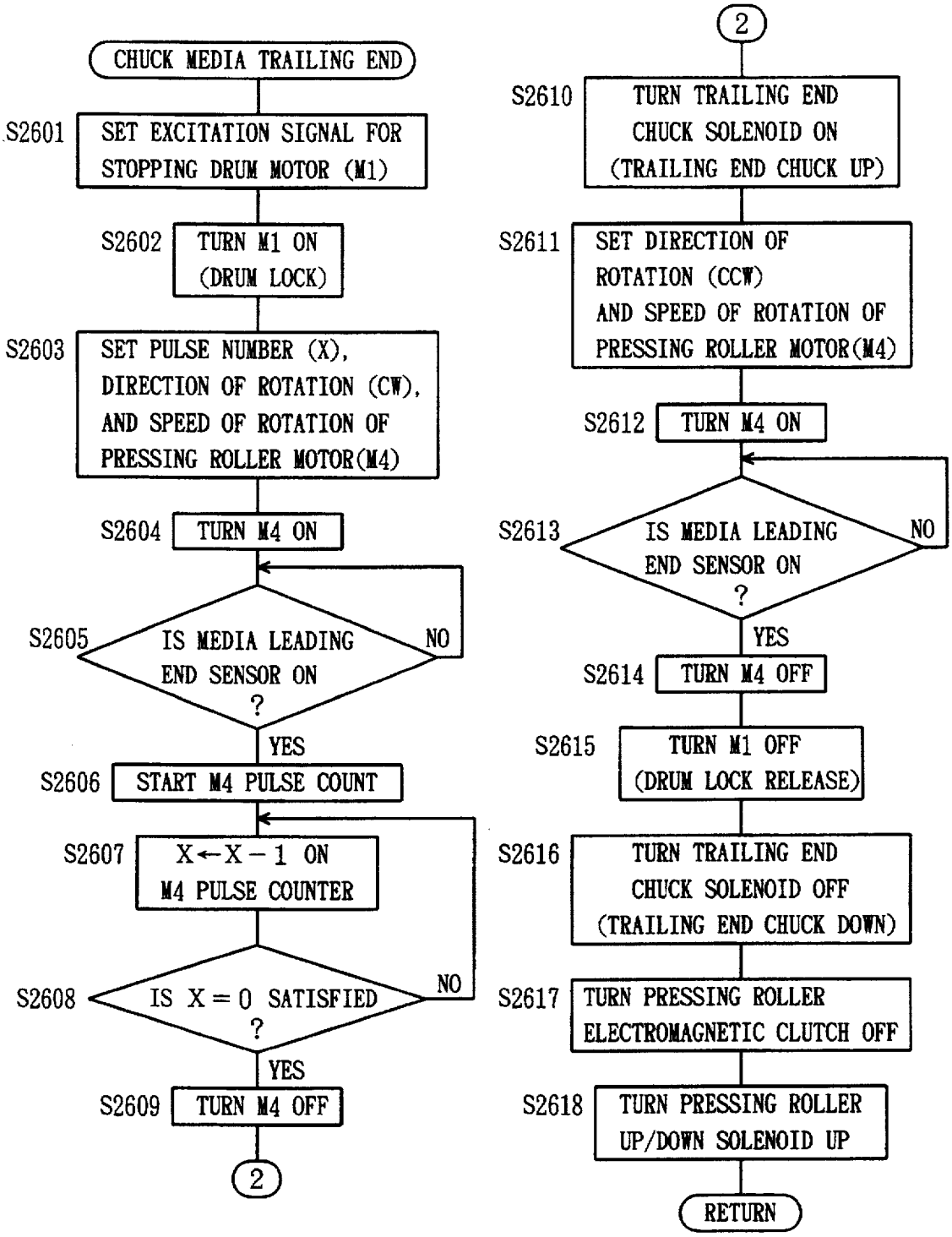
FIG. 14 is a flow chart showing an operation for chucking the trailing end of the media in the media rolling operation in the embodiment mentioned above.

The operation for chucking the trailing end of the media, as shown in FIG. 14, comprises first setting a stop excitation signal on the drum motor M1 (S2601) so as to keep the drum from moving, issuing the stop excitation signal to the drum motor M1 thereby setting the drum in a locked state (S2602), setting the number of pulses X, the direction of rotation CW, and the speed of rotation for the pressing roller motor M4 (S2603), starting the motor M4 (M4 ON) (S2604), starting the count of pulses of the motor M4 (S2606) when the media trailing end sensor detects the trailing end of the media (S2605), and stopping the motor M4 (M4 OFF) (S2609) at the time that the number of pulses, X, decreased sequentially (S2607) is ultimately brought to 0 (S2608). As a result, the pressing roller is rotated by a stated number of pulses, X, and consequently retracted until the trailing end of the media ceases to overlie the trailing end chuck.

The operation further comprises turning the trailing end chuck solenoid ON thereby raising the trailing end chuck (S2610), setting the direction of rotation CCW and the speed of rotation for the pressing roller motor M4 (S2611), starting the motor M4 (M4 ON) (S2612), stopping the motor M4 (M4 OFF) (S2614) when the media trailing end sensor detects the trailing end of the media (S2613), turning OFF the stop excitation signal of the motor M1 (S2615), and turning OFF the trailing end chuck solenoid thereby lowering the trailing end chuck (S2616) thereby causing the trailing end of the media to be nipped by the trailing end chuck.

Then, the pressing roller electromagnetic clutch is turned OFF (S2617) and the pressing roller up/down solenoid is set in a up mode to separate the pressing roller from the drum (S2618).

Figure 15:
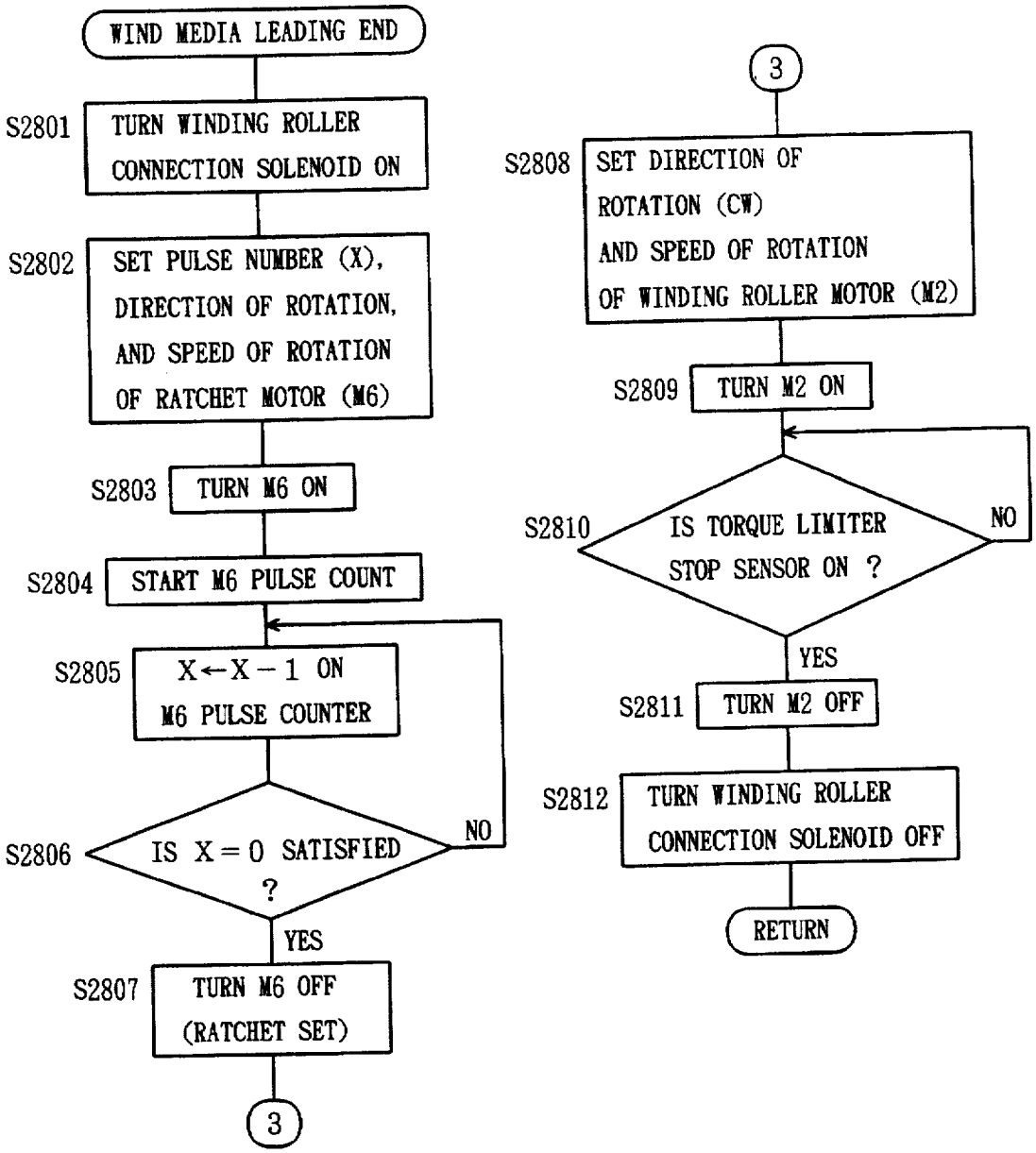
FIG. 15 is a flow chart showing an operation for winding up the leading end of the media in the media rolling operation in the embodiment mentioned above.

The operation for rolling the leading end of the media, as shown in FIG. 15, comprises first turning the winding roller connection solenoid ON thereby allowing the motive force of the motor M2 to be transmitted to the winding roller (S2801), setting the number of pulses X and the speed of rotation for the ratchet motor M6 (S2802), starting the motor M6 (M6 ON) (S2803), then starting the count of pulses of the motor M6 (S2804), and stopping the motor M6 (M6 OFF) (S2807) at the time that the number of pulses, X, decreased sequentially (S2805) is ultimately brought to 0 (S2806). As a result, the claw of the ratchet provided on the winding roller is set in place and the winding roller is allowed to rotate only in one direction and consequently prevented from producing a reverse rotation even when the winding roller connection solenoid is dislocated.

It further comprises setting the direction of rotation CW and the speed of rotation for the winding roller motor M2 (S2808), starting the motor M2 (M2 ON) (S2809), and stopping the motor M2 (M2 OFF) (S2811) when the torque limiter stop sensor detects the fact that the motor M2 is stopped owing to the exertion of a torque exceeding a stated level on the motor M2 (S2810). As a result, the leading end of the media is drawn until the media is brought into close contact with the drum.

Subsequently, the winding roller connection solenoid which has kept the winding roller and the motor M2 in a connected state is turned OFF and the motor M2 is retracted so as to avoid hindering the rotation of the drum (S2812).

The rolling of the media around the drum and the consequent close contact therebetween are carried out as described above. The operation is further described with reference to FIGS. 16–31 to show how the recording paper and the ink sheet are rolled severally around the drum 1.

First, the rolling of the recording paper will be described.

Figure 16:
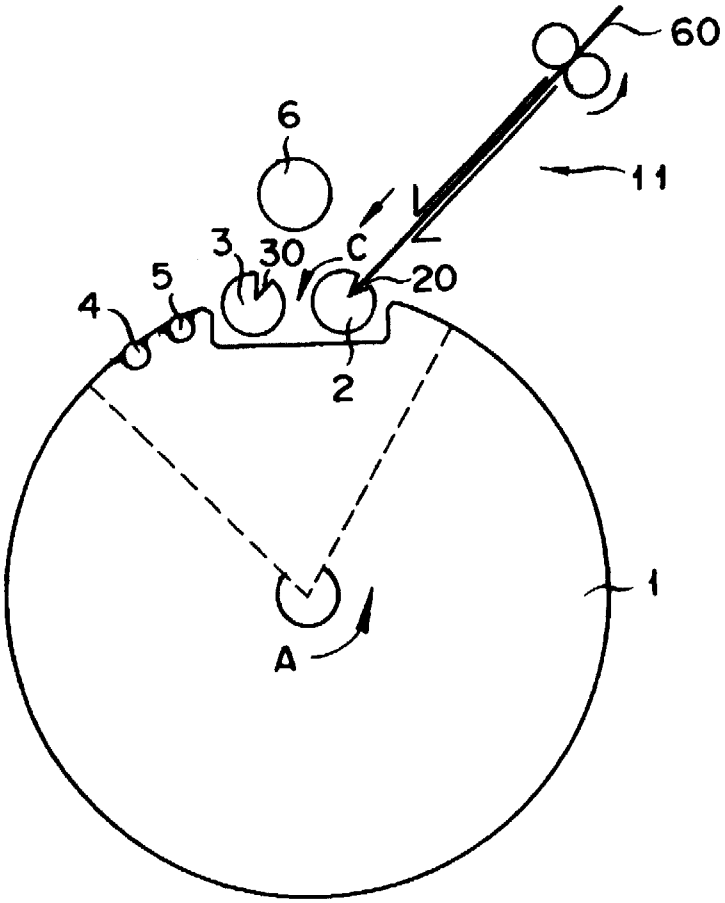
FIG. 16 is a diagram showing a step of the media rolling operation on a recording paper sequentially in the order of occurrence in the embodiment mentioned above.

After the drum 1 has been rotated in the direction (CCW) indicated by the arrow A in FIG. 16 and set at the initial position as shown in the diagram, the winding roller 2 is rotated in the direction (CCW) indicated by the arrow C in the diagram until the leading end chuck 20 is opened and the recording paper 60 from the feed device 11 is fed into the opened leading end chuck 20.

Figure 17:
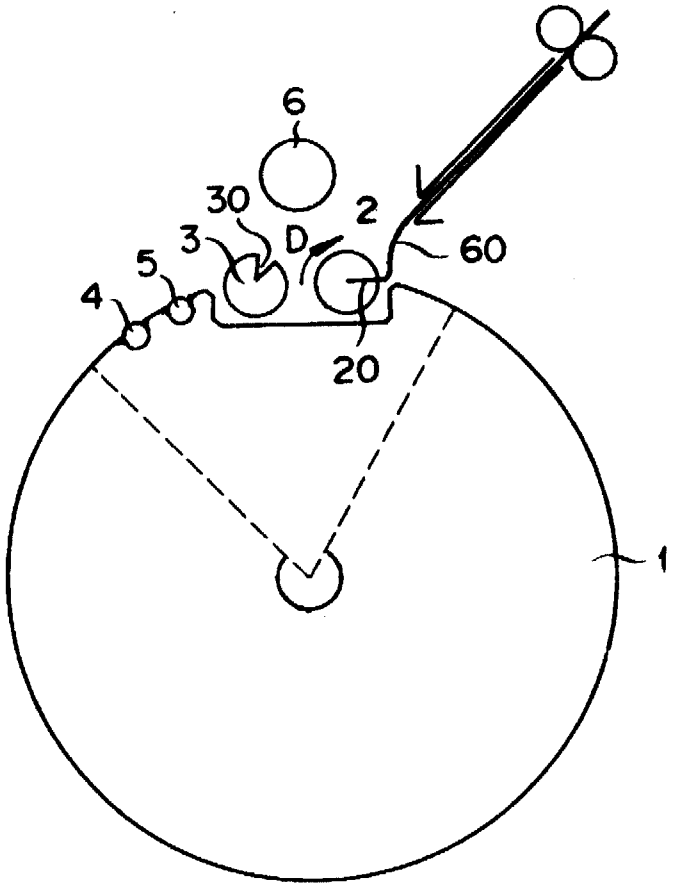
FIG. 17 is a diagram showing a step of the media rolling operation on the recording paper sequentially in the order of occurrence subsequent to that of FIG. 16.

Then, the winding roller 2 is rotated in the direction (CW) indicated by an arrow D in FIG. 17 until the leading end chuck 20 is closed and the leading end of the recording paper 60 is nipped.

Figure 18:
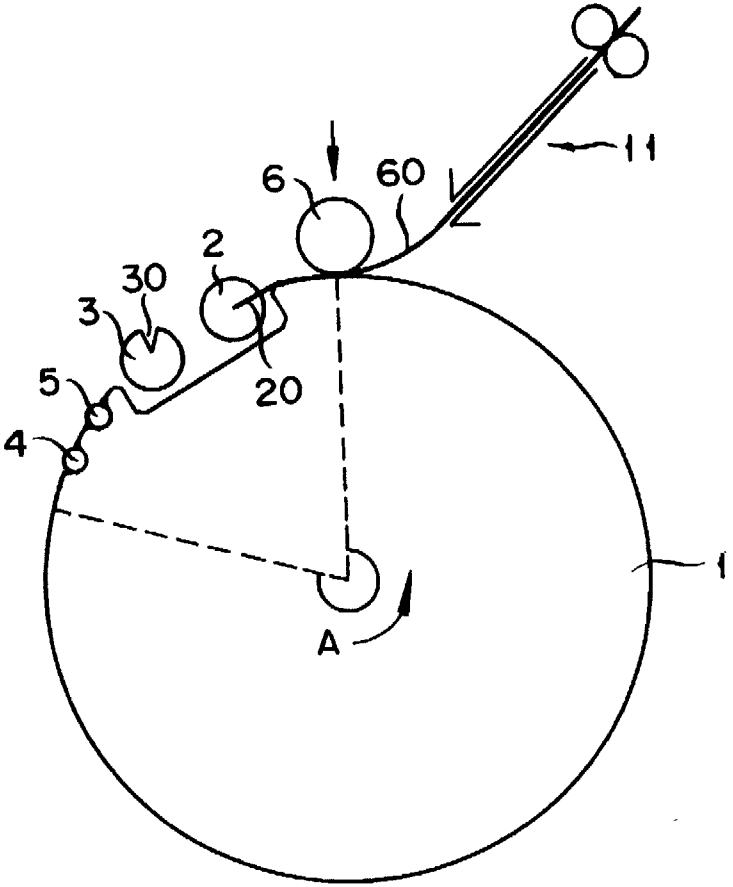
FIG. 18 is a diagram showing a step of the media rolling operation on the recording paper sequentially in the order of occurrence subsequent to that of FIG. 17.

Then, the drum 1 is rotated in the direction (CCW) indicated by the arrow A as shown in FIG. 18 and brought to a temporary stop and the pressing roller 6 is consequently lowered and brought into contact with the drum 1.

Figure 19:
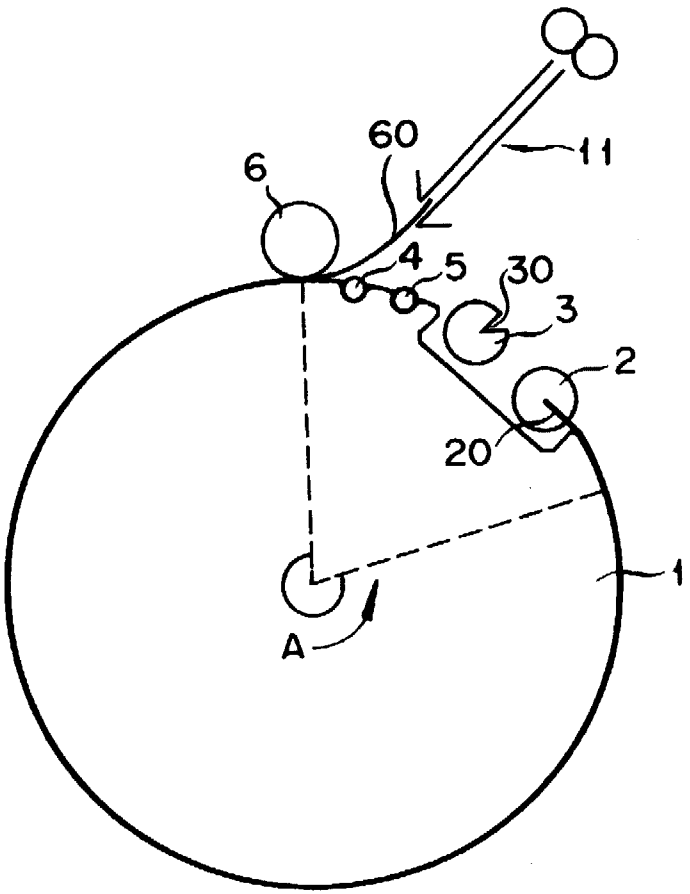
FIG. 19 is a diagram showing a step of the media rolling operation on the recording paper sequentially in the order of occurrence subsequent to that of FIG. 18.

Then, the drum 1 is rotated in the direction (CCW) indicated by the arrow A as shown in FIG. 19 and the pressing roller 6 is consequently induced to guide the recording paper 60 and meanwhile roll it over the drum 1.

Figure 20:
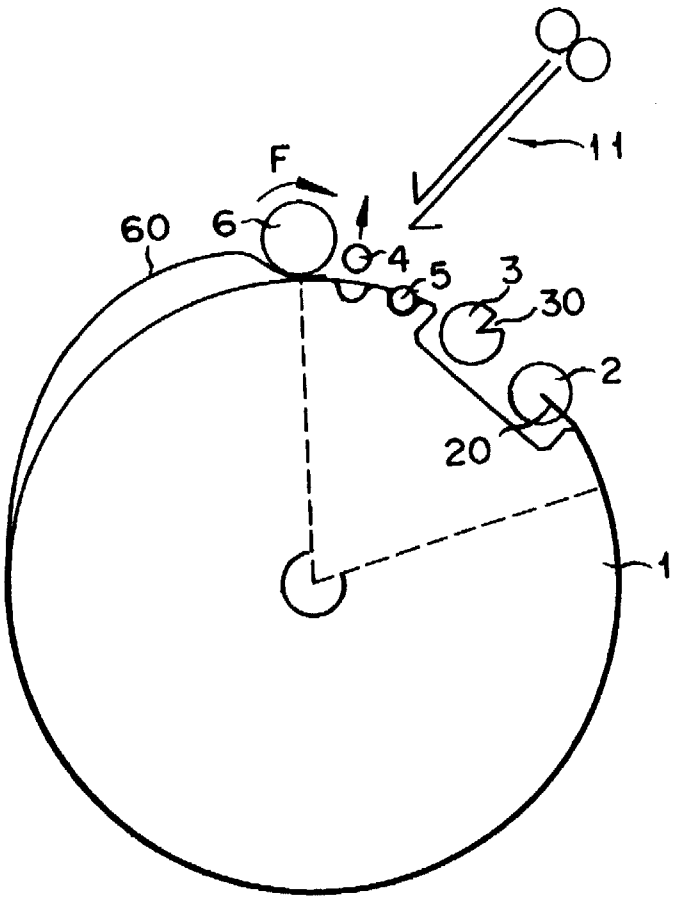
FIG. 20 is a diagram showing a step of the media rolling operation on the recording paper sequentially in the order of occurrence subsequent to that of FIG. 19.

When the trailing end of the recording paper 60 is detected, the pressing roller 6 is rotated in the direction (CW) indicated by an arrow F shown in FIG. 20 and the pressing roller 6 is consequently induced to retract the recording paper 60 slightly as shown in the diagram. Then, the trailing end chuck 4 nipping the trailing end of the recording paper 60 is raised.

Figure 21:
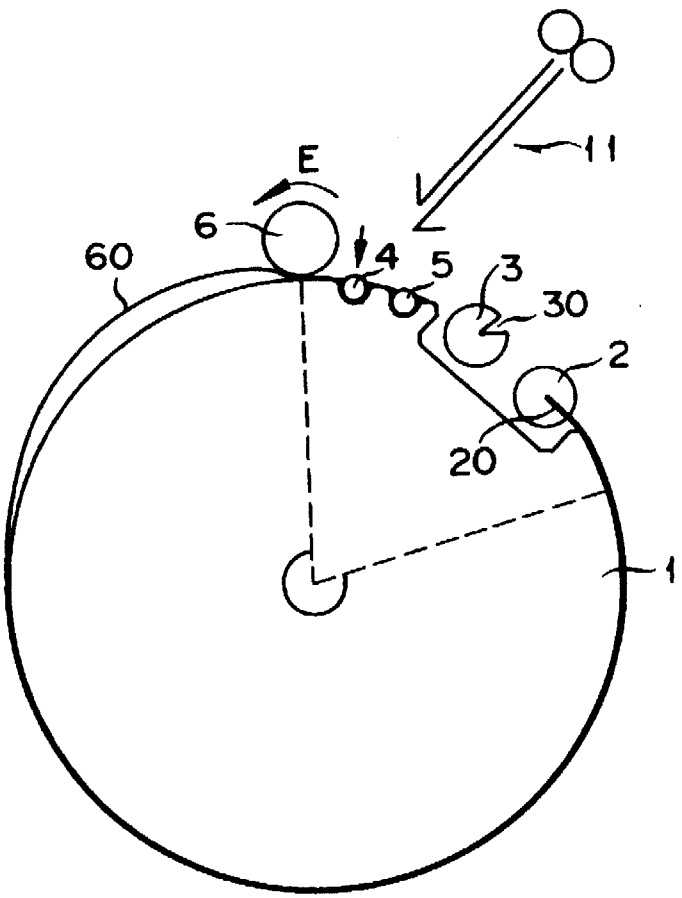
FIG. 21 is a diagram showing a step of the media rolling operation on the recording paper sequentially in the order of occurrence subsequent to that of FIG. 20.

Then, the pressing roller 6 is rotated in the direction (CCW) indicated by an arrow E in FIG. 21 and consequently induced to lead the trailing end of the recording paper 60 into the gap of the trailing end chuck 4 and the trailing end chuck 4 is lowered to nip the trailing end of the recording paper 60 as shown in the diagram.

Figure 22:
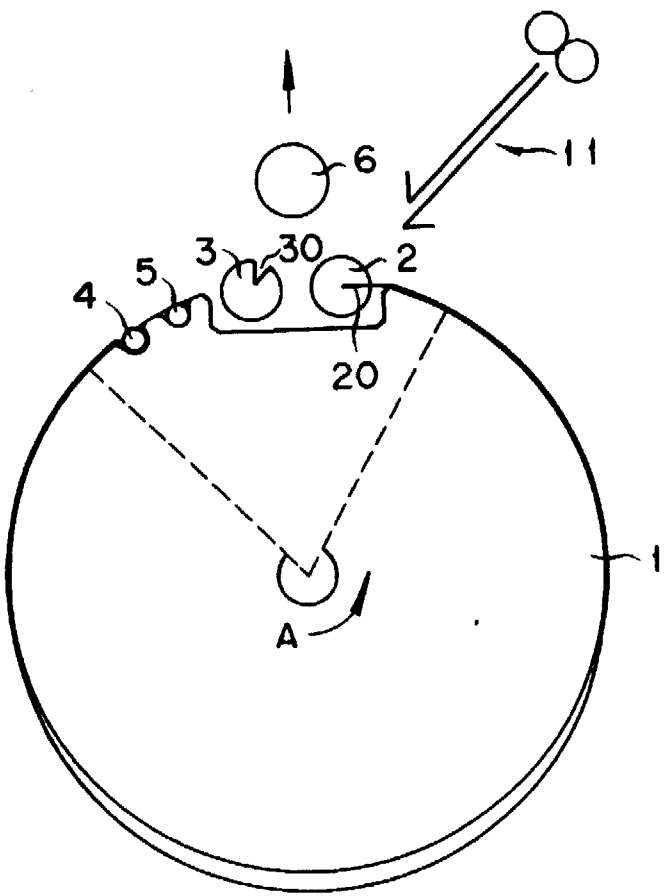
FIG. 22 is a diagram showing a step of the media rolling operation on the recording paper sequentially in the order of occurrence subsequent to that of FIG. 21.

Then, the pressing roller 6 is raised and separated from the drum 1 and the drum 1 is rotated in the direction (CCW) indicated by the arrow A in FIG. 22 and brought to the stated position as shown in the diagram.

Figure 23:
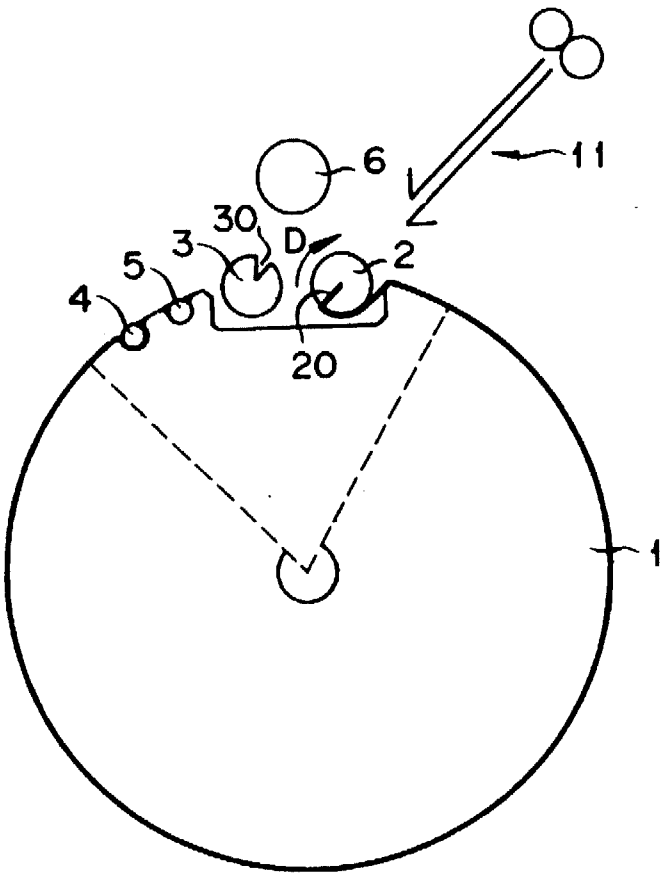
FIG. 23 is a diagram showing a step of the media rolling operation on the recording paper sequentially in the order of occurrence subsequent to that of FIG. 22.

Then, the winding roller 2 is rotated in the direction (CW) indicated by the arrow D in FIG. 23 and consequently induced to roll the recording paper 60 and bring it into close contact with the drum 1 as shown in the diagram.

In consequence of the steps of operation mentioned above, close contact is established between the recording paper 60 and the drum 1.

Then, the rolling of an ink sheet 61 and the consequent close contact thereof are carried out.

Figure 24:
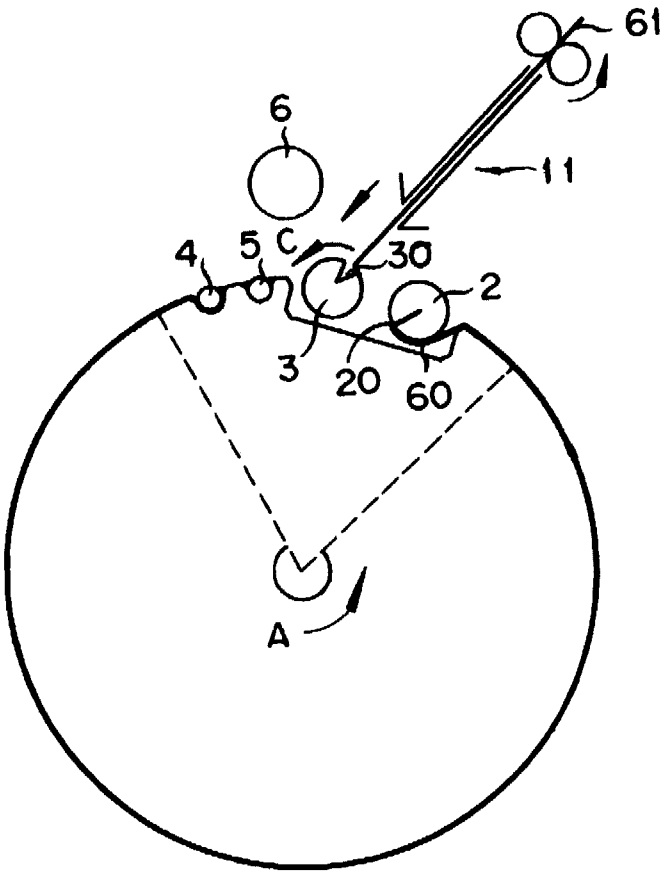
FIG. 24 is a diagram showing a step of the media rolling operation on an ink sheet sequentially in the order of occurrence subsequent to that of FIG. 23.

After the drum 1 has been rotated in the direction (CCW) indicated by the arrow A in FIG. 24 end set at the initial position as shown in the diagram, the winding roller 3 is rotated in the direction (CCW) indicated by the arrow C in the diagram until the leading end chuck 30 is opened and the ink sheet 61 fed from the feed device 11 is fed into the opened leading end chuck 30 similarly to the ink sheet 61 mentioned above.

Figure 25:
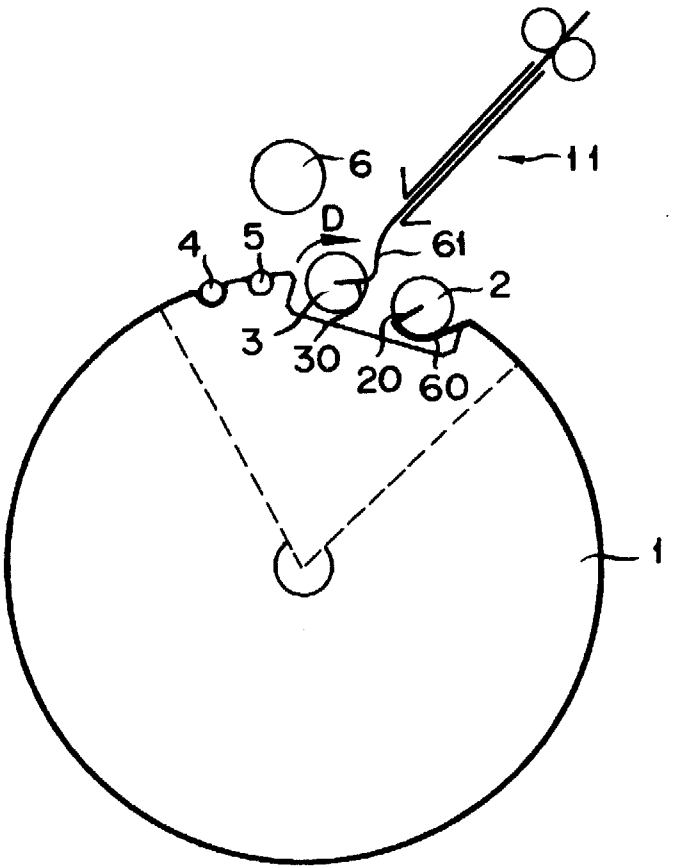
FIG. 25 is a diagram showing a step of the media rolling operation on the ink sheet sequentially in the order of occurrence subsequent to that of FIG. 24.

Then, the winding roller 3 is rotated in the direction (CW) indicated by the arrow D shown in FIG. 25 until the leading end chuck 30 is closed to nip the leading end of the ink sheet 61 as shown in the diagram.

Figure 26:
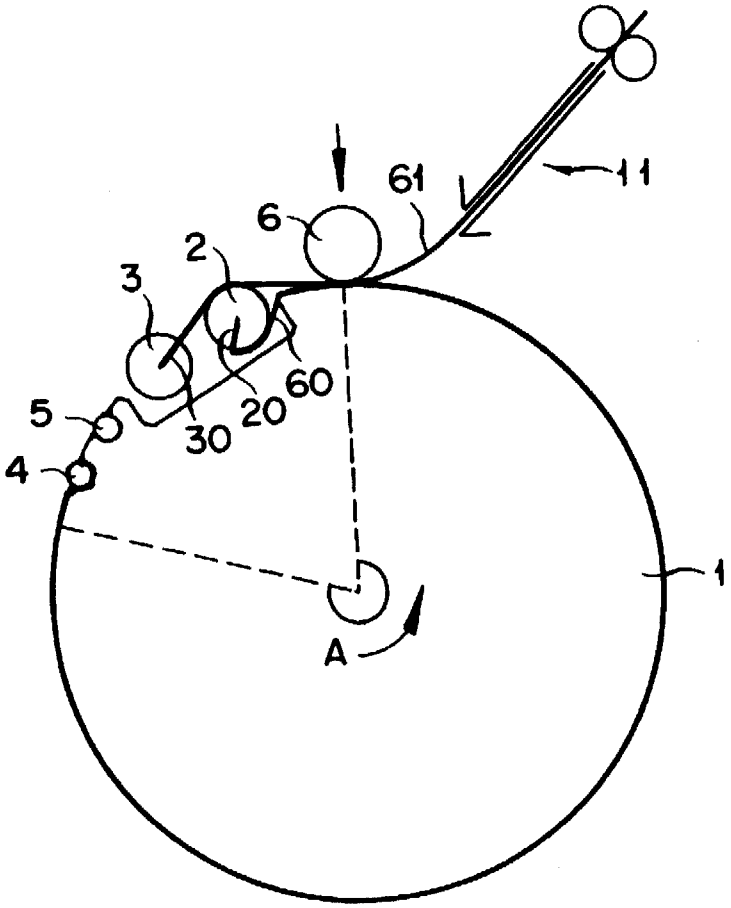
FIG. 26 is a diagram showing a step of the media rolling operation on the ink sheet sequentially in the order of occurrence subsequent to that of FIG. 25.

Then, the drum 1 is rotated in the direction (CCW) indicated by the arrow A shown in FIG. 26 and brought to a temporary stop and the pressing roller 6 is consequently lowered into contact with the drum 1 as shown in the diagram.

Figure 27:
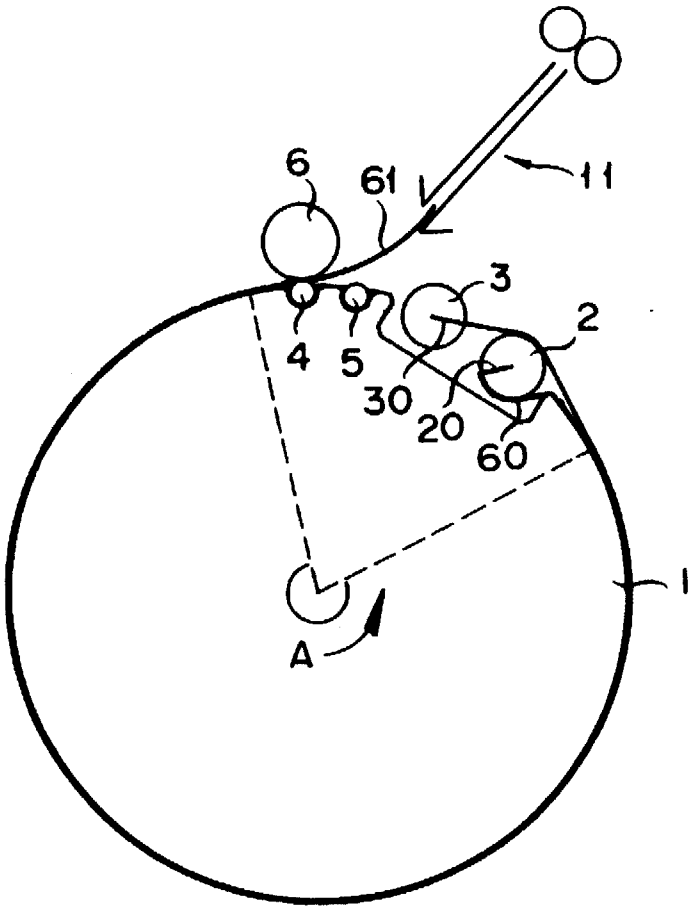
FIG. 27 is a diagram showing a step of the media rolling operation on the ink sheet sequentially in the order of occurrence subsequent to that of FIG. 26.

Then, the drum 1 is rotated in the direction (CCW) indicated by the arrow A shown in FIG. 27 and the pressing roller 6 is consequently induced to guide the ink sheet 61 and roll it on the recording paper 60 around the drum 1 as shown in the diagram.

Figure 28:
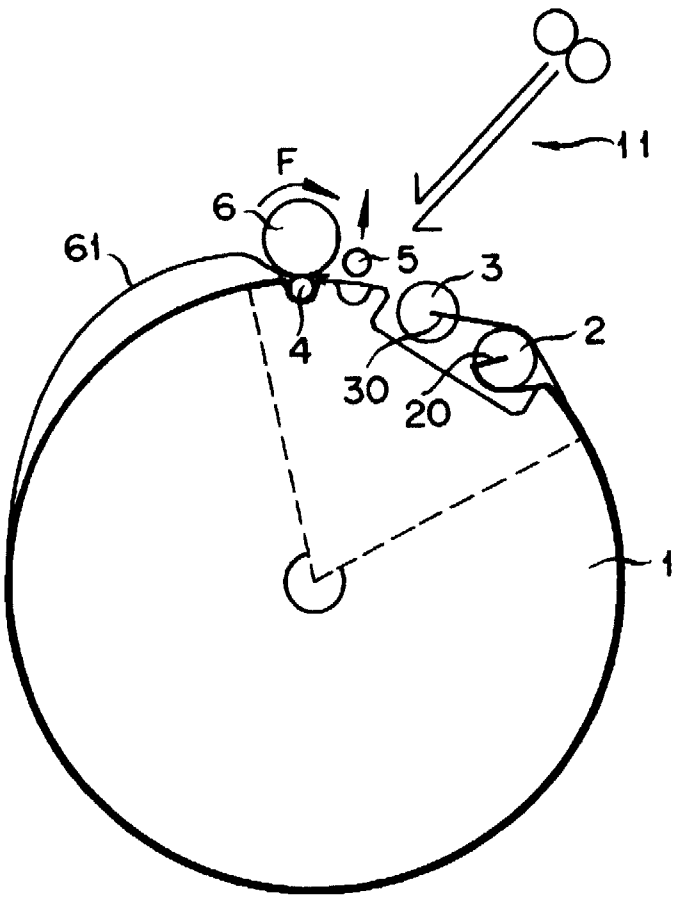
FIG. 28 is a diagram showing a step of the media rolling operation on the ink sheet sequentially in the order of occurrence subsequent to that of FIG. 27.

When the trailing end of the ink sheet 61 is detected, the pressing roller 6 is rotated in the direction (CW) indicated by the arrow F indicated in FIG. 28 and consequently induced to retract the ink sheet 61 slightly as shown in the diagram. Then, the trailing end chuck 5 nipping the trailing end of the ink sheet 61 is raised.

Figure 29:
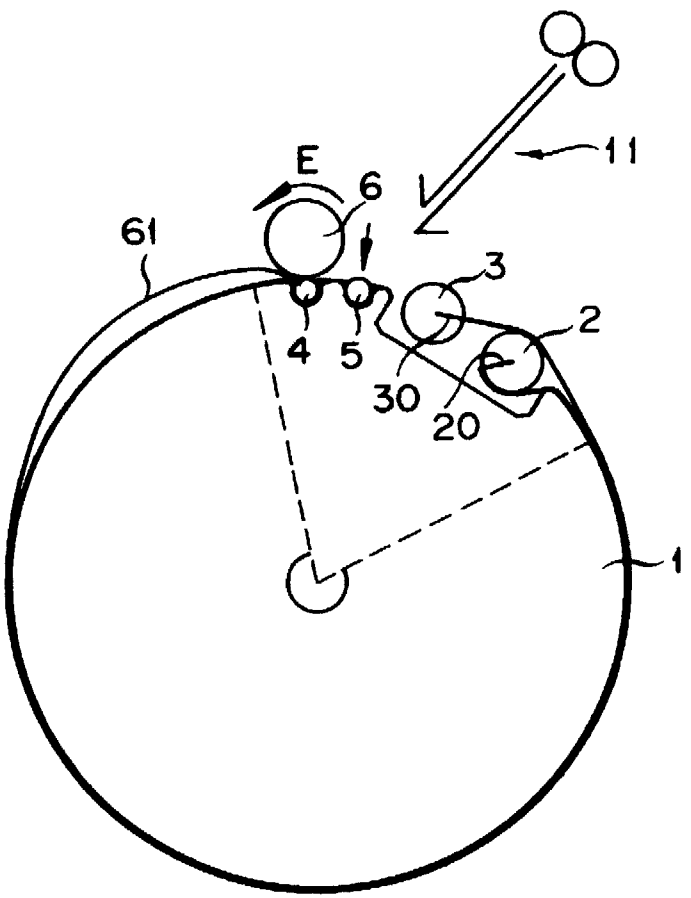
FIG. 29 is a diagram showing a step of the media rolling operation on the ink sheet sequentially in the order of occurrence subsequent to that of FIG. 28.

Then, the pressing roller 6 is rotated in the direction (CCW) indicated by the arrow E shown in FIG. 29 and consequently induced to lead the trailing end of the ink sheet 61 into the gap of the trailing end chuck 5 and the trailing end chuck 5 is lowered to nip the trailing end of the ink sheet 61.

Figure 30:
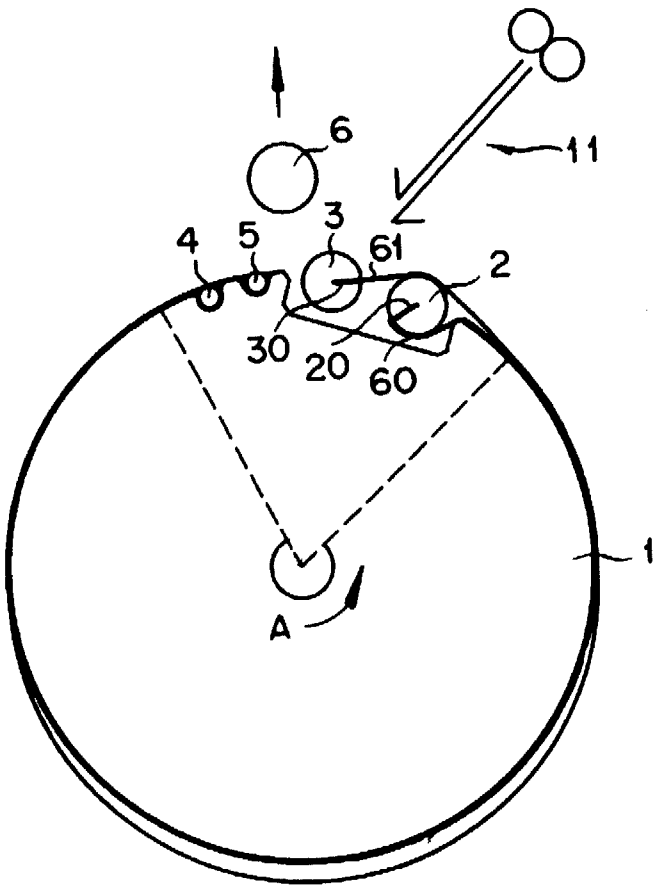
FIG. 30 is a diagram showing a step of the media rolling operation on the ink sheet sequentially in the order of occurrence subsequent to that of FIG. 29.

Then, the pressing roller 6 is raised and separated from the drum 1 and the drum 1 is rotated in the direction (CCW) indicated by the arrow A in FIG. 30 and brought to the stated position as shown in the diagram.

Figure 31:
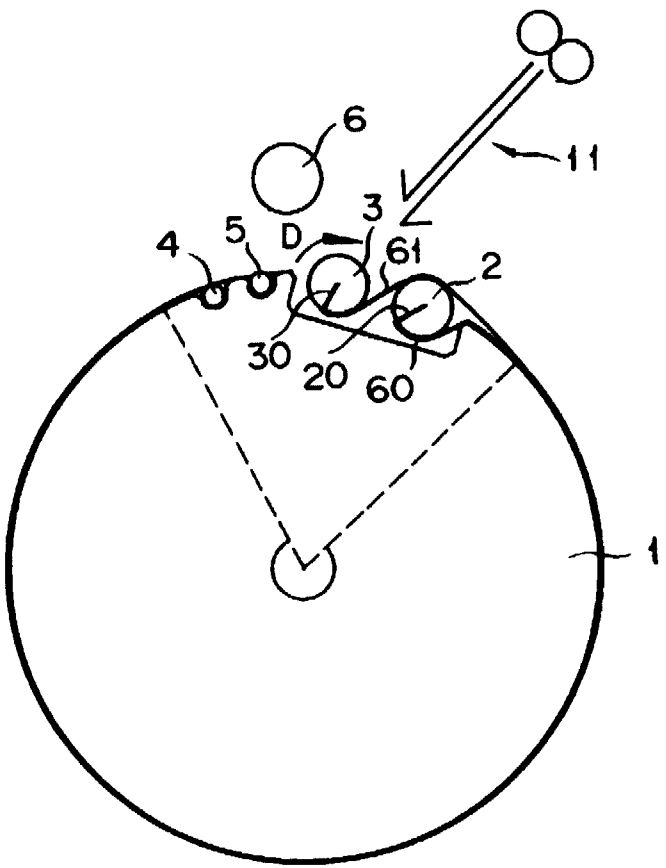
FIG. 31 is a diagram showing a step of the media rolling operation on the ink sheet sequentially in the order of occurrence subsequent to that of FIG. 30.

Then, the winding roller 3 is rotated in the direction (CW) indicated by the arrow D shown in FIG. 31 and consequently induced to roll the ink sheet 61 and bring it into close contact with the recording paper 60 already overlying the drum 1.

In consequence of the steps of operation described above, the recording paper 60 and the ink sheet 61 rolled around it are brought into close contact with the drum 1.

Now, the discharge of the media (recording paper and ink sheet) will be described with reference to the flow charts shown in FIGS. 32–39.

Figure 32:
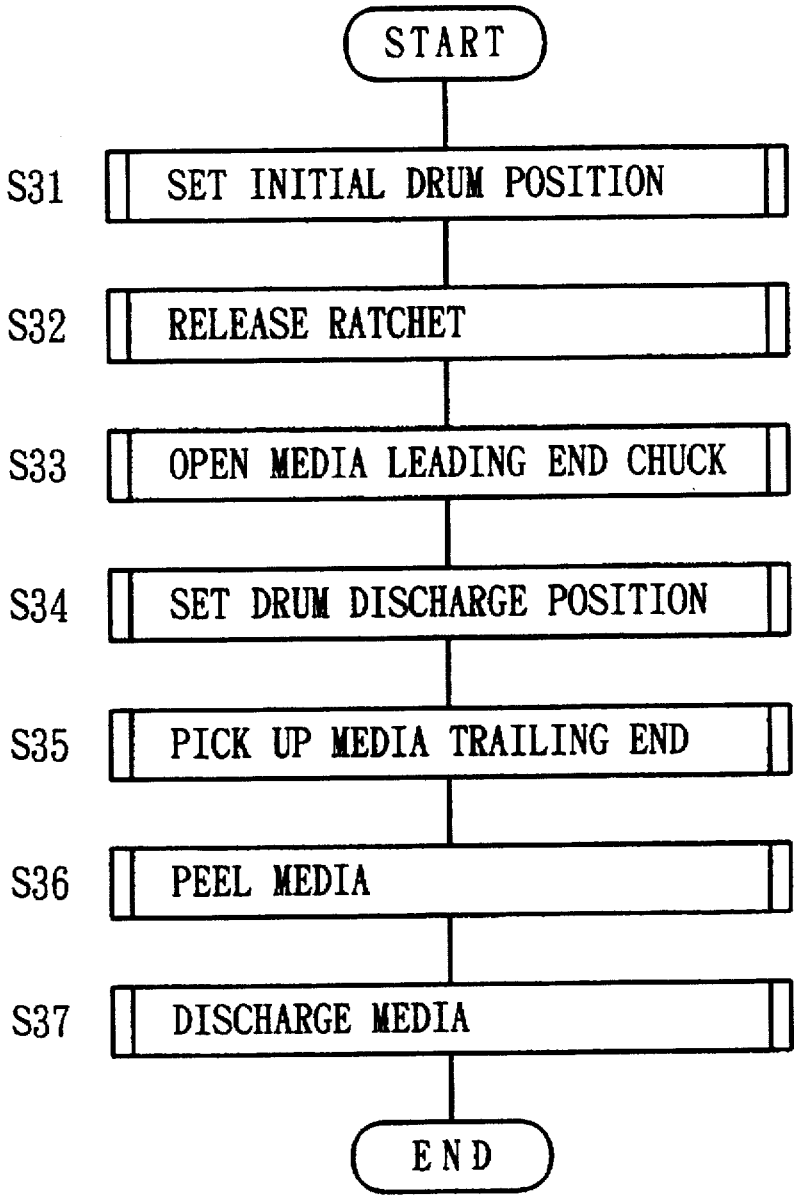
FIG. 32 is a flow chart showing an operation for discharging the media in the embodiment mentioned above.

The discharge of the media, as shown in FIG. 32, comprises the steps of setting the drum at the initial position (S31), releasing the ratchet (S32), opening the chuck for nipping the leading end of the media (S33), setting the drum discharge position (S34), picking up the trailing end of the media (S35), peeling the media (S36), and discharging the media (S37).

Figure 33:
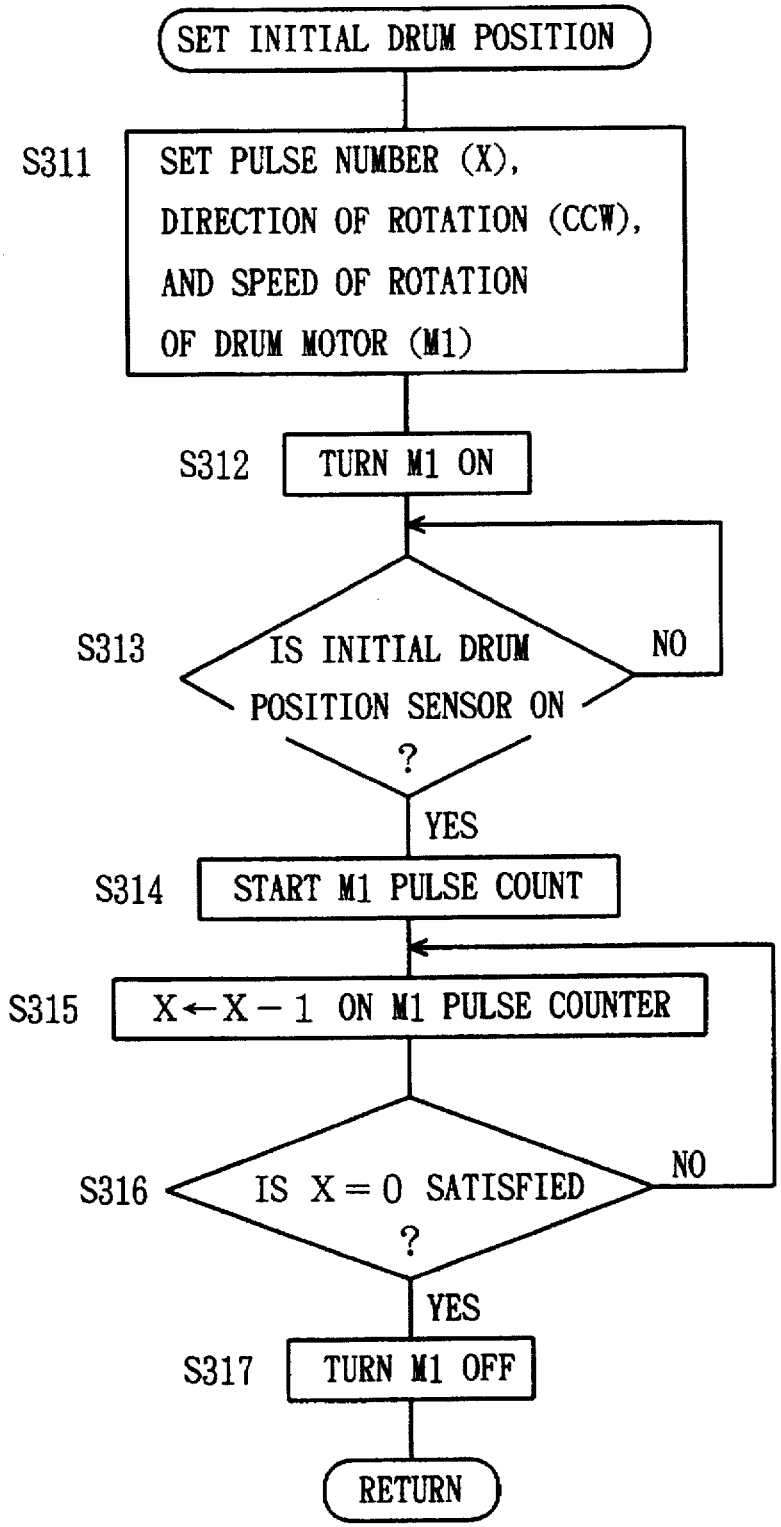
FIG. 33 is a flow chart showing an operation for setting the initial drum position in a media discharging operation in the embodiment mentioned above.

Now, the component steps of the operation mentioned above will be described more specifically below. The setting of the initial drum position, as shown in FIG. 33, comprises first setting the number of pulses X, the direction of rotation CCW, and the speed of rotation for the drum motor M1 (S311), starting the motor M1 (M1 ON) (S312), causing the initial drum position sensor, subsequently to the start of the rotation of the drum, to determine whether or not the drum has reached the initial position (S313), starting the count of pulses of the motor M1 (S314) after detecting the fact that the drum has reached the initial position, and stopping the motor M1 (M1 OFF) (S317) when the number, X, of pulses sequentially decreased (S315) is ultimately brought to 0 (S316). As a result, the drum comes to the stated position.

Figure 34:
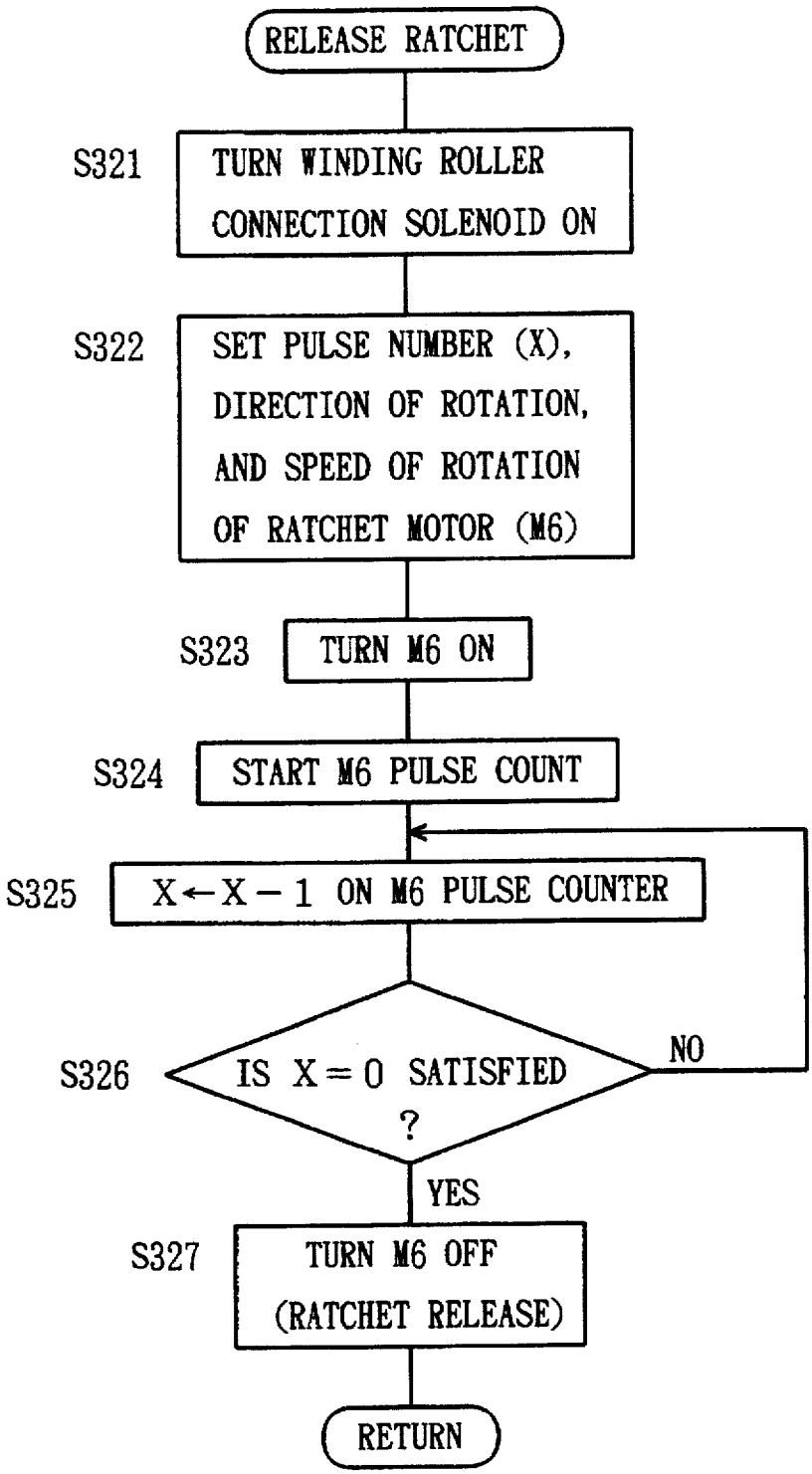
FIG. 34 is a flow chart showing an operation for releasing a ratchet in the media discharging operation in the embodiment mentioned above.

The operation for releasing the ratchet, as shown in FIG. 34, comprises turning the winding roller connection solenoid ON thereby precluding transmission of the motive force of the motor M2 to the winding roller and preventing the winding roller from producing an idle rotation (S321) even when the ratchet is released, setting the number of pulses X and the speed of rotation for the ratchet motor M6 (S322), starting the motor M6 (M6 ON) (S323), starting the count of pulses of the motor M6 (S324), and stopping the motor M6 (M6 OFF) (S327) when the number, X, of pulses sequentially decreased (S325) is ultimately brought to 0 (S326). As a result, the claw of the ratchet disposed in the winding roller is dislocated and released and the winding roller is allowed to rotate freely.

Figure 35:
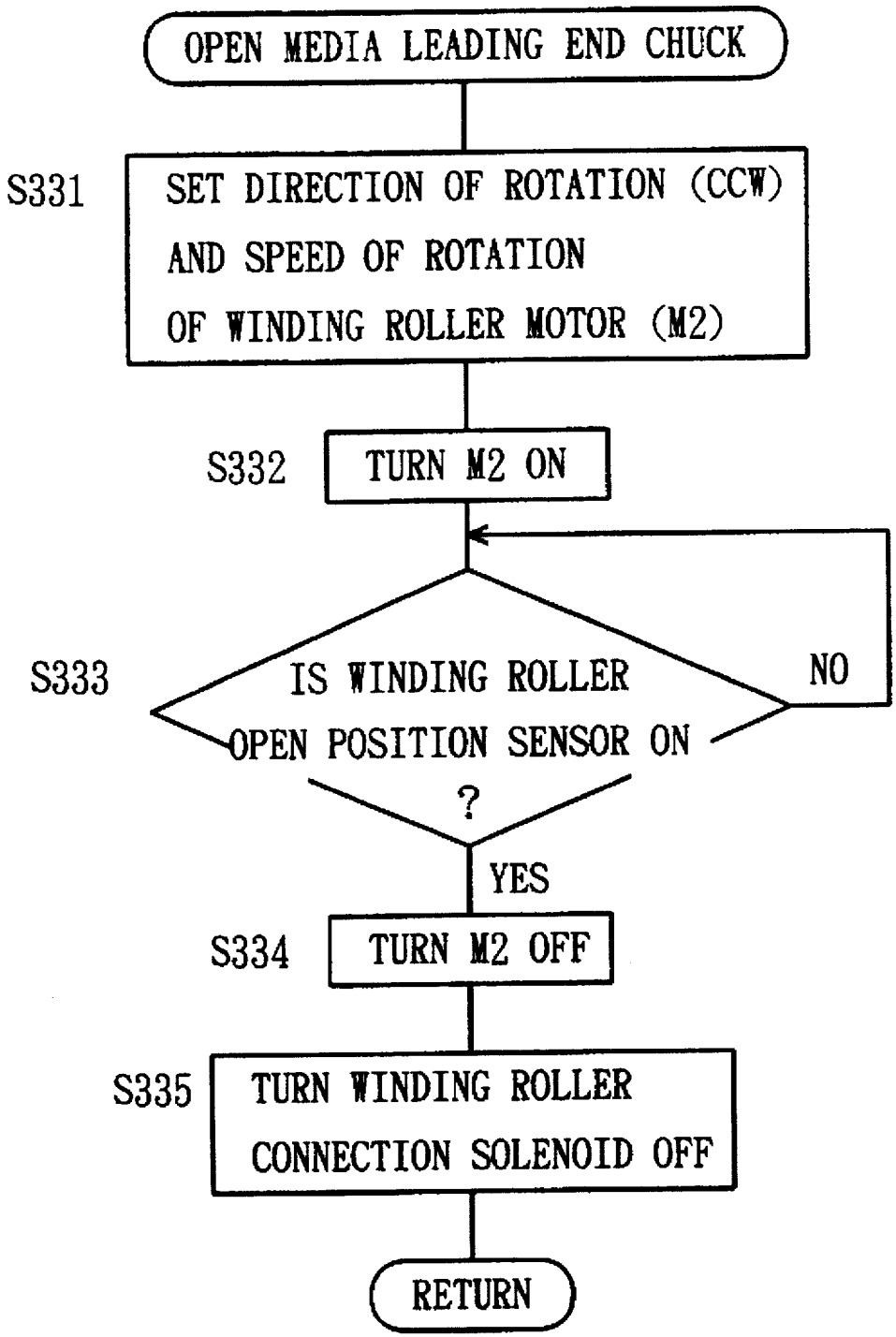
FIG. 35 is a flow chart showing an operation for opening the chuck at the leading end of the media in the media discharging operation in the embodiment mentioned above.

Then, the operation for opening the chuck for nipping the leading end of the media, as shown in FIG. 35, comprises first setting the direction of rotation CCW and the speed of rotation for the winding roller motor M2 (S331), starting the motor M2 (M2 ON) (S332), causing the winding roller open position sensor to determine whether or not the winding roller has reached the open position (S333), stopping the motor M2 (M2 OFF) after detecting the fact that the winding roller has reached the open position (S334) thereby opening the leading end chuck of the winding roller which has kept the leading end of the media in a nipped state, and turning the winding roller connection solenoid OFF thereby separating the winding roller from the motor M2 (S335).

Figure 36:
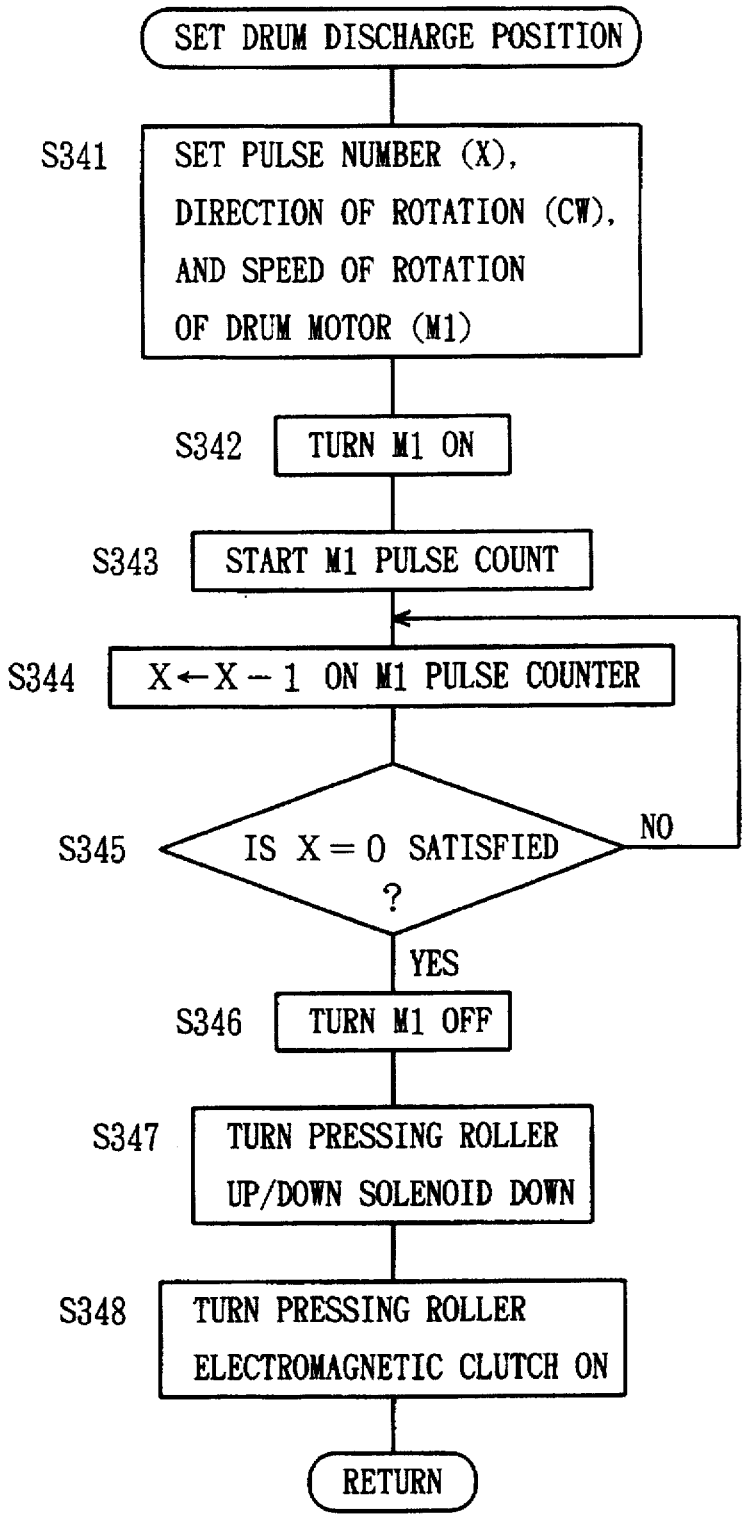
FIG. 36 is a flow chart showing an operation for setting position for discharge from the drum in the media discharging operation in the embodiment mentioned above.

The operation for setting the drum discharge position, as shown in FIG. 36, comprises first setting the number of pulses X, the direction of rotation CCW, and the speed of rotation for the drum motor M1 (S341), starting the motor M1 (M1 ON) (S342), starting the count of pulses of the motor M1 (S343), stopping the motor M1 (M1 OFF) (S346) when the number, X, of pulses sequentially decreased (S344) is ultimately brought to 0 (S345) thereby allowing the drum to come to the stated position for discharge, turning the pressing roller up/down solenoid in a down mode and allowing the pressing roller to contact the drum (S347), and turning the electromagnetic clutch ON so as to allow exertion of the motive force on the pressing roller (S348).

Figure 37:
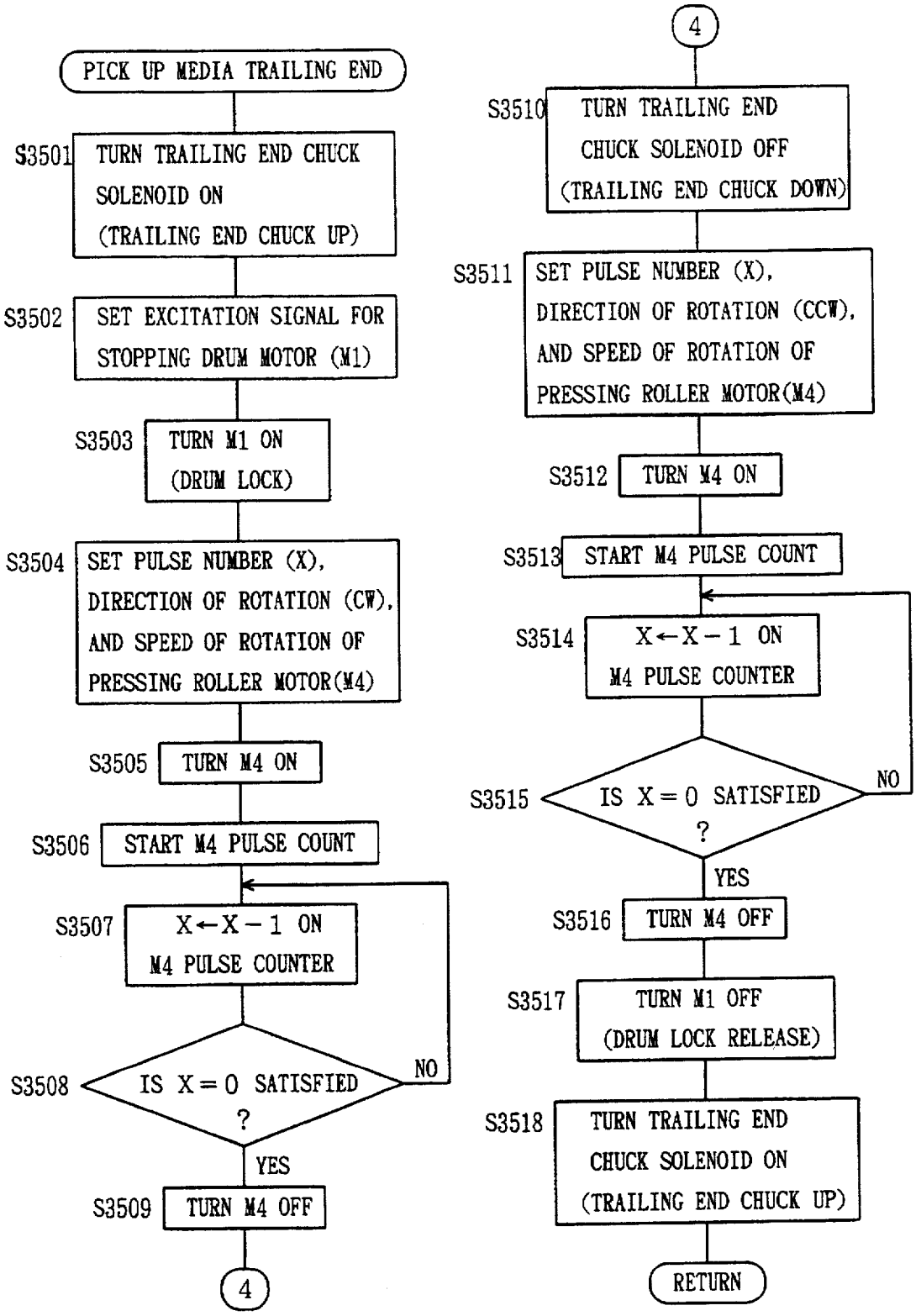
FIG. 37 is a flow chart showing an operation for picking up the trailing end of the media in the media discharging operation in the embodiment mentioned above.

The operation for picking up the trailing end of the media, as shown in FIG. 37, comprises first turning the trailing end chuck solenoid ON and consequently raising the trailing end chuck (S3501), setting the stop excitation signal for the drum motor M1 so as to immobilize the drum (S3502), and issuing the stop excitation signal thereby setting the drum in a locked state (S3503).

It further comprises setting the number of pulses X, the direction of rotation CW, and the speed of rotation for the pressing roller motor M4 (S3504), starting the motor M4 (M4 ON) (S3505), starting the count of pulses of the motor M4 (S3506), stopping the motor M4 (M4 OFF) (S3509) when the number, X, of pulses sequentially decreased (S3507) is ultimately brought to 0 (S3508) thereby causing the pressing roller to produce as many rotations as the set number of pulses X and pull the media from the trailing end chuck.

It further comprises turning the trailing end chuck solenoid OFF and consequently lowering the trailing end chuck (S3510), setting the number of pulses X, the direction of rotation CCW, and the speed of rotation for the pressing roller motor M4 (S3511), starting the motor M4 (M4 ON) (S3512), starting the count of pulses of the motor M4 (S3513), stopping the motor M4 (M4 OFF) (S3516) and turning the stop excitation signal OFF for the motor M1 (drum lock release) (S3517) when the number, X, of pulses sequentially decreased (S3514) is ultimately brought to 0 (S3515) thereby allowing the media to return to the home position, and then turning the trailing end chuck solenoid ON thereby raising the trailing end chuck and facilitating the entrance of the trailing end of the media into the discharge device (S3518).

Figure 38:
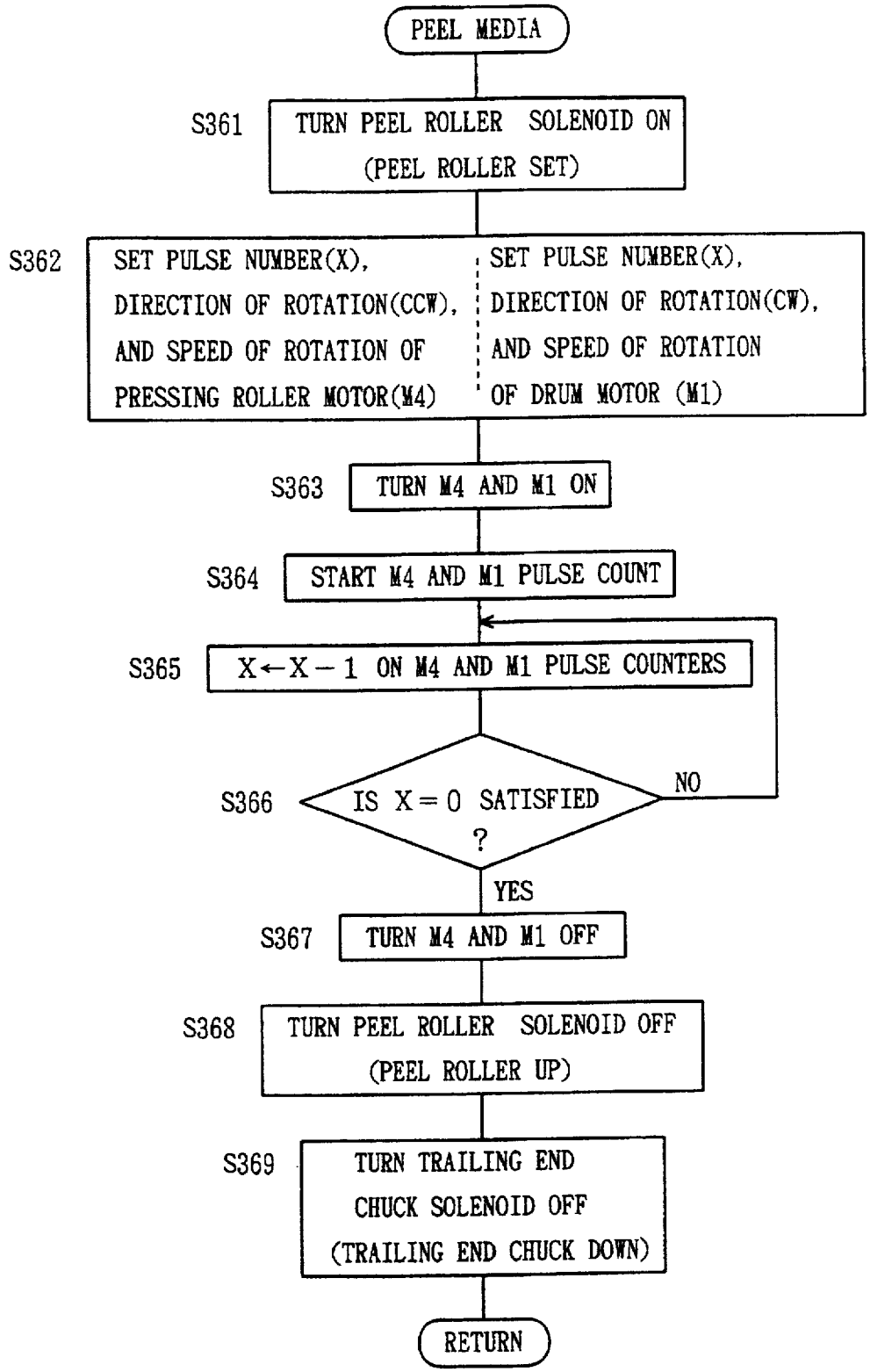
FIG. 38 is a flow chart showing an operation for peeling the media in the media discharging operation in the embodiment mentioned above.

The operation for peeling the media, as shown in FIG. 38, comprises first turning the peel roller solenoid ON thereby setting the peel roller (S361), setting the number of pulses X, the direction of rotation CCW, and the speed of rotation for the pressing roller motor M4 and the number of pulsesb X, the direction of rotation CW, and the speed of rotation for the drum motor M1 (S362), starting the motors M4 and M1 (M4, M1 ON) (S363), starting the count of pulses of the motors M4 and M1 (S364), stopping the motors M4 and M1 (M4, M1 OFF) (S367) when the number, X, of pulses sequentially decreased (S365) is ultimately brought to 0 (S366) thereby enabling the pressing roller and the drum to produce as many rotations as the set number of pulses X and separate the media from the drum and lead it to the discharge device.

It further comprises turning the peel roller solenoid OFF thereby raising the peel roller (S368) and turning the trailing end chuck solenoid OFF to lower the trailing end chuck (S369).

Figure 39:
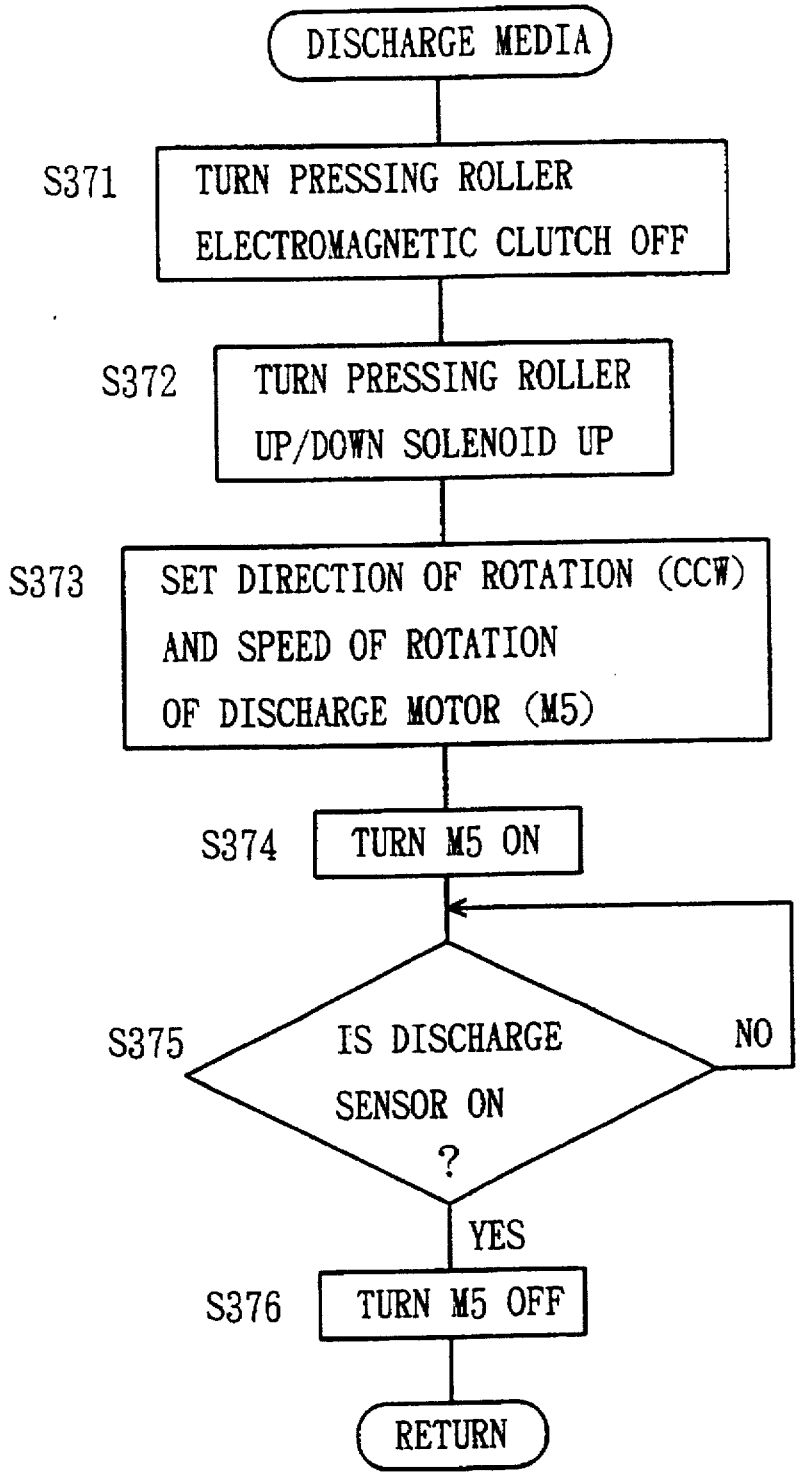
FIG. 39 is a flow chart showing an operation for discharging the media in the media discharging operation in the embodiment mentioned above.

The operation for discharging the media, as shown in FIG. 39, comprises first turning the electromagnetic clutch of the pressing roller OFF thereby allowing the pressing roller to move freely (S371) and turning the pressing roller up/down solenoid in a up mode thereby separating the pressing roller from the drum (S372) .

It further comprises setting the direction of rotation CCW and the speed of rotation for the discharge motor M5 of the discharge device (S373), starting the motor M5 (M5 ON) (S374), and, when the discharge sensor detects the fact that the media is discharged (S375), stopping the motor M5 (M5 OFF) (S376) thereby inducing discharge of the media.

The discharge of the media (recording paper and ink sheet) from the drum is effected as described above. The operation is further described with reference to FIGS. 40–61 to show how the recording paper and the ink sheet are rolled severally around the drum 1.

First, the discharge of the ink sheet will be described.

Figure 40:
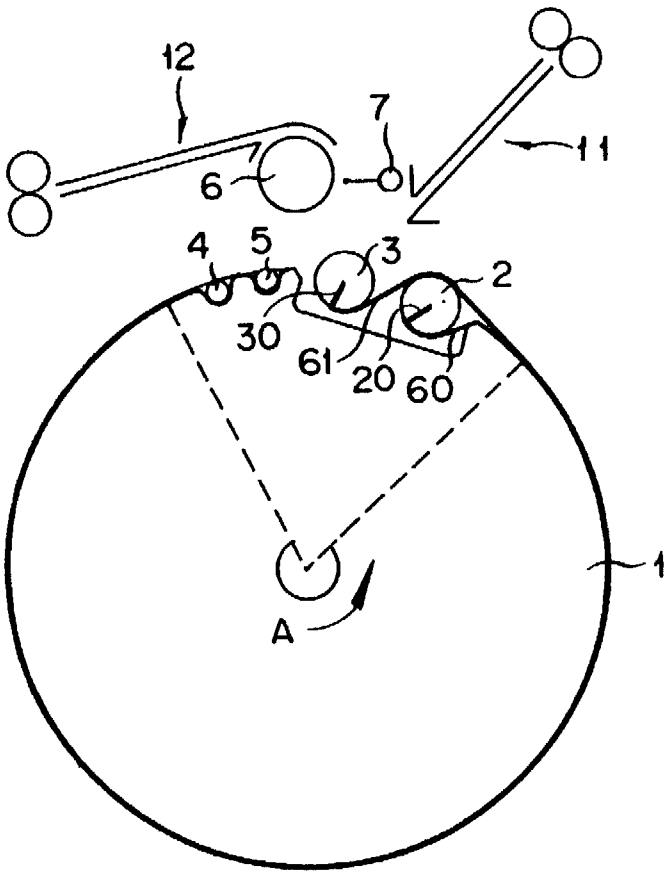
FIG. 40 is a diagram showing a step of the media discharging operation on the ink sheet sequentially in the order of occurrence in the embodiment mentioned above.

The drum 1 is rotated in the direction indicated by the arrow A (CCW) shown in FIG. 40 and set at the initial position and, at the same time, the ratchet is set free.

Figure 41:
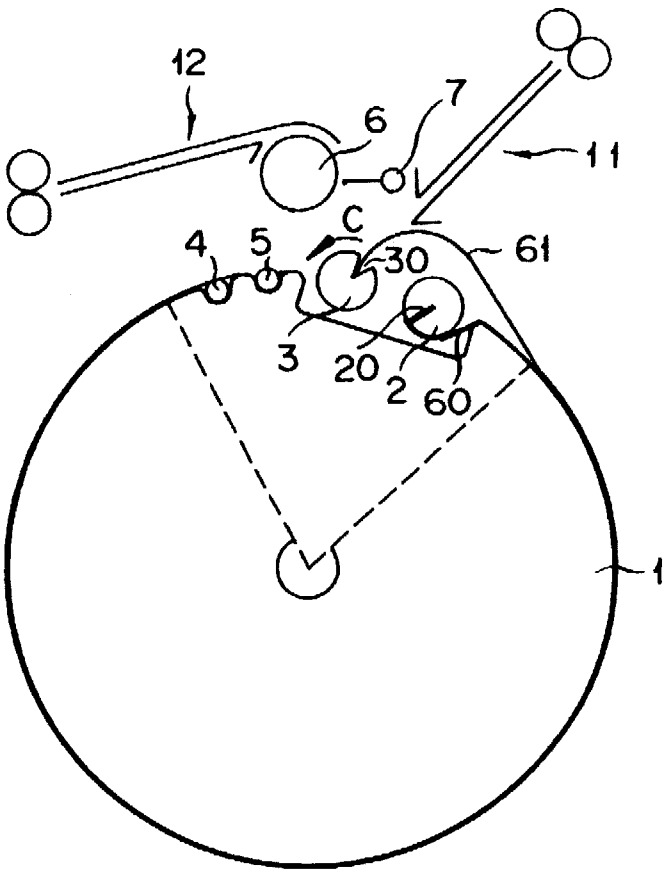
FIG. 41 is a diagram showing a step of the media discharging operation on the ink sheet sequentially in the order of occurrence subsequent to that of FIG. 40.

Then, the winding roller 3 is rotated in the direction indicated by the arrow C (CCW) shown in FIG. 41 and the leading end chuck is consequently opened to release the leading end of the ink sheet 61.

Figure 42:
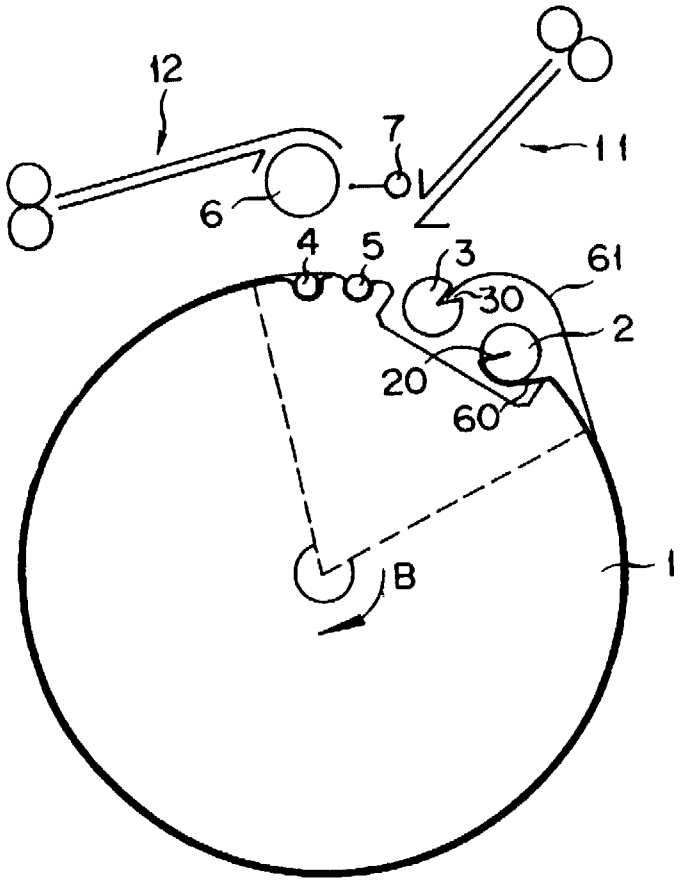
FIG. 42 is a diagram showing a step of the media discharging operation on the ink sheet sequentially in the order of occurrence subsequent to that of FIG. 41.

Then, the drum 1 is rotated in the direction indicated by the arrow B (CCW) shown in FIG. 42 and consequently set at the discharge position.

Figure 43:
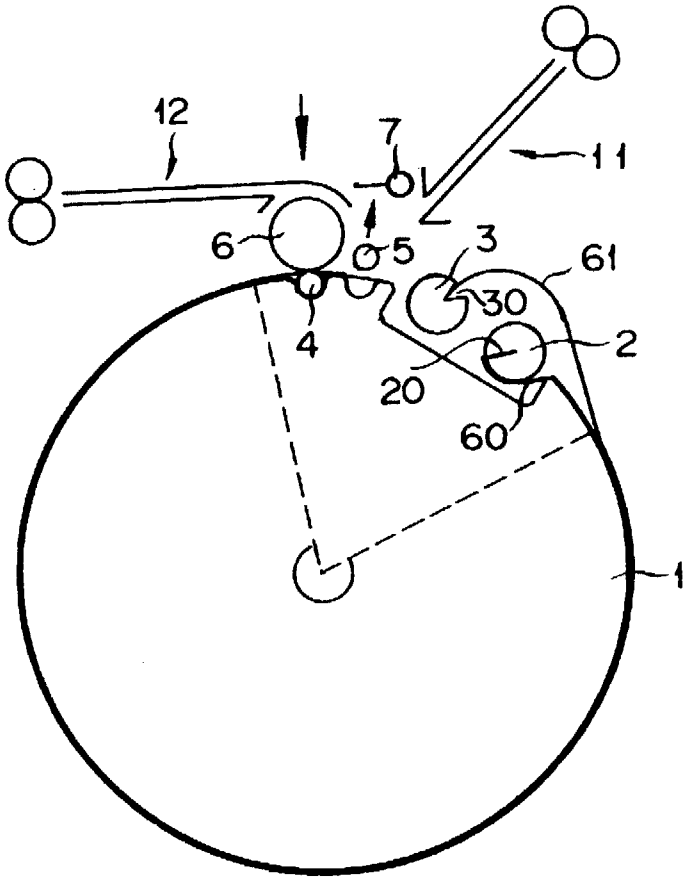
FIG. 43 is a diagram showing a step of the media discharging operation on the ink sheet sequentially in the order of occurrence subsequent to that of FIG. 42.

Then, the pressing roller 6 is lowered and brought into contact with the drum 1 and, at the same time, the trailing end chuck 5 is raised to release the trailing end of the ink sheet 61 as shown in FIG. 43.

Figure 44:
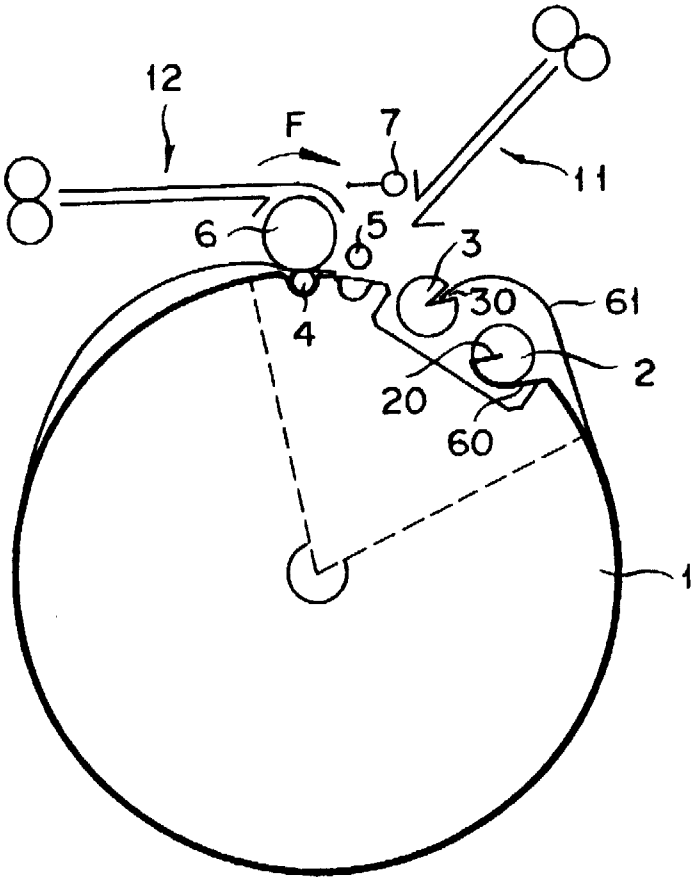
FIG. 44 is a diagram showing a step of the media discharging operation on the ink sheet sequentially in the order of occurrence subsequent to that of FIG. 43.

Then, the pressing roller 6 is rotated in the direction indicated by the arrow F (CW) shown in FIG. 44 and, at the same time, the pressing roller 6 is induced to draw the ink sheet 61 out of the trailing end chuck 5.

Figure 45:
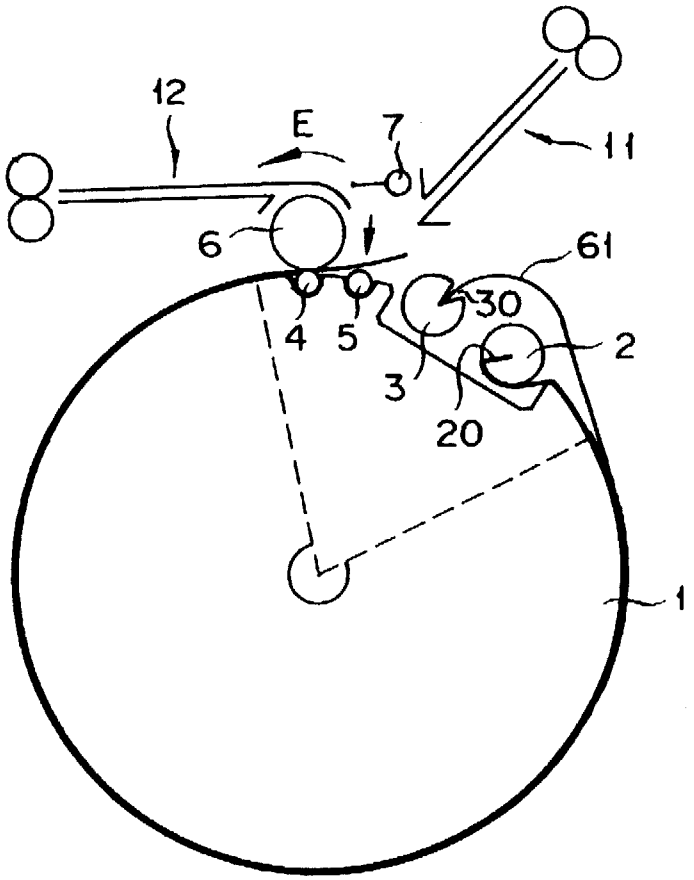
FIG. 45 is a diagram showing a step of the media discharging operation on the ink sheet sequentially in the order of occurrence subsequent to that of FIG. 44.

Then, the trailing end chuck 5 is lowered and the pressing roller 6 is rotated in the direction indicated by the arrow E (CCW) shown in FIG. 45 thereby causing the trailing end of the ink sheet 61 to be returned onto the trailing end chuck 5.

Figure 46:
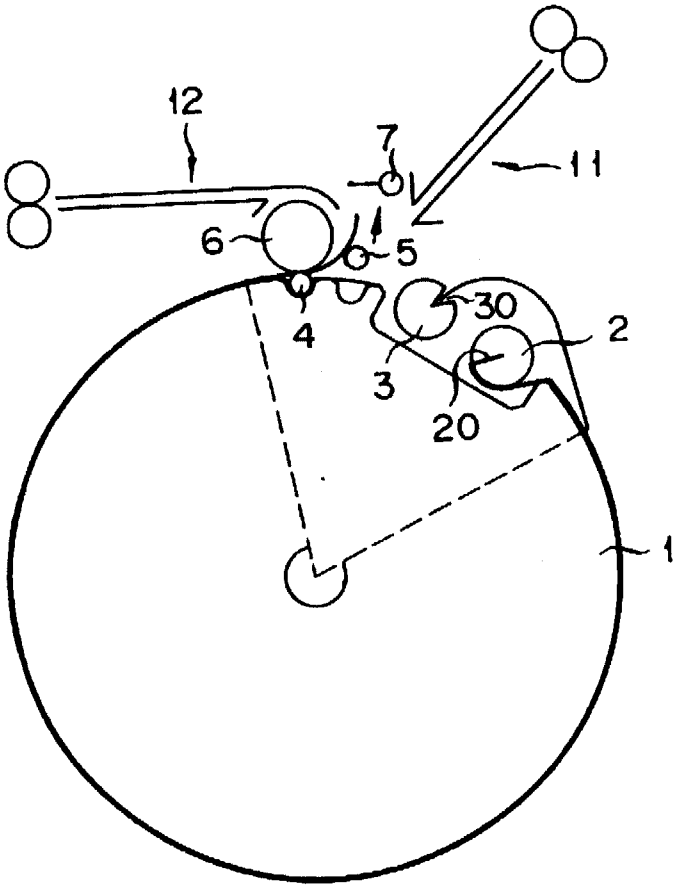
FIG. 46 is a diagram showing a step of the media discharging operation on the recording paper sequentially in the order of occurrence subsequent to that of FIG. 45.

Then, the trailing end chuck 5 is again raised as shown in FIG. 46 so as to facilitate the entrance of the trailing end of the ink sheet 61 into the discharge device 12.

Figure 47:
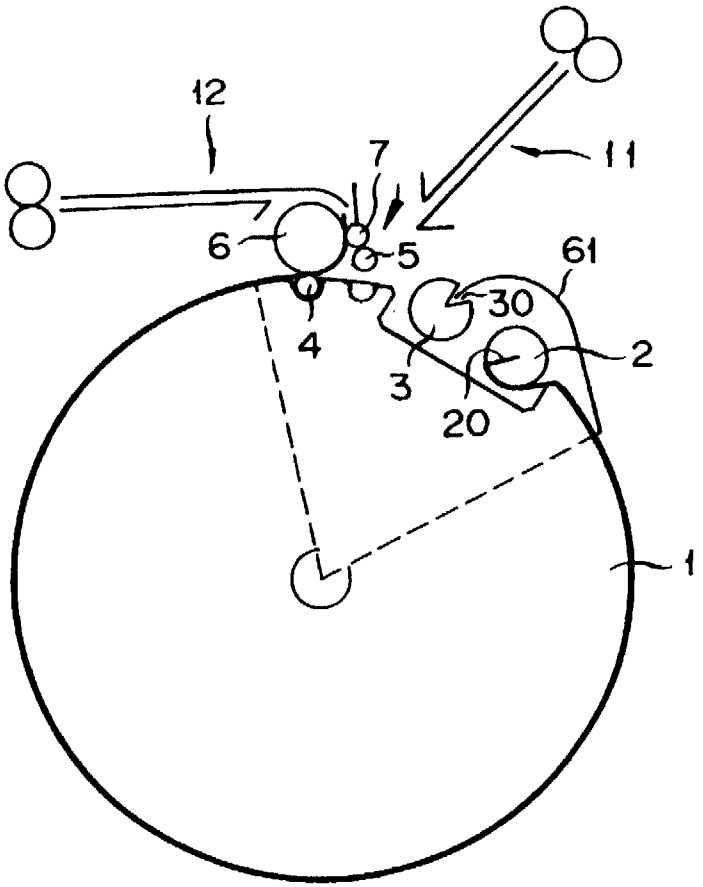
FIG. 47 is a diagram showing a step of the media discharging operation on the recording paper sequentially in the order of occurrence subsequent to that of FIG. 46.

Then, the peel roller 7 is set as shown in FIG. 47 so as to facilitate the entrance of the ink sheet into the discharge device 12.

Figure 48:
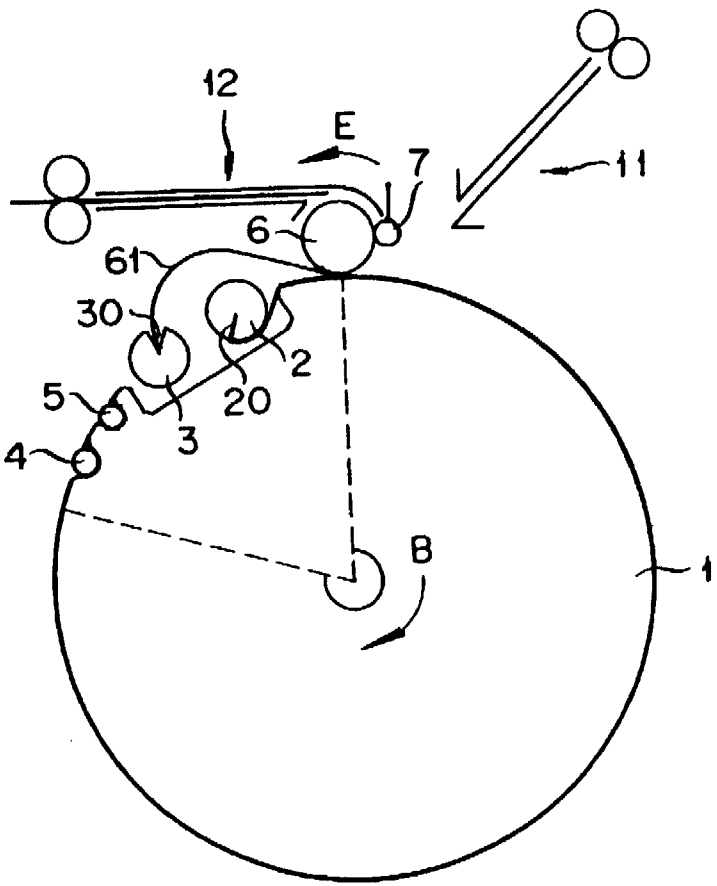
FIG. 48 is a diagram showing a step of the media discharging operation on the ink sheet sequentially in the order of occurrence subsequent to that of FIG. 47.

Then, the pressing roller 6 is rotated in the direction indicated by the arrow E (CCW) and the drum 1 is rotated in the direction indicated by the arrow B (CW) as shown in FIG. 48 thereby separating the ink sheet from the drum 1 and guiding the ink sheet into the discharge device 12.

Figure 49:
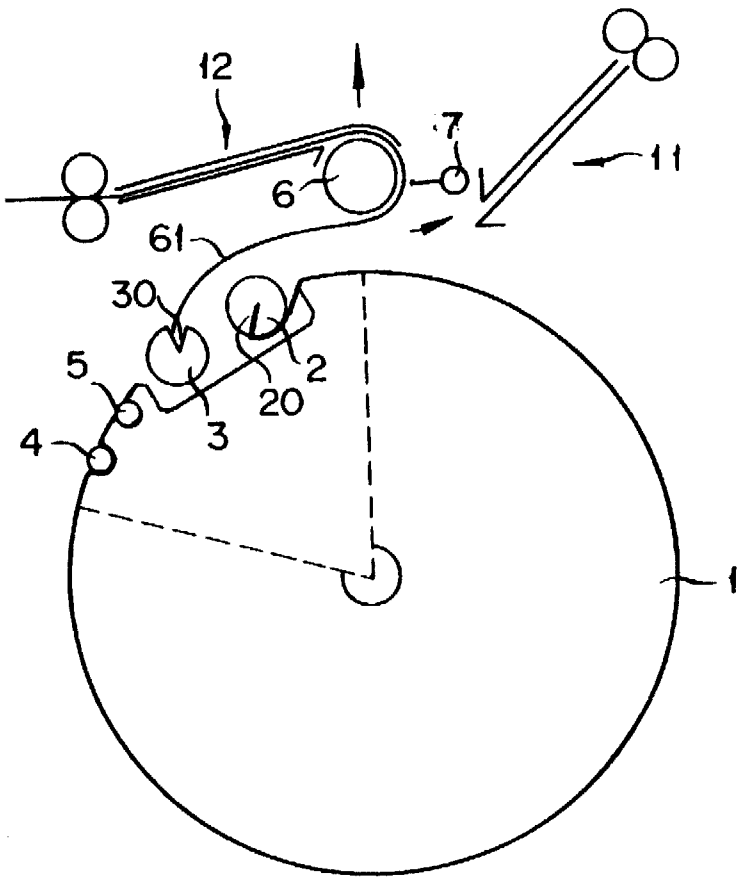
FIG. 49 is a diagram showing a step of the media discharging operation on the ink sheet sequentially in the order of occurrence subsequent to that of FIG. 48.

Then, the pressing roller 6 is raised and separated from the drum 1 and the peel roller 7 is also raised as shown in FIG. 49.

Figure 50:
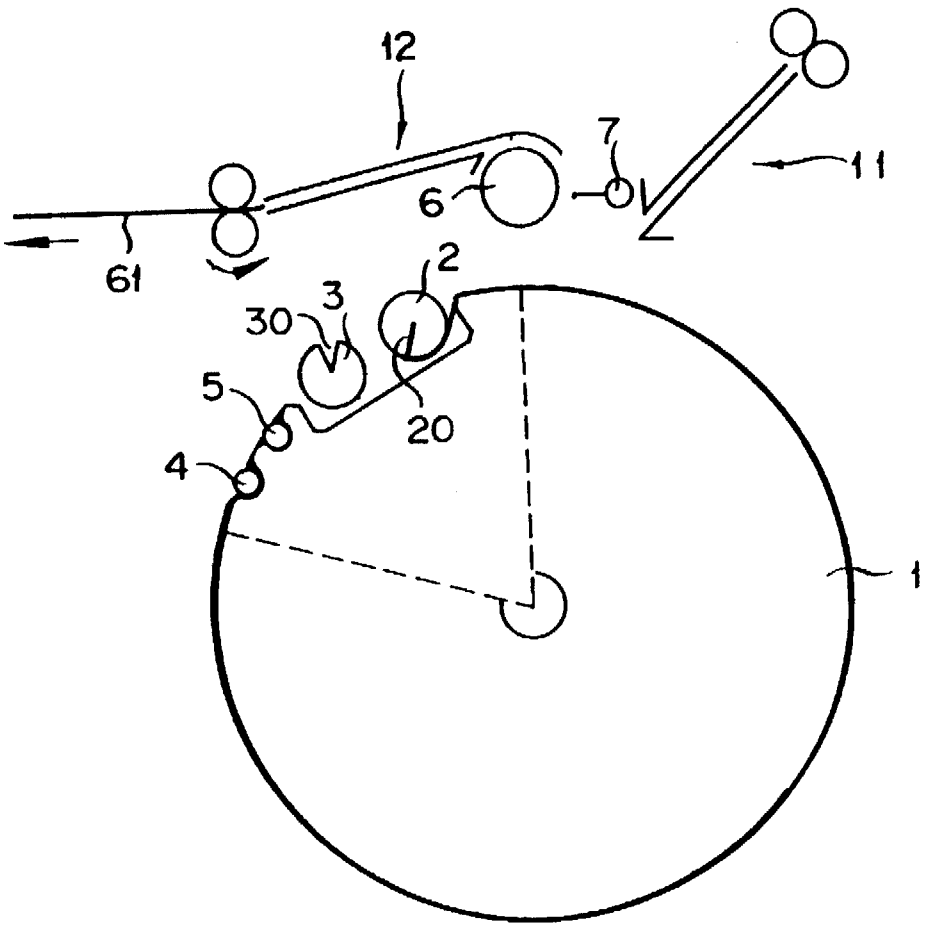
FIG. 50 is a diagram showing a step of the media discharging operation on the ink sheet sequentially in the order of occurrence subsequent to that of FIG. 49.

Then, the discharge motor of the discharge device 12 is started and the ink sheet 61 is consequently discharged as shown in FIG. 50.

Figure 51:
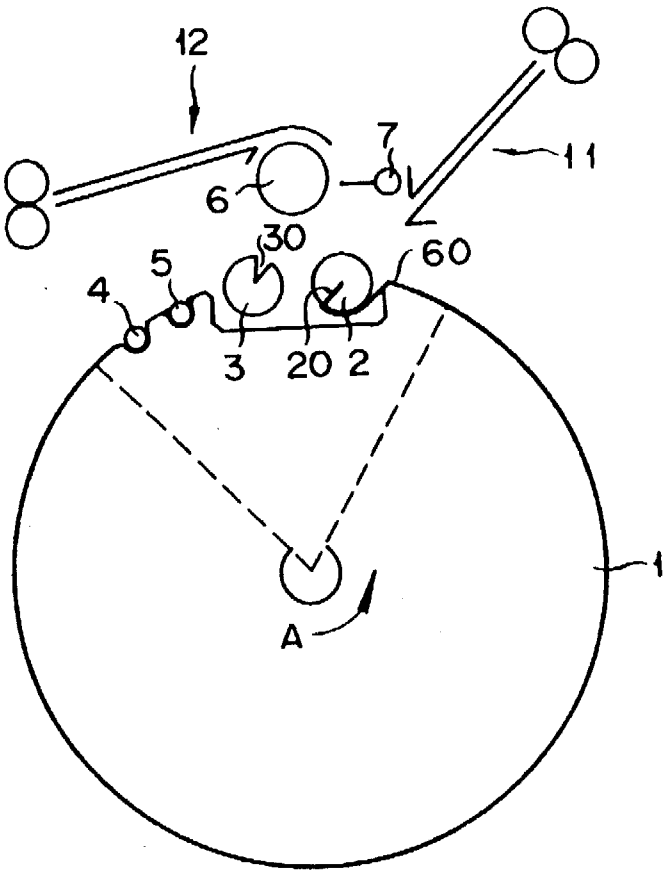
FIG. 51 is a diagram showing a step of the media discharging operation on the recording paper sequentially in the order of occurrence subsequent to that of FIG. 50.
Figure 54:
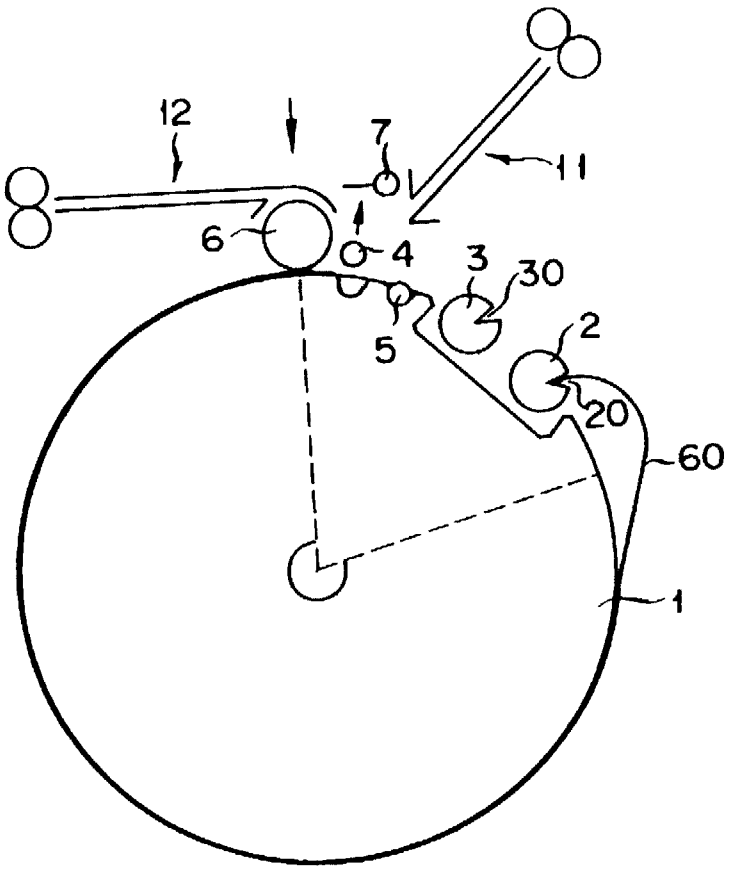
FIG. 54 is a diagram showing a step of the media discharging operation on the recording paper sequentially in the order of occurrence subsequent to that of FIG. 53.

Then, as respects the recording paper 60 similarly to the ink sheet 61 mentioned above, the drum 1 is first rotated in the direction indicated by the arrow A (CCW) and consequently set at the initial position and, at the same time, the ratchet is set free as shown in FIG. 51.

Figure 52:
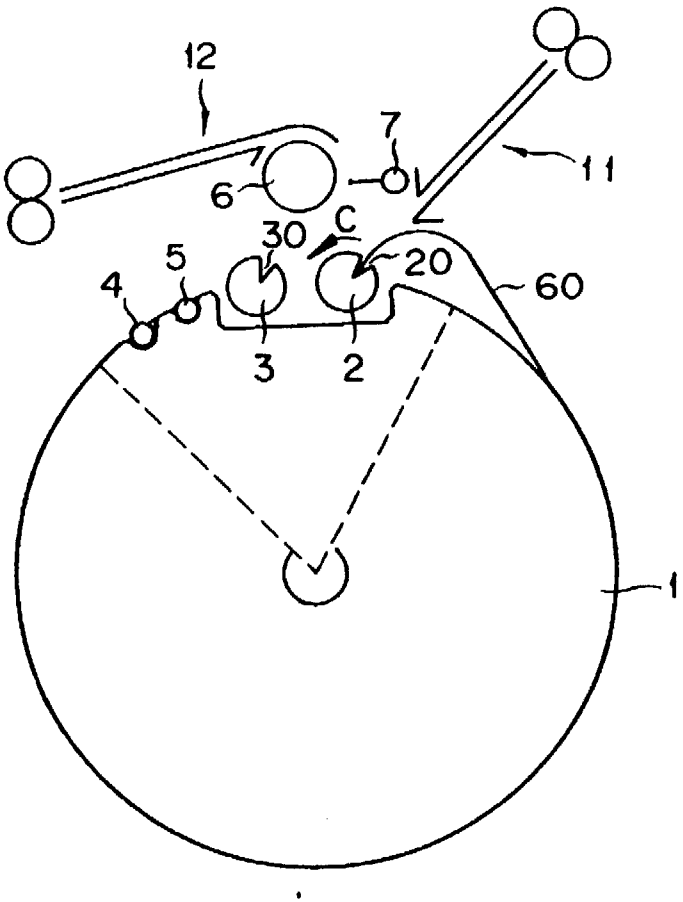
FIG. 52 is a diagram showing a step of the media discharging operation on the recording paper sequentially in the order of occurrence subsequent to that of FIG. 51.

Then, the winding roller 2 is rotated in the direction indicated by the arrow C (CCW) shown in FIG. 52 until the leading end chuck is opened to release the leading end of the recording paper 60.

Figure 53:
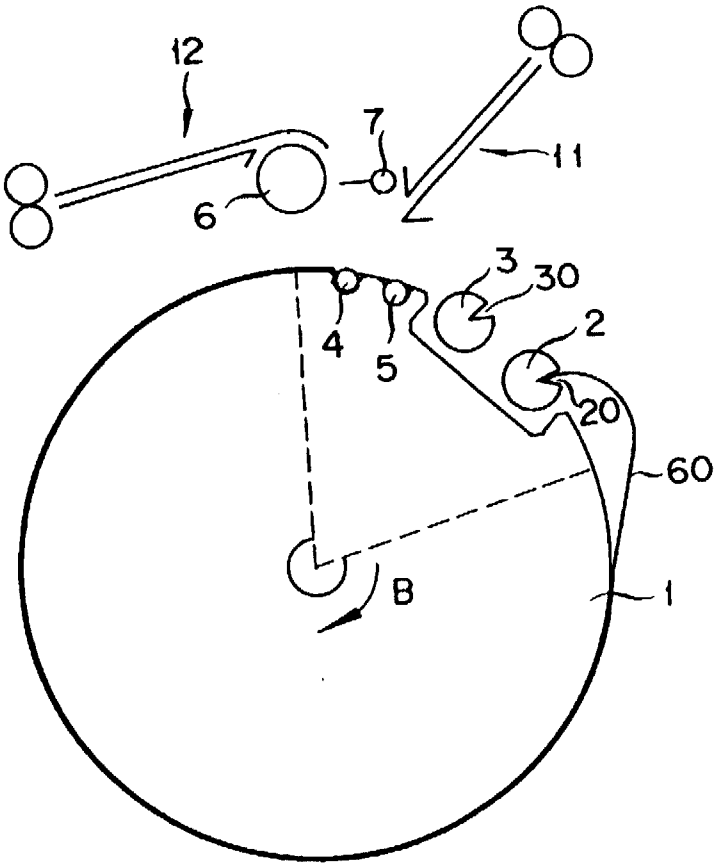
FIG. 53 is a diagram showing a step of the media discharging operation on the recording paper sequentially in the order of occurrence subsequent to that of FIG. 52.

Then, the drum 1 is rotated in the direction indicated by the allow B (CCW) shown in FIG. 53 and is consequently set at the discharge position.

Then, the pressing roller 6 is lowered and brought into contact with the drum 1 and, at the same time, the trailing end chuck 4 is raised to release the trailing end of the recording paper 60.

Figure 55:
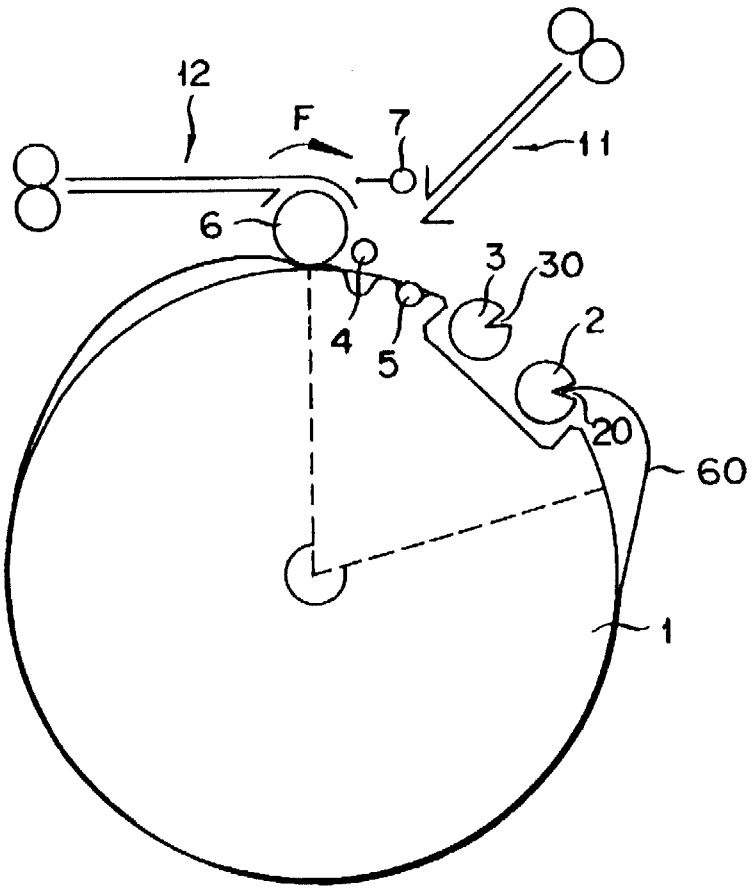
FIG. 55 is a diagram showing a step of the media discharging operation on the recording paper sequentially in the order of occurrence subsequent to that of FIG. 54.

Then, the pressing roller 6 is rotated in the direction indicated by the arrow F (CW) shown in FIG. 55 and the pressing roller 6 is consequently induced to draw the recording paper 60 out of the trailing end chuck 4.

Figure 56:
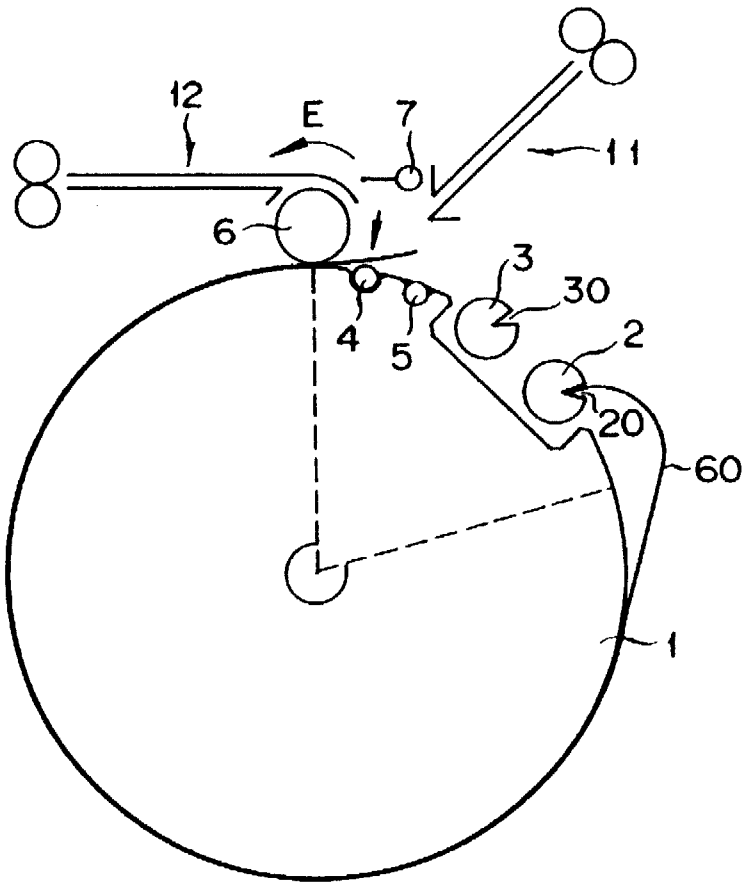
FIG. 56 is a diagram showing a step of the media discharging operating on the recording paper sequentially an the order of occurrence subsequent to that of FIG. 55.

Then, after the trailing end chuck 5 is lowered, the pressing roller 6 is rotated in the direction indicated by the arrow E (CCW) as shown in FIG. 56 so as to return the trailing end of the recording paper 60 onto the trailing end chuck 4.

Figure 57:
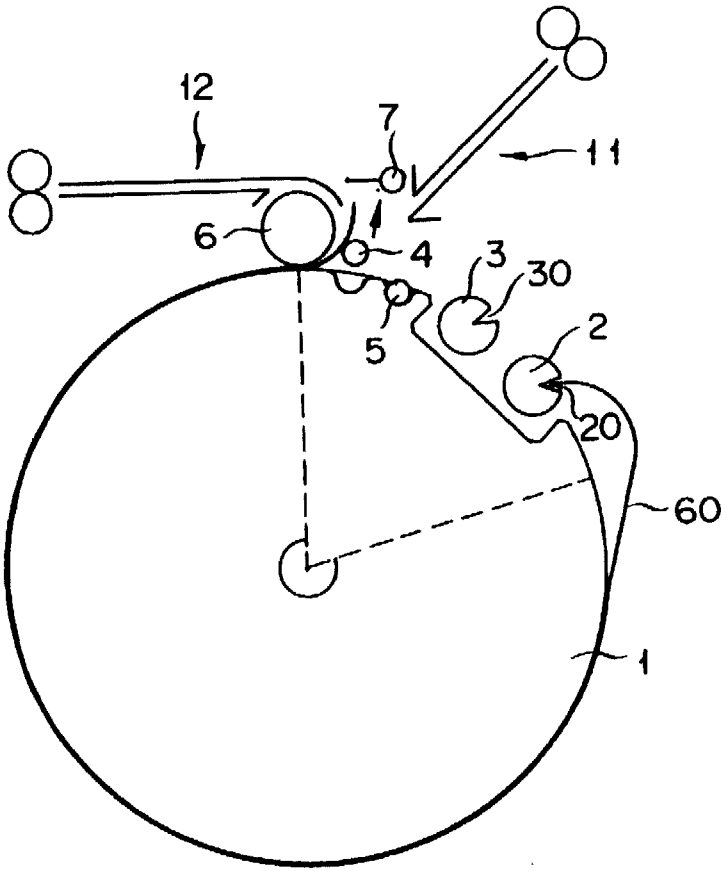
FIG. 57 is a diagram showing a step of the media discharging operation on the recording paper sequentially in the order of occurrence subsequent to that of FIG. 56.

Then, the trailing end chuck 4 is again raised as shown in FIG. 57 so as to facilitate the entrance of the trailing end of the recording paper 60 into the discharge device 12.

Figure 58:
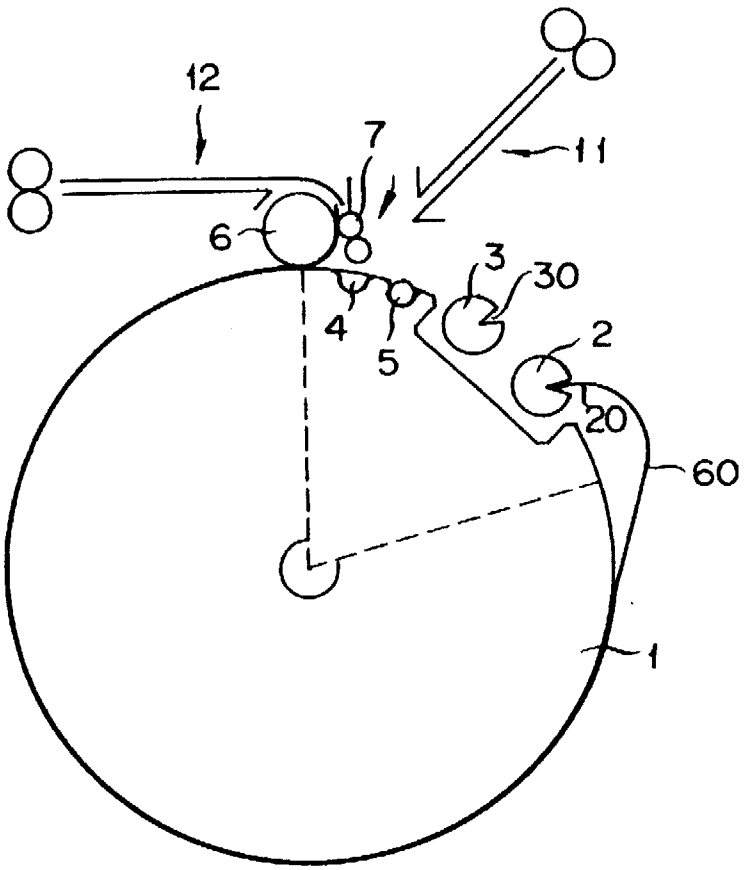
FIG. 58 is a diagram showing a step of the media discharging operation on the recording paper sequentially an the order of occurrence subsequent to that of FIG. 57.

Then, the peel roller 7 is set as shown in FIG. 58 so as to facilitate the entrance of the ink sheet into the discharge device 12.

Figure 59:
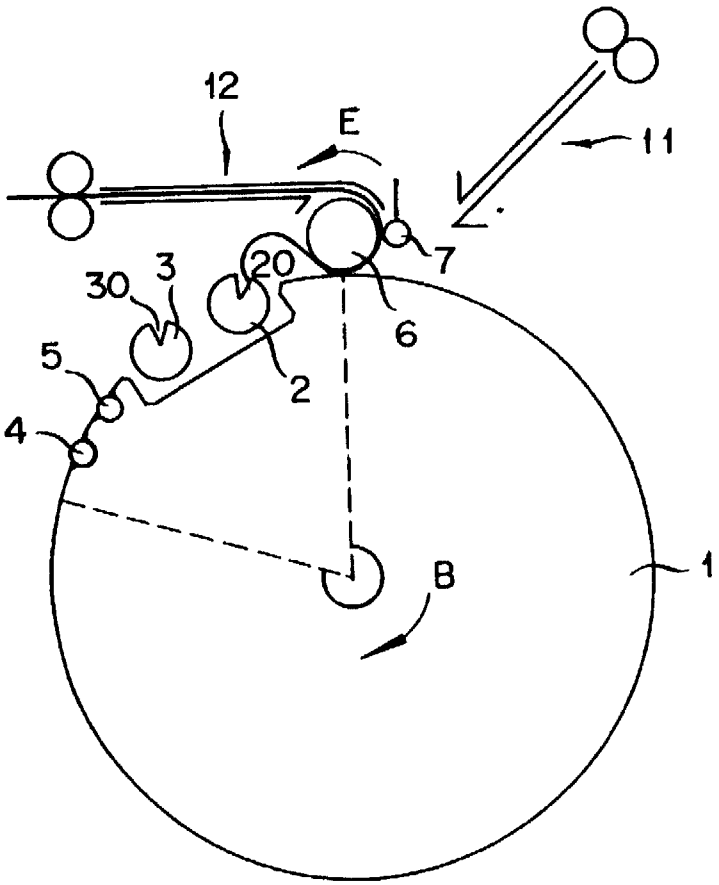
FIG. 59 is a diagram showing a step of the media discharging operation on the recording paper sequentially in the order of occurrence subsequent to that of FIG. 58.

Then, the pressing roller 6 is rotated in the direction indicated by the arrow E (CCW) and the drum 1 is rotated in the direction indicated by the arrow B as shown in FIG. 59 so as to separate the ink sheet from the drum 1 and lead this ink sheet into the discharge device 12.

Figure 60:
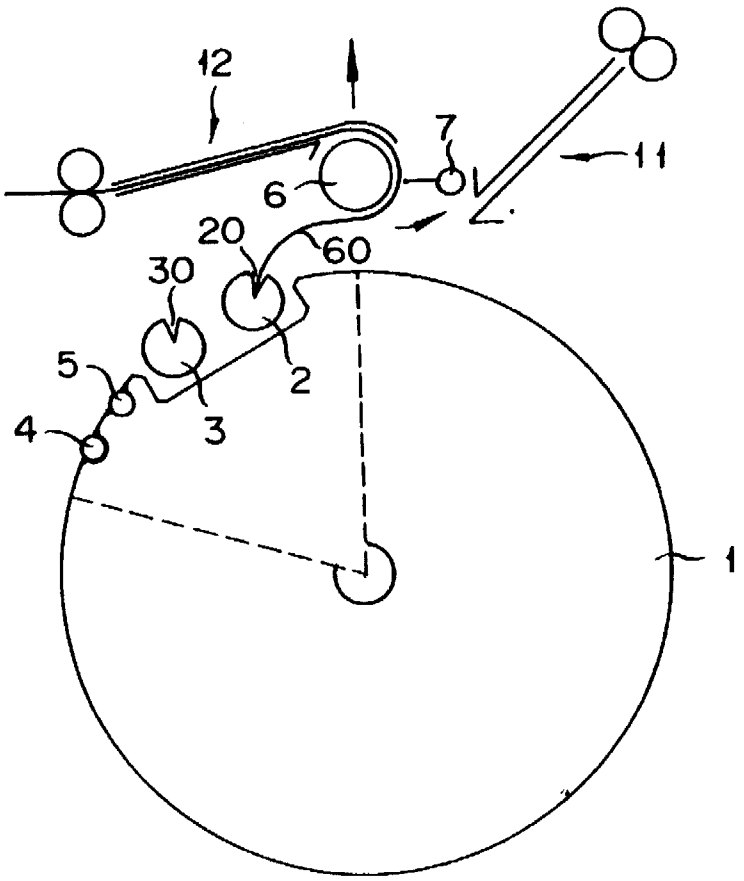
FIG. 60 is a diagram showing a step of the media discharging operation on the recording paper sequentially in the order of occurrence subsequent to that of FIG. 59.

Then, the pressing roller 6 is raised and separated from the drum 1 and the peel roller 7 is also raised as shown in FIG. 60.

Figure 61:
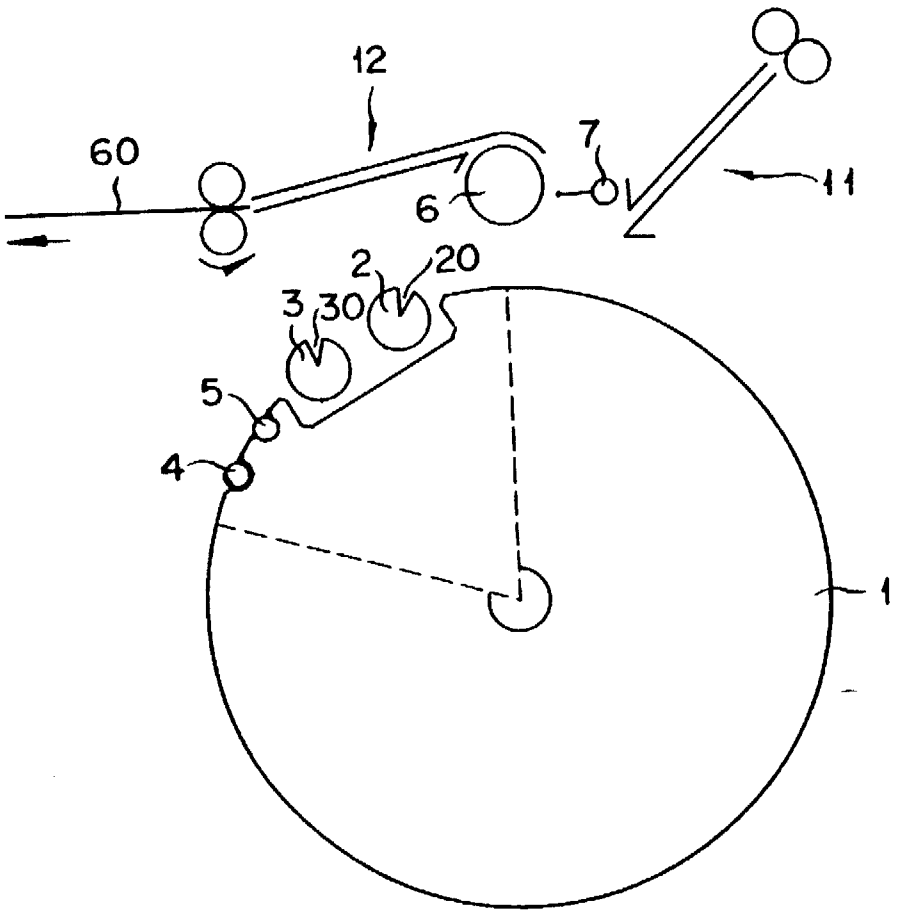
FIG. 61 is a diagram showing a step of the media discharging operation on the recording paper sequentially (in the order of occurrence subsequent to that of FIG. 60.

Then, the discharge motor of the discharge device 12 is started so as to discharge the recording paper 60 as shown in FIG. 61.

The discharge of the ink sheet 61 and the recording paper 60 are discharged in consequence of the steps of operation described above.

The embodiment described above represents a case of causing the leading end chuck to be rotated and move and consequently inducing the recording paper and the ink sheet to be drawn and brought into close contact owing to the rotation of the winding rollers 2 and 3 each provided with a leading end chuck. Instead of the rotation of the winding rollers, this invention may rely on the leading end chuck (winding roller) which in itself is adapted to be moved. It otherwise may adapt the trailing end chuck to be rendered movable in addition to the leading end chuck.

Now, a laser thermal ink transfer printer which utilizes the rolling apparatus of this invention for the recording paper and the ink sheet described above will be described below.

Incidentally, for the purpose of drawing an image on an image receiving paper by means of the laser thermal ink transfer process, the laser beam must be moved both in the main scanning direction and the secondary scanning direction relative to the image receiving paper. As concrete examples of the means for effecting the scanning contemplated herein, a plane scanning method, an outer cylinder periphery scanning method, and an inner cylinder periphery scanning method may be cited.

This invention can adopt effectively any of these methods. In the following description, the present invention is assumed to operate with the outer cylinder periphery method using a rotatable cylindrical drum.

Figure 62:
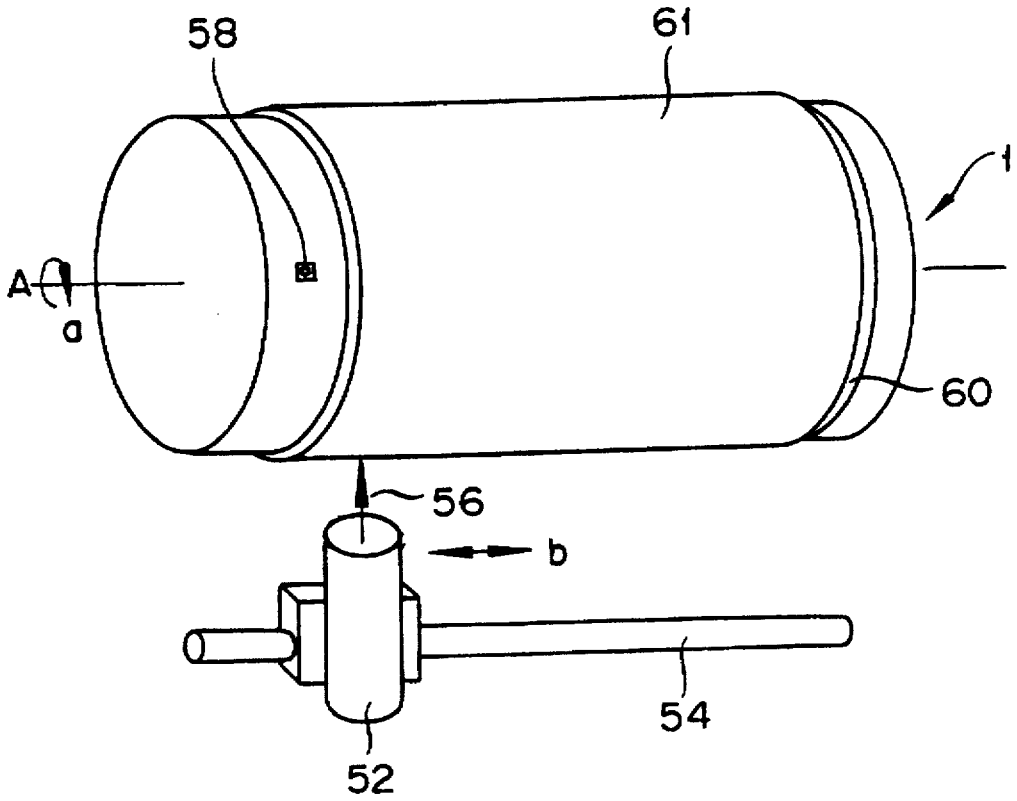
FIG. 62 is a schematic diagram of a laser thermal ink transfer printer using the rolling apparatus of this invention.

FIG. 62 is a structural diagram schematically showing one example of the laser thermal ink transfer printer which adopts the outer cylinder periphery scanning method.

The drum 1, as shown in the diagram, is rotated in the direction indicated by an arrow a (direction of main scanning) by a drive mechanism as supported on a rotary shaft (not shown). A laser beam source unit 52 has a moving shaft 54 thereof disposed parallelly to a rotary shaft A of the drum 1. The laser beam source unit 52 reciprocates the moving shaft 54 in the direction indicated by an arrow b shown in the diagram (direction of secondary scanning). The laser beam source unit 52 emits a laser beam 56 which will be specifically described herein below in the direction of the drum 1.

The recording paper 60 which has the image receiving layer thereof face outward is rolled in close contact around the outer peripheral surface of the drum 1. The ink sheet 61 which has the ink layer face inward is rolled in close contact around the recording paper 60 already overlying the drum 1.

Figure 63:
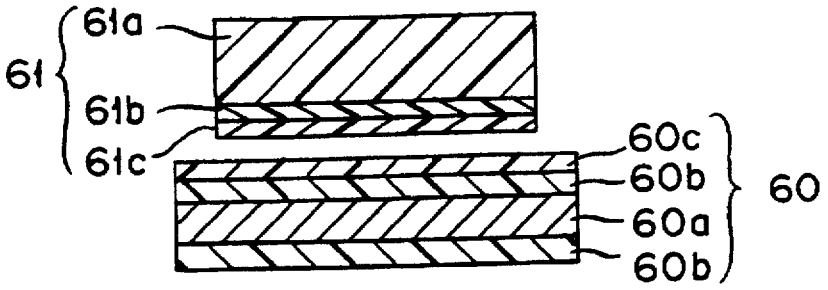
FIG. 63 is a cross section showing the constructions of the recording paper and the ink sheet.

The recording paper 60 is obtained by using a substrate having Yupo sheets **60*b* applied one each to the opposite surface of a quality paper 60*a* and depositing on this substrate an image receiving layer 60c provided with a coating of such substance as polycarbonate or polyurethane as shown in FIG. 63. The receiving layer 60c of the recording paper 60 is placed outside the outer periphery of the drum 1** to ensure reception of the dye.

Figure 64:
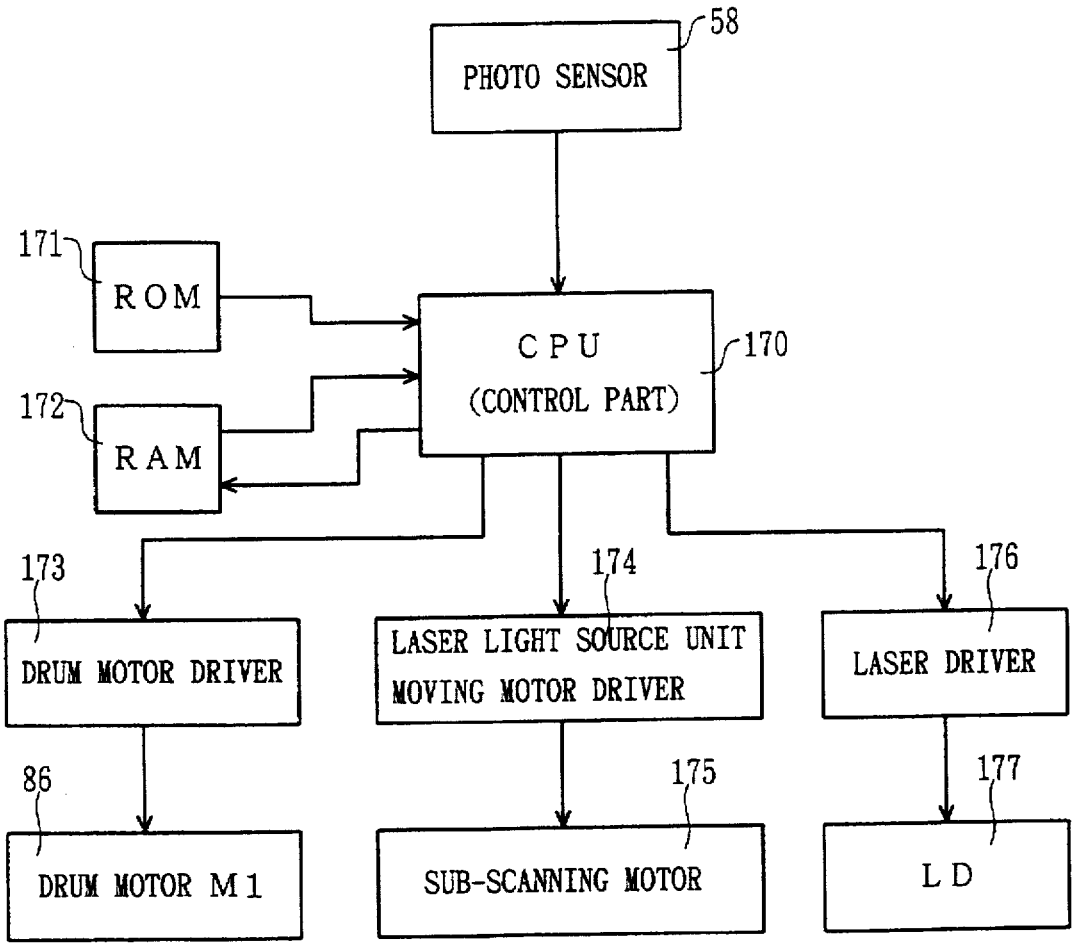
FIG. 64 is a block diagram of a control part of the laser thermal ink transfer printer mentioned above.
Figure 65A:
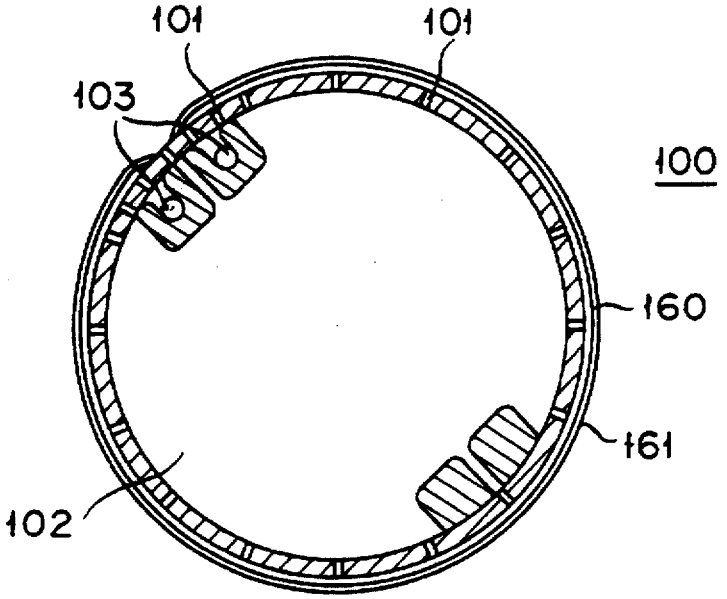
FIG. 65a Prior Art
FIG. 65*a* and 65*b* are diagrams showing a conventional rolling
Figure 65B:
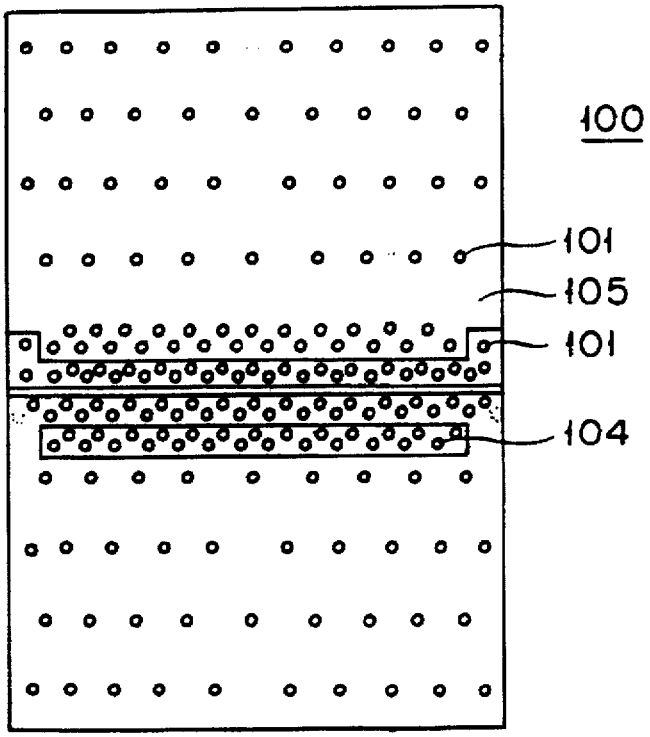
FIG. 65b Prior Art
Figure 66:
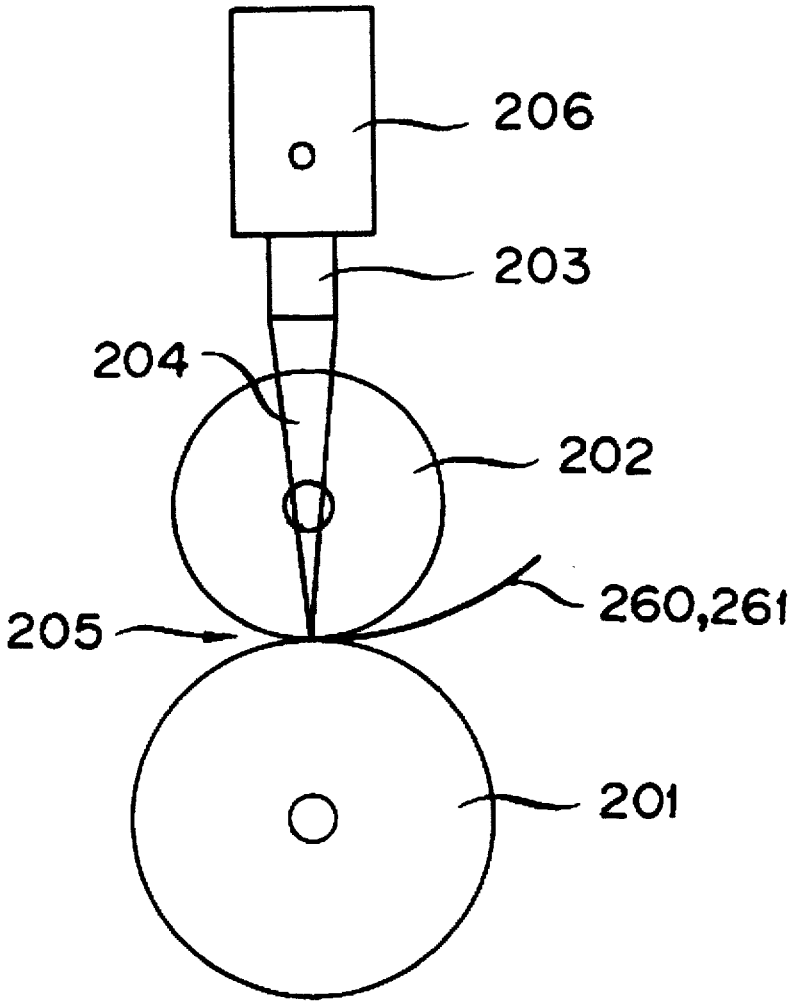
FIG. 66 Prior Art
FIG. 66 is a diagram showing another conventional rolling apparatus.

The ink sheet 61 is obtained by using a base film 61a of such a substance as polyethylene terephthalate having only small absorption in the range of wavelength of the light of the laser beam 56 and depositing on the base film 61a a photothermal conversion layer 61b of such a substance as carbon which has large absorption and an ink layer 61c having a dye dispersed in a macromolecular binding material. The ink sheet 61, therefore, is rolled on the recording paper 60 already rolled around the drum 1 in such a manner that, as shown in FIG. 63, the ink layer may face the image receiving layer 60c of the recording paper 60. A photosensor 58 capable of responding to the wavelength of the laser beam 56 is disposed in the area not subjected to image scanning on the outer periphery of the drum 1. This photosensor 58 is provided for the purpose of permitting the position of the laser beam to be detected by the prescanning which is performed prior to the actual scanning of the image (main scanning). FIG. 64 is a block diagram of a control part of this laser thermal ink transfer printer.

The photosensor 58 is disposed on the drum 1 as described above and is used for detecting the position of the laser beam.

A ROM 171 permits an operating program of the printer to be written therein.

A RAM 172 functions as an image data page memory for storing one page full of image data to be received as from an external computer.

A drum motor driver 173 is intended to control a drum motor 86 which is adapted to rotate the drum 1 in the direction of main scanning.

A laser beam source unit motor driver 174 is intended to control a secondary scanning motor 175 which is adapted to reciprocate the laser beam source unit 52 in the direction of secondary scanning.

A laser driver 176 is intended to drive a laser diode (LD) 177.

A CPU 170 is intended to effect overall control of the printer and issue instructions to the various drivers mentioned above.

The printer constructed as described above, after the recording paper 60 and the ink sheet 61 have been rolled around the outer periphery of the drum 1 as described above, utilizes the control of the CPU 170 to project a laser beam onto the ink sheet 61 and form an image on the recording paper 60. This printer is capable of printing images of high quality because the recording paper and the ink sheet are kept in close mutual contact owing to the use of the rolling apparatus of this invention.

What is claimed is:

1. A method for rolling a recording paper around a rotatable cylindrical drum, which method comprises:

a first step for causing first nipping means provided on the circumference of said cylindrical drum to nip one end of said recording paper, a second step for starting rotation of said cylindrical drum subsequently to said first step and thereby causing said recording paper to be rolled around said cylindrical drum, a third step for causing second nipping means provided on the circumference of said cylindrical drum to nip the other end of said recording paper subsequently to said second step, and a fourth step for moving one of said first nipping means and said second nipping means while the end of said recording paper that is not nipped by the nipping means that is moved is fixed relative to said circumference of said drum so as to force said recording paper into close contact with said cylindrical drum.

2. A method according to claim 1, wherein said fourth step for moving the one of said first nipping means and said second nipping means effects close contact of said recording paper with said cylindrical drum by causing the one of said first nipping means and said second nipping means to roll said recording paper.

3. A method according to claim 1, which is used for a laser thermal ink transfer process which forms an image on said recording paper by rolling said recording paper around said cylindrical drum, further rolling an ink sheet around said recording paper, and projecting a laser beam onto said ink sheet.

4. A method according to claim 2, which is used for a laser thermal ink transfer process which forms an image on said recording paper by rolling said recording paper around said cylindrical drum, further rolling an ink sheet around said recording paper, and projecting a laser beam onto said ink sheet.

5. The method according to claim 1, wherein the fourth step is moving said first nipping means.

6. The method according to claim 5, wherein the fourth step includes rotating the first nipping means.

7. An apparatus for rolling a recording paper around a rotatable cylindrical drum comprising:

first nipping means disposed on the circumference of said cylindrical drum and adapted to nip one end of said recording paper, second nipping means disposed on the circumference of said cylindrical drum and adapted to nip the other end of said recording paper, and moving means for moving one of said first nipping means and said second nipping means while the end of said recording paper that is not nipped by the nipping means that is moved is fixed relative to said circumference of said drum so as to bring said recording paper into close contact with said cylindrical drum.

8. An apparatus according to claim 7, wherein said moving means is a motor for rotating the one of said first nipping means and said second nipping means having said recording paper nipped on said cylindrical drum.

9. An apparatus according to claim 8, wherein said motor is a motor provided with a torque limiter and adapted to stop on exposure to a stated external force.

10. An apparatus according to claim 7, including means for enabling the apparatus to be used with a laser thermal ink transfer printer which forms an image on said recording paper by rolling said recording paper around said cylindrical drum, rolling an ink sheet around said recording paper, and projecting a laser beam onto said ink sheet.

11. An apparatus according to claim 8, including means for enabling the apparatus to be used with a laser thermal ink transfer printer which forms an image on said recording paper by rolling said recording paper around said cylindrical drum, rolling an ink sheet around said recording paper, and projecting a laser beam onto said ink sheet.

12. An apparatus according to claim 9, including means for enabling the apparatus to be used with a laser thermal ink transfer printer which forms an image on said recording paper by rolling said recording paper around said cylindrical drum, rolling an ink sheet around said recording paper, and projecting a laser beam onto said ink sheet.

13. An apparatus according to claim 7, wherein said moving means is a motor that moves said first nipping means.

14. An apparatus according to claim 13, wherein said motor includes means for rotating said first nipping means.

15. A method for rolling a recording paper and an ink sheet around a rotatable cylindrical drum, which method comprises:

a first step for causing first nipping means disposed on the circumference of said cylindrical drum to nip one end of said recording paper, a second step for rotating said cylindrical drum subsequently to said first step thereby rolling said recording paper around said cylindrical drum, a third step for causing second nipping means disposed on the circumference of said cylindrical drum subsequently to said second step to nip the other end of said recording paper, a fourth step for moving one of said first and said second nipping means subsequently to said third step thereby bringing said recording paper into close contact with said cylindrical drum, a fifth step for causing third nipping means disposed on the circumference of said cylindrical drum between said first and said second nipping means subsequently to said fourth step to nip one end of said ink sheet, a sixth step for rotating said cylindrical drum subsequently to said fifth step thereby rolling said ink sheet around said cylindrical drum, a seventh step for causing fourth nipping means disposed on the circumference of said cylindrical drum between first and said second nipping means subsequently to said sixth step to nip the other end of said ink sheet, and an eighth step for moving one of said third and said fourth nipping means subsequently to said seventh step thereby bringing said ink sheet into close contact with said cylindrical drum.

16. A method according to claim 15, wherein said fourth step for moving the one of said first nipping means and said second nipping means effects close contact of said recording paper with said cylindrical drum by causing the one of said first nipping means and said second nipping means to roll said recording paper.

17. A method according to claim 15, wherein said eighth step for moving the one of said third nipping means and said fourth nipping means effects close contact of said ink sheet with said recording paper already rolled around said cylindrical drum by causing the one of said third nipping means and said fourth nipping means to roll said ink sheet.

18. A method according to claim 15, which is used for a laser thermal ink transfer process which forms an image on said recording paper by rolling said recording paper and said ink sheet around said cylindrical drum and projecting a laser beam thereonto.

19. A method according to claim 16, which is used for a laser thermal ink transfer process which forms an image on said recording paper by rolling said recording paper and said ink sheet around said cylindrical drum and projecting a laser beam thereonto.

20. A method according to claim 17, which is used for a laser thermal ink transfer process which forms an image on said recording paper by rolling said recording paper and said ink sheet around said cylindrical drum and projecting a laser beam thereonto.

21. An apparatus for rolling a recording paper and an ink sheet around a rotatable cylindrical drum comprising:

first nipping means disposed on the circumference of said cylindrical drum and adapted to nip one end of said recording paper, second nipping means disposed on the circumference of said cylindrical drum and adapted to nip the other end of said recording paper, first moving means for moving one of said first and said second nipping means thereby bringing said recording paper into close contact with said cylindrical drum, third nipping means disposed on the circumference of said cylindrical drum between said first and said second nipping means and adapted to nip one end of said ink sheet, fourth nipping means disposed on the circumference of said cylindrical drum between said first and said second nipping means and adapted to nip the other end of said ink sheet, and second moving means for moving one of said third and said fourth nipping means thereby bringing said ink sheet into close contact with said cylindrical drum.

22. An apparatus according to claim 21, wherein said first moving means is a motor for moving the one of said first nipping means and said second nipping means nipping said recording paper on said cylindrical drum.

23. An apparatus according to claim 22, wherein said motor is a motor provided with a torque limiter and adapted to stop on exposure to a stated external force.

24. An apparatus according to claim 22, including means for enabling the apparatus to be used with a laser thermal ink transfer printer which forms an image on said recording paper by rolling said recording paper and said ink sheet around said cylindrical drum and projecting a laser beam thereunto.

25. An apparatus according to claim 23, including means for enabling the apparatus to be used with a laser thermal ink transfer printer which forms an image on said recording paper by rolling said recording paper and said ink sheet around said cylindrical drum and projecting a laser beam thereunto.

26. An apparatus according to claim 21, wherein said second moving means is a motor for moving the one of said third nipping means and said fourth nipping means nipping said ink sheet on said cylindrical drum.

27. An apparatus according to claim 26, wherein said motor is a motor provided with a torque limiter and adapted to stop on exposure to a stated external force.

28. An apparatus according to claim 26, including means for enabling the apparatus to be used with a laser thermal ink transfer printer which forms an image on said recording paper by rolling said recording paper and said ink sheet around said cylindrical drum and projecting a laser beam thereunto.

29. An apparatus according to claim 27, including means for enabling the apparatus to be used with a laser thermal ink transfer printer which forms an image on said recording paper by rolling said recording paper and said ink sheet around said cylindrical drum and projecting a laser beam thereunto.

30. An apparatus according to claim 26, wherein said motor includes means for rotating said third nipping means.

31. An apparatus according to claim 21, including means for enabling the apparatus to be used with a laser thermal ink transfer printer which forms an image on said recording paper by rolling said recording paper and said ink sheet around said cylindrical drum and projecting a laser beam thereunto.

32. An apparatus according to claim 22, wherein said motor includes means for rotating said first nipping means.

* * * * *